United States Patent [19]

Inagaki et al.

[11] Patent Number: 5,063,146

[45] Date of Patent: Nov. 5, 1991

[54] SILVER HALIDE PHOTOGRAPHIC MATERIAL

[75] Inventors: Yoshio Inagaki; Keiichi Adachi, both of Kanagawa, Japan

[73] Assignee: Fuji Photo Film Co., Ltd., Kanagawa, Japan

[21] Appl. No.: 487,078

[22] Filed: Mar. 1, 1990

[30] Foreign Application Priority Data

Mar. 2, 1989 [JP] Japan ..... 1-50874

[51] Int. Cl.[5] ..... G03C 1/02

[52] U.S. Cl. ..... 430/522; 430/593; 430/944

[58] Field of Search ..... 430/522, 593, 944

[56] References Cited

U.S. PATENT DOCUMENTS

| | | | |
|---|---|---|---|
| 4,102,688 | 7/1978 | Sugiyama et al. | 96/139 |
| 4,182,886 | 1/1980 | Kitzing et al. | 546/304 |
| 4,233,399 | 11/1980 | Kitzing et al. | 430/510 |
| 4,920,031 | 4/1990 | Ohno et al. | 430/522 |

FOREIGN PATENT DOCUMENTS

| | | |
|---|---|---|
| 2720982 | 11/1977 | Fed. Rep. of Germany . |
| 2382485 | 9/1978 | France . |

*Primary Examiner*—Charles L. Bowers, Jr.

*Assistant Examiner*—Thomas R. Neville

*Attorney, Agent, or Firm*—Sughrue, Mion, Zinn Macpeak & Seas

[57] ABSTRACT

A silver halide photographic material having a hydrophilic colloidal layer containing a dispersion of fine solid particles of a dye is disclosed, said dye being represented by formula (I):

(I)

wherein L represents a nitrogen atom or a group composed of 1, 3, 5 or 7 substituted or unsubstituted methine group(s) connected via a conjugated double bond(s); E represents O, S, or N—$R^9$; and $R^0$ through $R^9$ are as defined in the specification. The dye of formula (I) colors a specific hydrophilic colloidal layer without being diffused to other layers and is rapidly decolorized or washed off on development processing.

18 Claims, No Drawings

SILVER HALIDE PHOTOGRAPHIC MATERIAL

FIELD OF THE INVENTION

This invention relates to a silver halide photographic material containing a novel dye.

BACKGROUND OF THE INVENTION

Emulsion layers or other hydrophilic colloidal layers in silver halide photographic materials are often colored for the purpose of absorbing light of a specific wavelength region.

When control of a spectral composition of incident light is needed, a colored layer is usually provided at the position farther from a support than a photographic emulsion layer. Such a colored layer is called a filter layer. Where there are two or more photographic emulsion layers, the filter layer is sometimes interposed between the emulsion layers.

Light scattered during or after passage through a photographic emulsion layer is reflected on the interface between an emulsion layer and a support or on the surface of a photographic material on the side opposited to a photographic emulsion layer and again enters in the photographic emulsion layer to cause image smearing, i.e., halation. In order to prevent such a phenomenon, a colored layer called an antihalation layer is usually provided between a photographic emulsion layer and a support or on the surface of a support on the side opposite to a photographic emulsion layer. Where there are two or more photographic emulsion layers, the antihalation layer is sometimes provided between these emulsion layers.

Further, coloration of a photographic emulsion layer is also conducted in order to prevent reduction of image sharpness due to light scatter within a photographic emulsion layer (this phenomenon is generally called irradiation).

The hydrophilic colloidal layer to be colored generally contains a dye. Dyes which can be used for the above purposes are required to show proper spectral absorption according to the end use, to be photochemically inert (that is, to give no chemically adverse influence on performance of a silver halide photographic emulsion layer, such as reduction in sensitivity, fading of a latent image, and fogging), to be decolorized or bleached during photographic processing or dissolved in a processing solution or washing water, leaving no harmful color in a processed photographic material, not to diffuse from a layer where they are fixed to other layers, and to exhibit excellent stability with time in solutions or in a photographic material without undergoing color change.

When in particular, the colored layer is a filter layer or an antihalation layer provided on the same side as a photographic emulsion layer with respect to a support, the dye to be used is required, in many cases, to exclusively color the desired layer without coloring other layers. Otherwise, the dye would exert harmful spectral effects on other layers and also their own effects as a filter layer or an antihalation layer would be lessened. However, when a dye-containing layer is brought into contact with other hydrophilic colloidal layer in a wet state, cases are often met in which a part of the dye in the former layer diffuses into the latter layer. Many efforts have conventionally been made in order to prevent such dye diffusion.

For example, it has been proposed to incorporate a hydrophilic polymer having a charge opposite to a dissociated anionic dye into a specific layer as a mordant to thereby localize the dye in that specific layer by the mutual action between the polymer and dye molecules, and disclosed in U.S. Pat. No. 2,548,564, 4,124,386, and 3,625,694.

Further, methods of dying a specific layer by using a water-insoluble solid dye have been suggested in JP-A-56-12639, JP-A-52-92716, JP-A-55-155350, JP-A-55-155351, JP-A-63-27838, JP-A-63-197943 (the term "JP-A" as used herein means an "unexamined published Japanese patent application"), European Patent 15,601, U.S. Pat. Nos. 4,803,150 and 4,855,221, and WO 88/04794.

Furthermore, methods of dyeing a specific layer with metallic salt fine particles on which a dye is adsorbed are disclosed in U.S. Pat. Nos.2,719,088, 2,496,841, and 2,496,843 and JP-A-60-45237.

Even with these improved methods, however, there have been pointed out problems that the rate of decoloration on development processing is still low and that the decolorizing function of the dye cannot be always taken full advantage of in cases where various alterations for improvement, such as speeding up of processing, changes in composition of processing solutions or photographic emulsions, are made.

On the other hand, it has been demanded to develop a hydrophilic colloidal layer containing a dispersion of fine solid particles of a dye which is applicable to photographic light-sensitive materials sensitive to near infrared light, for example, a dye which absorbs light having a wavelength of from 700 to 1000 nm and, also, is sufficiently decolorized or washed off during development processing. However, a dye meeting such demands has not yet been found.

SUMMARY OF THE INVENTION

An object of this invention is to provide a silver halide photographic material containing a dye which colors a specific hydrophilic colloidal layer and is rapidly decolorized during development processing.

Another object of this invention is to provide a silver halide photographic material having a hydrophilic colloidal layer containing a dye which absorbs light in the near infrared region and is rapidly decolorized during development processing.

A further object of this invention is to provide a silver halide photographic material containing a dye which is dispersed in the form of fine solid particles so as not to diffuse to other hydrophilic colloidal layers and is still rapidly decolorized during development processing.

As a result of extensive investigations, the inventors have found that the above objects of this invention are accomplished by a silver halide photographic material having a hydrophilic colloidal layer containing a dispersion of fine solid particles of a dye represented by formula (I) shown below and thus completed the present invention.

Formula (I) is represented by:

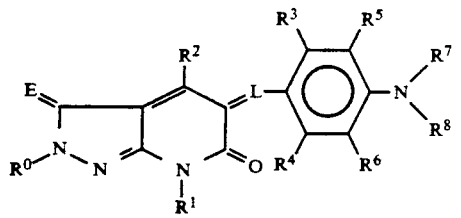

(I)

wherein L represents a nitrogen atom or a group composed of 1, 3, 5 or 7 substituted or unsubstituted methine group(s) connected via a conjugated double bond(s); E represents O, S, or N—$R^9$; $R^0$ or $R^9$ each represents a hydrogen atoms, a substituted or unsubstituted alkyl group, a substituted or unsubstituted alkenyl group, a substituted or unsubstituted alkynyl group, a substituted or unsubstituted aryl group, a substituted or unsubstituted heterocyclic group, a substituted or unsubstituted amino group, a substituted or unsubstituted hydrazino group, or a substituted or unsubstituted diazenyl group; $R^1$ represents a hydrogen atom, a substituted or unsubstituted alkyl group, a substituted or unsubstituted aryl group, a substituted or unsubstituted alkenyl group, a substituted or unsubstituted alkynyl group, or a substituted or unsubstituted heterocyclic group; $R^2$ represents a hydrogen atom, a halogen atom, a cyano group, a nitro group, a hydroxyl group, a carboxyl group, a substituted or unsubstituted alkyl group, a substituted or unsubstituted aryl group, a substituted or unsubstituted alkenyl group, a substituted or unsubstituted heterocyclic group, a substituted or unsubstituted alkoxyl group, a substituted or unsubstituted aryloxy group, a substituted or unsubstituted alkoxycarbonyl group, a substituted or unsubstituted aryloxycarbonyl group, a substituted or unsubstituted amino group, a substituted or unsubstituted acyloxy group, a substituted or unsubstituted carbamoyl group, a substituted or unsubstituted sulfamoyl group, a substituted or unsubstituted alkylthio group, a substituted or unsubstituted arylthio group, a substituted or unsubstituted alkylsulfonyl group, a substituted or unsubstituted arylsulfonyl group, or a substituted or unsubstituted alkynyl group; $R^0$ and $R^9$ may be connected to each other to form a ring; $R^3$ and $R^4$ each represents a hydrogen atom, a halogen atom, an alkoxyl group, an alkyl group, an alkenyl group, an aryloxy group, or an aryl group; $R^5$ and $R^6$ each represents a hydrogen atom or a group capable of substituting a hydrogen atom; $R^7$ and $R^8$ each represents an alkyl group, an aryl group, a vinyl group, an acyl group, an alkylsulfonyl group, or an arylsulfonyl group; and $R^3$ and $R^5$, $R^4$ and $R^6$, $R^1$ and $R^8$, $R^5$ and $R^7$, or $R^6$ and $R^8$ may be connected to each other to form a ring.

DETAILED DESCRIPTION OF THE INVENTION

In formula (I), L preferably represents a nitrogen atom or a group represented by formula (Ia), and more preferably represents the group represented by formula (Ia):

$$=L_1(L_2=L_3)_p \qquad \text{(Ia)}$$

wherein $L_1$, $L_2$, and $L_3$ each represents a substituted or unsubstituted methine group; and p represents 0 or 1.

Substituents on the methine group $L_1$, $L_2$, or $L_3$ include methyl and ethyl groups.

E in formula (I) preferably represents O or N-$R^9$. $R^9$ preferably represents a substituted or unsubstituted alkyl group having from 1 to 20 carbon atoms (e.g., methyl, ethyl, n-propyl, and n-octyl), a substituted or unsubstituted alkenyl group having from 3 to 6 carbon atoms (e.g., allyl), a substituted or unsubstituted aryl group having from 6 to 10 carbon atoms (e.g., phenyl and naphthyl), a substituted or unsubstituted amino group, a substituted or unsubstituted hydrazino group, or a substituted or unsubstituted diazenyl group. Where E is N-$R^9$, $R^9$ is preferably connected to $R^0$ to form a ring. The ring formed by $R^0$ and $R^9$ preferably includes an imidazole ring, a triazole ring, and a tetrazole ring, each of which may be substituted. These rings may be fused with other ring(s) to form condensed rings (e.g., benzoimidazole).

$R^0$ preferably represents a substituted or unsubstituted alkyl group having from 1 to 20 carbon atoms (e.g., methyl, ethyl, n-propyl, t-butyl, n-butyl, n-octyl, n-dodecyl, and isooctadecyl), a substituted or unsubstituted aryl group having from 6 to 20 carbon atoms (e.g., phenyl and naphthyl), or a substituted or unsubstituted 5- or 6-membered heterocyclic ring containing at least one of B, N, O, S, Se and Te atoms as a hetero atom. Specific examples of the heterocyclic ring as represented by $R^0$ include saturated heterocyclic rings, e.g., substituted or unsubstituted pyrrolidyl, morpholino, 2-bora-1,3-dioxolanyl and 1,3-thiazolidinyl rings; and unsaturated heterocyclic rings, e.g., substituted or unsubstituted imidazolyl, thiazolyl, benzothiazolyl, benzoxazolyl, benzotellurazolyl, benzoselenazolyl, pyridyl, pyrimidinyl, and quinolinyl rings. Substituents on these groups as $R^0$ are not particularly limited unless they dissolve the dye molecules on coating the fine solid dispersion of the dye (e.g., a sulfo group). Examples of suitable substituents are a halogen atom (e.g., F, Cl, Br, and I), a cyano group, a nitro group, a carboxyl group, a hydroxyl group, an alkoxyl group having from 1 to 20 carbon atoms (e.g., methoxy, isopropoxy, and hexadecyloxy), an aryloxy group having from 6 to 10 carbon atoms (e.g., phenoxy, 4-carboxyphenoxy, 2,4-di-t-pentylphenoxy, m-pentadecylphenoxy, p-methoxyphenyl, and 3,5-dichlorophenyl), an alkyl group having from 1 to 20 carbon atoms (e.g., methyl, ethyl, n-propyl, isopropyl, t-butyl, 2-methoxyethyl, and trifluoromethyl), an aryl group having from 6 to 10 carbon atoms (e.g., phenyl, 2-carboxyphenyl, 3-carboxyphenyl, 4-carboxyphenyl, 3,5dicarboxyphenyl, 3-chlorophenyl, 4-methanesulfonamidophenyl, 4-hexylphenyl, and 2-naphthyl), an unsubstituted amino group, a substituted amino group having from 1 to 20 carbon atoms (e.g., dimethylamino, methylamino, diethylamino, phenylamino, acetylamino, methanesulfonylamino, methylcarbamoylamino, phenylthiocarbamoylamino, and benzene-sulfonylamino), an unsubstituted carbamoyl group, a substituted carbamoyl group having from 2 to 20 carbon atoms (e.g., ethylcarbamoyl, methylcarbamoyl, phenylcarbamoyl, octadecylcarbamoyl, diethylcarbamoyl, and pyrrolidinocarbonyl), an unsubstituted sulfamoyl group, a substituted sulfamoyl group having from 1 to 20 carbon atoms (e.g., methylsulfamoyl, dimethylsulfamoyl, t-butylsulfamoyl, phenylsulfamoyl, pyrrolidinosulfonyl, and 3-(2,4-di-t-pentylphenoxy)butylsulfamoyl), an alkylthio group having from 1 to 20 carbon atoms (e.g., methylthio, benzylthio, and octadecylthio), an arylthio group having from 6 to 10 carbon atoms (e.g., phenylthio), an alkylsulfonyl group having from 1 to 20 carbon atoms (e.g., methanesulfonyl and 2-ethoxyethylsulfonyl), an arylsulfonyl group having from 6 to 10 carbon atoms (e.g., benzylenesulfonyl, dodecylbenzenesulfonyl, and 2-(2-methoxyethoxy)-5-(4-hydroxyphenylazo)benzenesulfonyl), and an ester group having from 2 to 20 carbon atoms (e.g., methoxycarbonyl, ethoxycarbonyl, octadecyloxycarbonyl, and phenoxycarbonyl).

Of these groups for $R^0$, particularly preferred are a hydrogen atom, a substituted or unsubstituted alkyl group having from 1 to 10 carbon atoms (e.g., methyl, ethyl, n-propyl, n-hexyl, n-decyl, and isopropyl) (the substituent is selected from those enumerated above), a substituted or unsubstituted aryl group having from 6 to 10 carbon atoms (e.g., phenyl and naphthyl) (the substituent is selected from those enumerated above), and a 5- or 6-membered heterocyclic group (e.g., 2-pyridyl, 4-pyridyl, 2-benzothiazolyl, 2-(1-methylimidazolyl), and 4,6-diethylamino-2-triazinyl).

$R^1$ preferably represents a hydrogen atom, a substituted or unsubstituted alkyl group having from 1 to 20 carbon atoms, a substituted or unsubstituted aryl group having from 6 to 10 carbon atoms, or a substituted or unsubstituted 5- or 6-membered heterocyclic group containing at least one of B, N, O, S, Se and Te atoms as a hetero atom. Substituents on these groups are preferably selected from those enumerated above with respect to $R^0$.

$R^1$ more preferably represents a hydrogen atom, an alkyl group having from 1 to 10 carbon atoms which may be substituted with a group selected from those enumerated above as substituents for $R^0$ (e.g., methyl, ethyl, n-propyl, t-butyl, benzyl, 2-methoxyethyl, trifluoromethyl, and benzoyloxymethyl), a phenyl group which may be substituted with a group selected from those enumerated above as substituents for $R^0$ (e.g., phenyl, 4-carboxyphenyl, 4-methoxyphenyl, 3-chlorophenyl, 3-trifluoromethylphenyl, 2-methanesulfonyl-4-nitrophenyl, 2-nitro-4-dimethylsulfamoylphenyl, and 4-methanesulfonylphenyl), or a 5- or 6-membered heterocyclic ring (e.g., 2-pyridyl, 4-pyridyl, 3-pyridyl, 2-benzothiazolyl, 2-(1-methylimidazolyl), and 4,6-dibutylamino-2-triazinyl).

$R^2$ preferably represents a hydrogen atom, a substituted or unsubstituted alkyl group having from 1 to 20 carbon atoms, a substituted or unsubstituted aryl group having from 6 to 10 carbon atoms, a substituted or unsubstituted carbamoyl group having from 1 to 20 carbon atoms, a substituted or unsubstituted alkoxycarbonyl group having from 2 to 20 carbon atoms, a substituted or unsubstituted aryloxycarbonyl group having from 7 to 11 carbon atoms, a carboxyl group, or a hydroxyl group. Substituents on these groups are preferably selected from those enumerated above with respect to $R^0$.

Examples of preferred groups as $R^2$ are methyl, ethyl, t-butyl, trifluoromethyl, 2-ethylhexyl, and pentadecyl, phenyl, 4-carboxyphenyl, 4-methoxyphenyl, 4-nitrophenyl, carbamoyl, methylcarbamoyl, butylcarbamoyl, diethylcarbamoyl, pyrrolidinocarbonyl, morpholinocarbonyl, hydroxyethylcarbamoyl, phenylcarbamoyl, 4-carboxyphenylcarbamoyl, 2-methoxyethoxycarbamoyl, 2-ethylhexylcarbamoyl, ethoxycarbonyl, butoxycarbonyl, benzyloxycarbonyl, 2-methoxyethoxycarbonyl, and 2-dodecyloxyethoxycarbonyl.

$R^3$ and $R^4$ each preferably represents a hydrogen atom, a chlorine atom, a fluorine atom, a substituted or unsubstituted alkoxyl group having 1 to 10 carbon atoms (e.g., methoxy, ethoxy, and octoxy) or a substituted or unsubstituted alkyl group having from 1 to 10 carbon atoms (e.g., methyl, isopropyl, 2-methoxyethyl, and benzyl).

$R^3$ and $R^4$ more preferably represents a hydrogen atom, a chlorine atom, an alkyl group having from 1 to 5 carbon atoms (e.g., methyl, ethyl, isopropyl, isobutyl, and t-amyl), or an alkoxyl group having from 1 to 8 carbon atoms (e.g., methoxy, ethoxy, sec-butoxy, t-butoxy, and 2-methoxyethoxy).

The group capable of substituting a hydrogen atom as represented by $R^5$ or $R^6$ includes a halogen atom (e.g., F, Cl, and Br), a hydroxyl group, a cyano group, a substituted or unsubstituted alkyl group having from 1 to 10 carbon atoms (e.g., methyl, ethyl, butyl, and 2-ethylhexyl), and a substituted or unsubstituted aryl group having from 6 to 10 carbon atoms (e.g., phenyl, naphthyl, 4-carboxyphenyl, 3-sulfamoylphenyl, and 5-methanesulfonamido-1-naphthyl), said alkyl or aryl group being bonded to the benzene ring either directly or via a divalent linking group. Examples of the divalent linking group are —O—, —NHCO—, —$NHSO_2$—, —NHCOO—, —NHCONH—, —COO—, —CO—, —$SO_2$—, and —NR— [wherein R represents a hydrogen atom or a substituted or unsubstituted alkyl group having from 1 to 6 carbon atoms (e.g., methyl, ethyl, and n-butyl)].

$R^5$ and $R^6$ each preferably represents a hydrogen atom or an alkyl group having from 1 to 8 carbon atoms (e.g., methyl, ethyl, isobutyl, cyclohexyl, and 2-ethoxypropylethyl).

$R^7$ and $R^8$, which may be the same or different, each preferably represents an alkyl group having from 1 to 18 carbon atoms (e.g., methyl, ethyl, propyl, isobutyl, n-octyl, n-dodecyl, and n-octadecyl) which may have a substituent [e.g., a cyano group, a hydroxyl group, an alkoxyl group (e.g., methoxy and ethoxy groups), a carboxyl group, an aryloxy group (e.g., phenoxy), an amido group (e.g., acetamido and methanesulfonamido), and a halogen. atom (e.g., Cl and F)]; a phenyl or naphthyl group which may have a substituent [e.g., a carboxyl group, a hydroxyl group, a cyano group, a halogen atom (e.g., Cl and F), an acyl group having from 2 to 18 carbon atoms (e.g., acetyl, propionyl, and stearoyl), a sulfonyl group having from 1 to 18 carbon atoms (e.g., methanesulfonyl, ethanesulfonyl, and octanesulfonyl), a carbamoyl group having from 1 to 18 carbon atoms (e.g., carbamoyl, methylcarbamoyl, and octylcarbamoyl), a sulfamoyl group having from 1 to 18 carbon atoms (e.g., sulfamoyl, methylsulfamoyl, and butylsulfamoyl), an alkoxycarbonyl group having from 2 to 18 carbon atoms (e.g., methoxycarbonyl, trichloroethoxycarbonyl, and decyloxycarbonyl), an alkoxyl group having from 1 to 18 carbon atoms (e.g., methoxy, butoxy, and pentadecyloxy), and an amino group (e.g., dimethylamino, diethylamino, and dihexylamino)]; a substituted or unsubstituted vinyl group having from 2 to 18 carbon atoms (e.g., vinyl, 1-propenyl, 2,2-dimethylvinyl, and 1-methyl-1-propenyl groups); a substituted or unsubstituted aliphatic or aromatic acyl group having from 1 to 18 carbon atoms (e.g., acetyl, pivaloyl, benzoyl, and 2-carboxybenzoyl groups); or a substituted or unsubstituted alkyl- or arylsulfonyl group having from 1 to 18 carbon atoms (e.g., methanesulfonyl, octanesulfonyl, benzenesulfonyl, 3-carboxybenzenesulfonyl, trifluoromethanesulfonyl, and hydroxymethanesulfonyl).

The ring formed by connecting $R^3$ and $R^5$ or connecting $R^4$ and $R^6$ preferably includes a 5- or 6- L membered ring, and more preferably an aromatic ring (e.g., benzene ring) and a heterocyclic aromatic ring (e.g., pyridine, imidazole, thiazole, and pyrimidine rings).

The ring formed by connecting $R^5$ and $R^7$ or connecting $R^6$ and $R^8$ preferably includes a 5- or 6-membered ring.

The ring formed by connecting $R^7$ and $R^8$ preferably includes a 5- or 6-membered ring, and more preferably pyrrolidine, piperidine, and morpholine rings.

As any of the substituents possessed by the compound represented by formula (I), those having a pKa value (acid dissociation constant) of 2 or smaller, e.g., sulfo groups, are unfavorable, and those having a pKa value of 3 or larger are preferred. In particular, to facilitate washing off from a light-sensitive material on development, it is preferable that the compound of formula (I) contains 1 to 4 substituents having a pKa value of from 3 to 12, more preferably from 4 to 11. Examples of such substituents are a carboxyl group, a phenolic hydroxyl group, —$NHSO_2$—, and an active methylene group (e.g., —$COCH_2CO$—). A carboxyl group directly bonded to an aryl group is particularly preferred.

Specific examples of the compound represented by formula (I) are shown below, but the present invention is not deemed to be limited thereto.

1

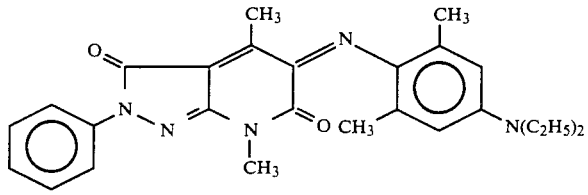

2

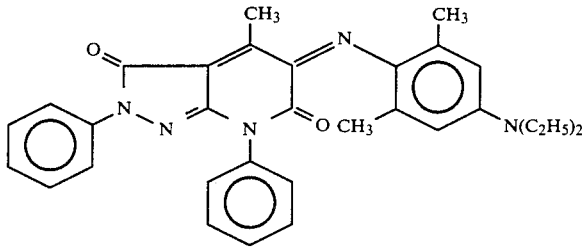

3

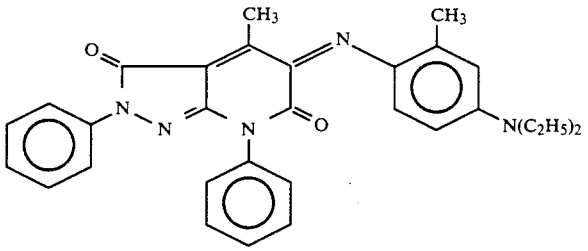

4

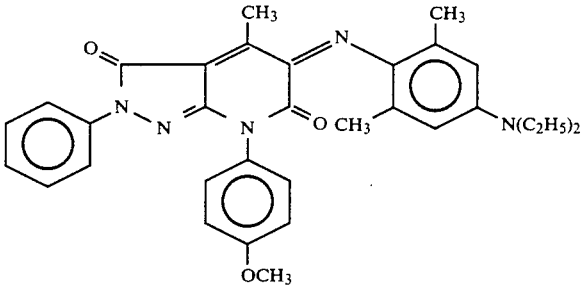

5

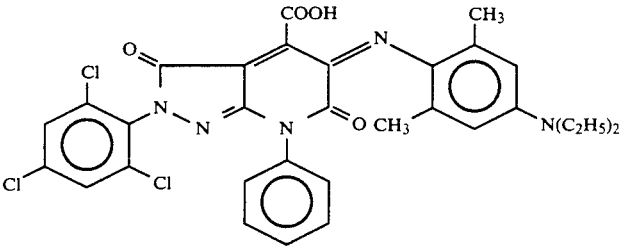

-continued
6
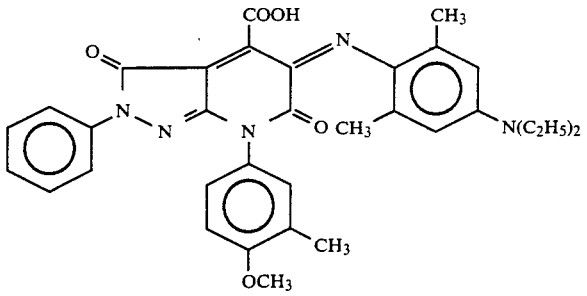
7
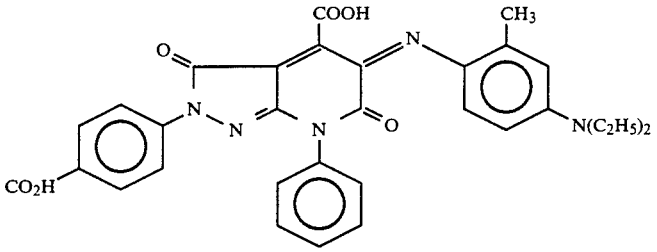
8
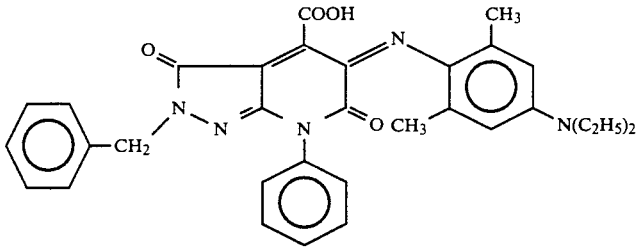
9
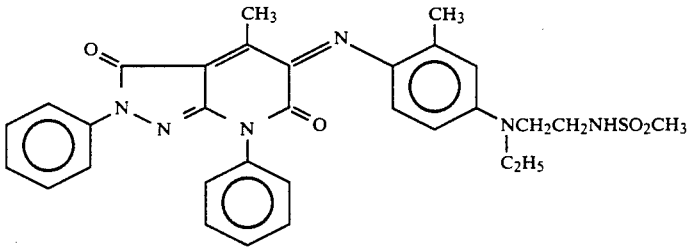
10
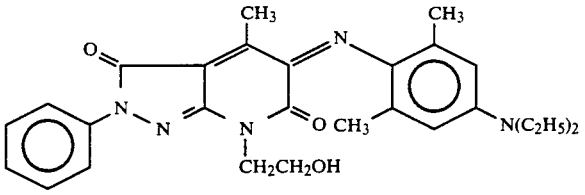
11
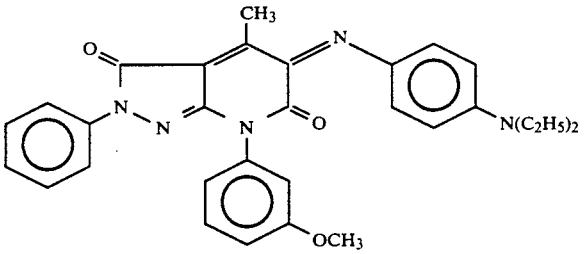

-continued
12
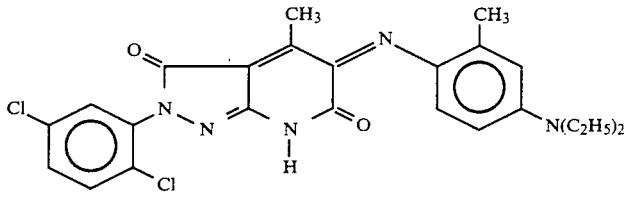
13
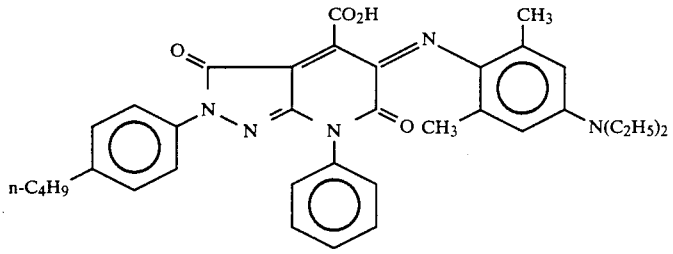
14
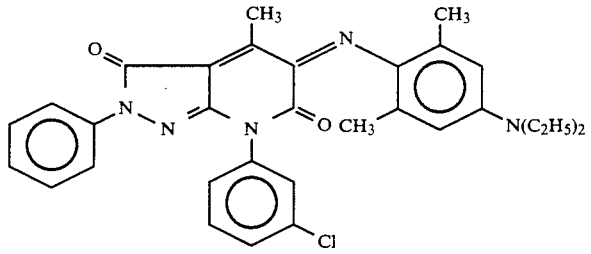
15
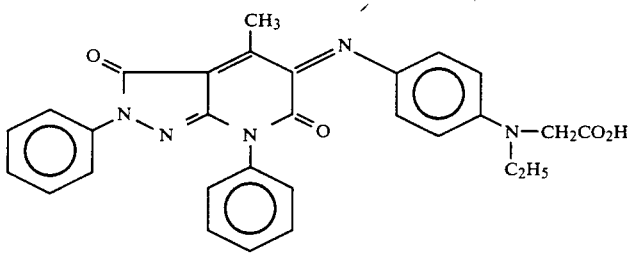
16
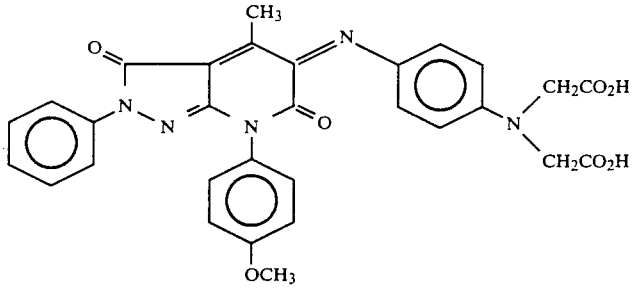
17
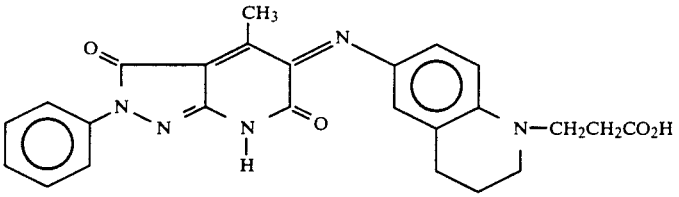
18
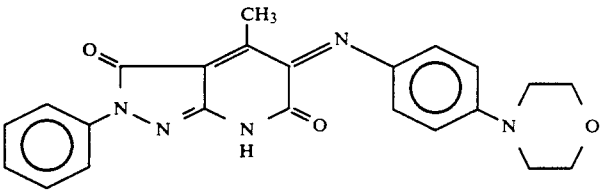

-continued
19
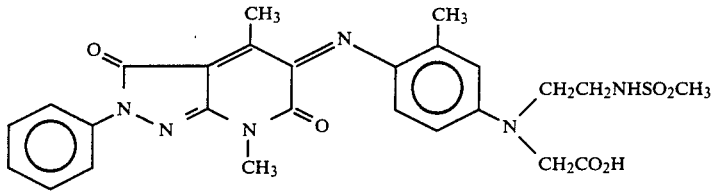
20
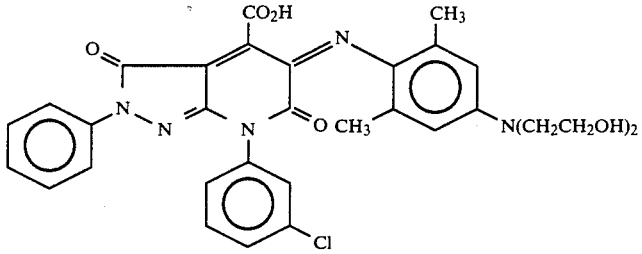
21
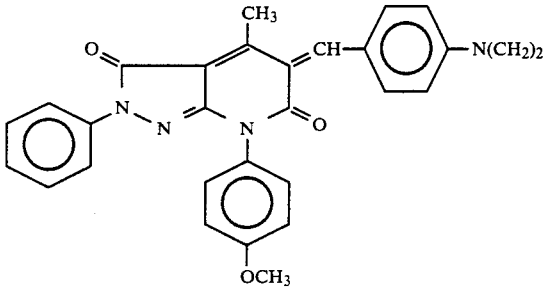
22
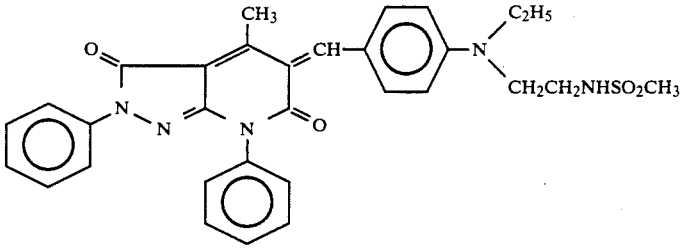
23
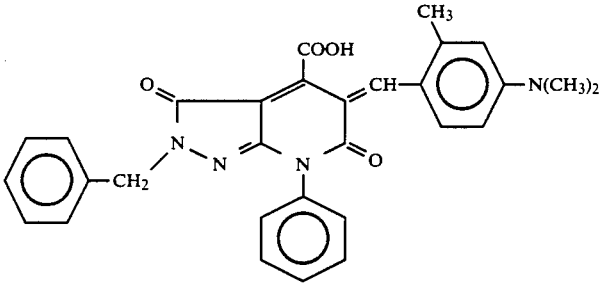
24
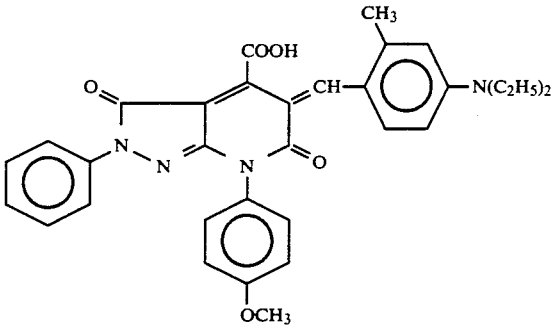

-continued
25
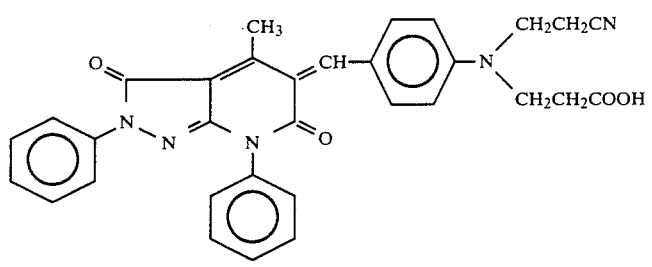
26
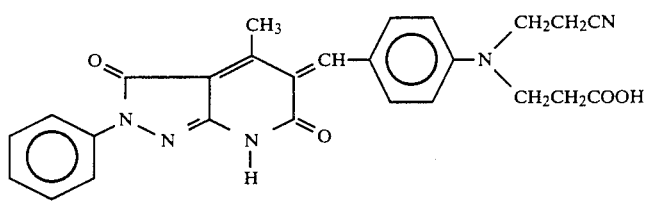
27
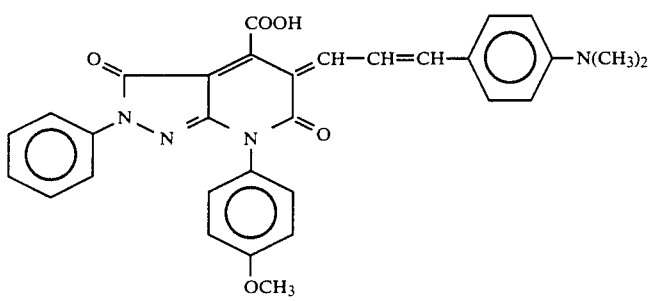
28
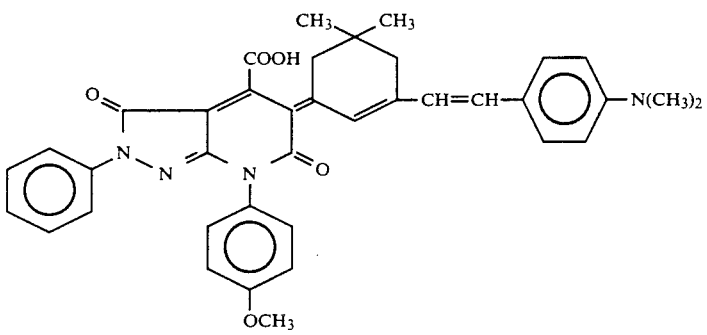
29
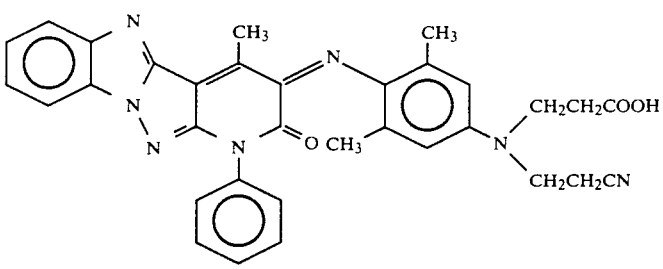
30
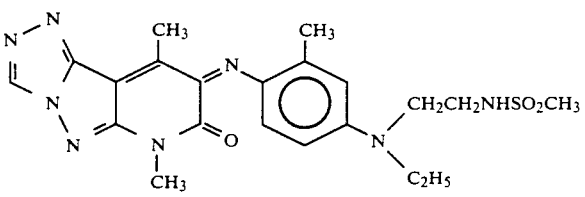

-continued
31
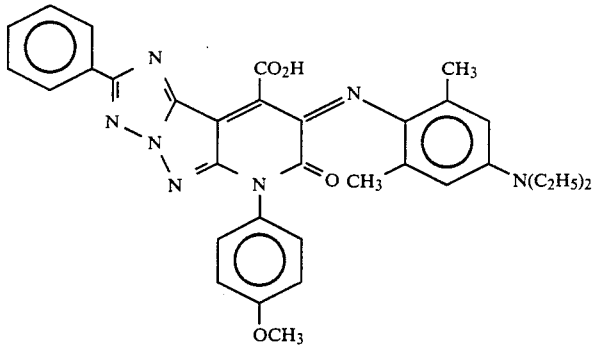
32
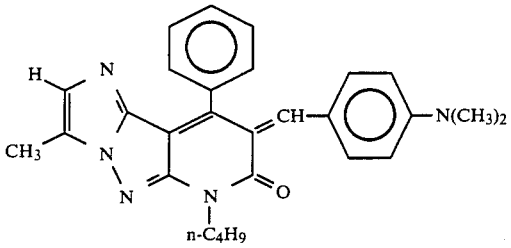
33
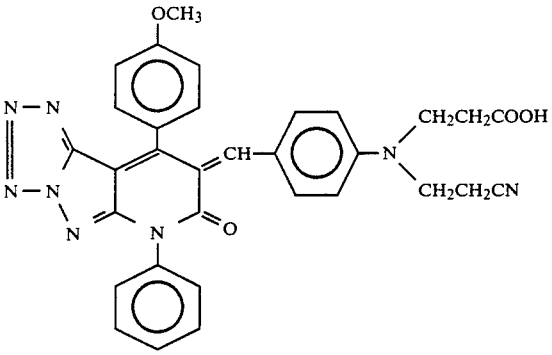
34
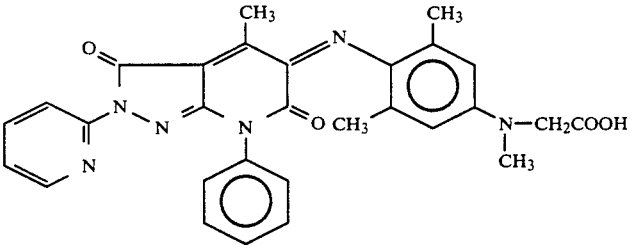
35
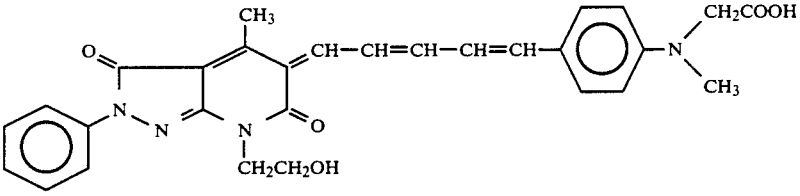
36
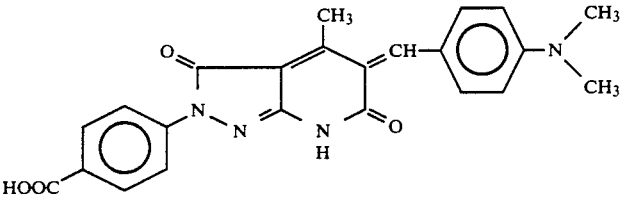

-continued
37
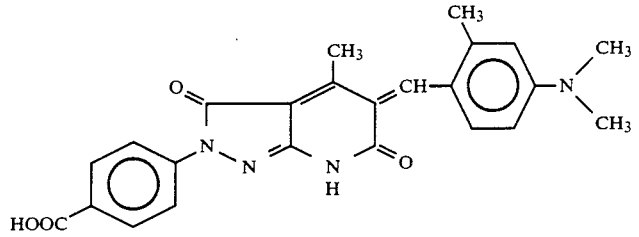
38
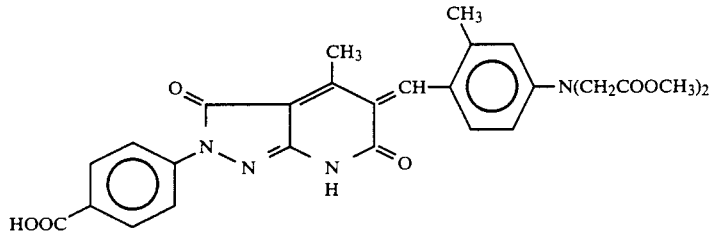
39
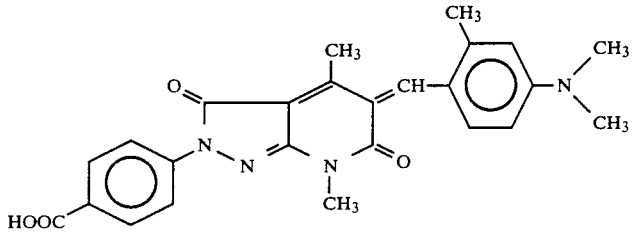
40
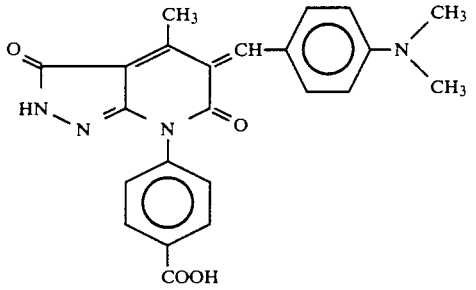
41
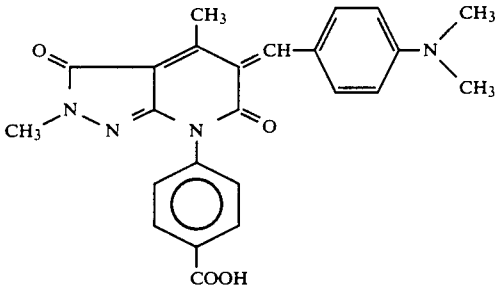
42
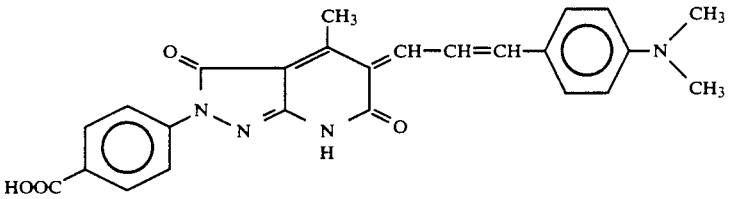

-continued
43
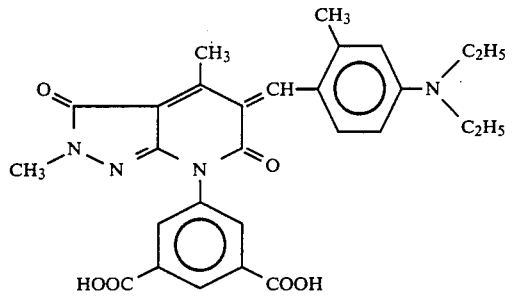
44
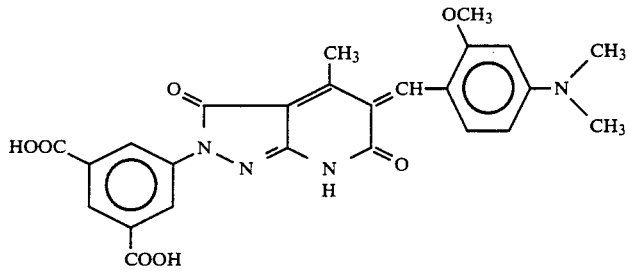
45
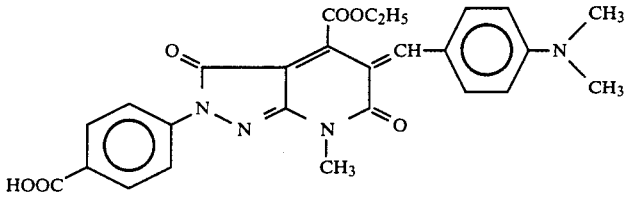
46
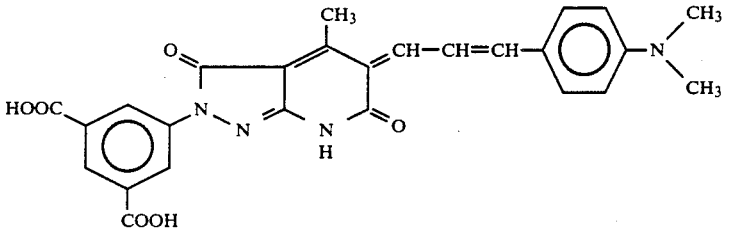
47
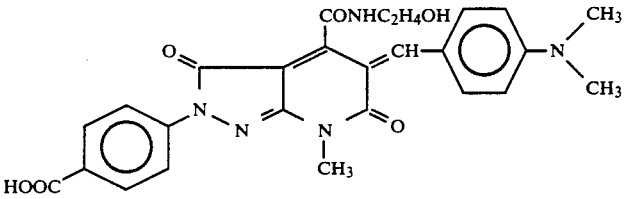
48
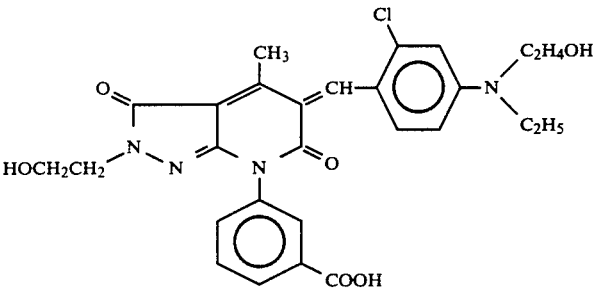

-continued

49

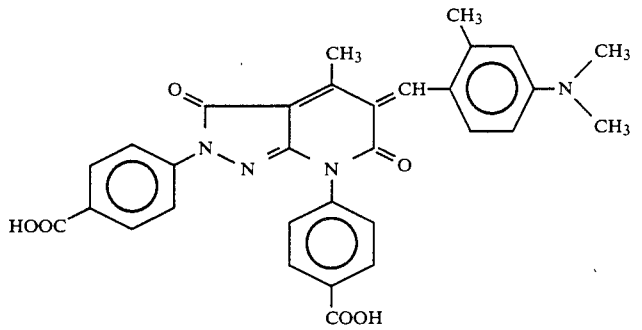

50

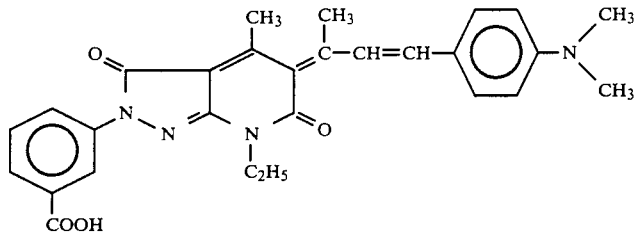

The compounds of formula (I) according to the present invention can be synthesized with reference to the process described in JP-A-52-135335 which comprises condensing a compound represented by formula (II):

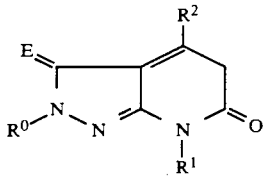

(II)

wherein $R^0$, $R^1$, $R^2$, and E are as defined above, with a nitrosoaniline derivative, a benzaldehyde derivative, or a cinnamic aldehyde derivative.

The compound represented by formula (II) can be synthesized by heating a compound represented by formula (III):

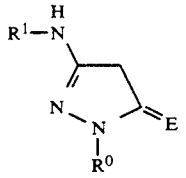

(III)

wherein $R^0$, $R^1$, and E are as defined above, and a compound represented by formula (IV):

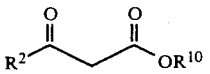

(IV)

wherein $R^2$ is as defined above; and $R^{10}$ represents an alkyl group or an aryl group, under an acidic condition.

As a matter of course, functional groups on the compounds of formulae (I) and (II) may be converted to other functional groups in a known manner.

Synthesis examples of the compounds according to the present invention are described below.

SYNTHESIS EXAMPLE 1

Synthesis of Compound 2

A mixture of 25 g of 1-phenyl-3-anilino-2-pyrazolin-5-one, 18 g of ethyl acetoacetate, and 150 ml of acetic acid was heat-refluxed for 6 hours. The reaction mixture was diluted with water, and the formed solid was crystallized from acetonitrile to obtain 10.9 g of 2,7-diphenyl-4-methylpyrazolo[3,4-b]pyridine-3,6-dione having a melting point of 145° to 147° C.

To 3.17 g of the resulting compound were added 150 ml of methanol and 1.4 ml of triethylamine to form a solution, and 2.4 g of N,N-diethyl-2,5-dimethyl-4-nitrosoaniline hydrochloride and 0.94 ml of acetic anhydride were added to the solution, followed by stirring at room temperature for 1 hour. The precipitated crystals were collected by filtration, washed with methanol, and dissolved in a 1:5 (by volume) mixture of ethyl acetate and chloroform. The solution was passed through a short column of silica gel for purification. The solvent was removed by distillation, the residue was dissolved in chloroform, and methanol was added to the solution. The thus formed crystals were collected by filtration and dried to obtain 0.3 g of Compound 2 having a melting point of 183° to 185° C.

SYNTHESIS EXAMPLE 2

Synthesis of Compound 12

To 48.8 g of 3-amino-1-(2,5-dichlorophenyl)-2-pyrazolin-5-one were added 200 ml of acetic acid and 26.4 g of ethyl acetoacetate, and the solution was refluxed for 2 hours. The reaction mixture was poured into 800 ml of water, and the formed crystals were collected by filtration and washed successively with water, isopropanol, and ethyl acetate. The crystals were dispersed in 200 ml of isopropanol, and the dispersion was heated while stirring for washing. The crystals were filtered and dried to obtain 4.7 g of 4-methyl-2-(2,5-dichlorophenyl)pyrazolo[3,4-b]pyridine-3,6-dione.

To 3.1 g of the resulting compound were added 200 ml of methanol and 1.4 ml of triethylamine to form a solution, and 1.92 g of N,N-diethyl-4-nitrosometatoluidine and 0.94 ml of acetic anhydride were added to the solution, followed by stirring at room temperature for 30 minutes. After adding 0.7 ml of acetic acid thereto, the mixture was poured into 500 ml of water and then extracted with chloroform. The extract was purified twice by silica gel column chromatography. The bluish green portion was collected, and the solvent was removed by distillation to obtain 0.6 g of Compound 12 having a melting point of 300° C. or higher.

SYNTHESIS EXAMPLE 3

Synthesis of Compound 14

To 5.7 g of 3-(3-chlorophenylamino)-1-phenyl-2-pyrazolin-5-one were added 30 ml of acetic acid and 4 g of ethyl acetoacetate and the solution was heated at a bath temperature of 150° C. for 10 hours and 20 minutes while stirring. Any insoluble matter was collected by filtration while hot, washed with isopropanol, and air-dried to obtain 2.3 g of 7-(3-chlorophenyl)-2-phenyl-4-methylpyrazolo[3,4-b]pyridine-3,6-dione having a melting point of 278° to 282° C.

To 1.5 g of the resulting compound were added 100 ml of methanol and 0.6 ml of triethylamine. After removing a trace amount of an insoluble matter by filtration, 1.1 g of N,N-diethyl-3,5-dimethyl-4-nitrosoaniline hydrochloride and 0.41 ml of acetic anhydride were added to the solution, followed by stirring at room temperature for 30 minutes. The precipitated crystals were collected by filtration, washed with methanol and recrystallized from a mixture of chloroform and methanol to obtain 0.2 g of compound 14 having a melting point of 178° to 180° C.

SYNTHESIS EXAMPLE 4

Synthesis of Compound 36

A mixture of 2.8 g of 2-(4-carboxyphenyl)-4-methylpyrazolo[3,4-b]pyridine-3,6-dione, 1.6 g of 4-dimethylaminobenzaldehyde, 25 ml of acetic acid, and 5 ml of acetic anhydride was heated at an inner temperature of 70° to 75° C. for 2 hours while stirring. The precipitated crystals were collected by filtration and washed with methanol. The crystals were dispersed in 30 ml of methanol, followed by refluxing for 1 hour. Insoluble crystals were collected by filtration, washed with methanol, and dried to obtain 2.1 g of Compound 36 having a melting point 300° C. or higher. $\lambda_{max}=559$ nm, $\epsilon=4.18\times10^4$(in dimethyl sulfoxide).

SYNTHESIS EXAMPLE 5

Synthesis of Compound 37

A mixture of 2.8 g of 2-(4-carboxyphenyl)-4-methylpyrazolo[3,4-b]pyridine-3,6-dione, 1.8 g of 4-dimethylamino-2-methylbenzaldehyde, 25 ml of acetic acid, and 5 ml of acetic anhydride was heated at an inner temperature of 80° to 85° C. for 2 hours while stirring. The precipitated crystals were collected by filtration and washed with methanol. The crystals were dispersed in 50 ml of methanol, and the dispersion was refluxed for 1 hour. Insoluble crystals were filtered, washed with methanol, and dried to obtain 2.7 g of Compound 37 having a melting point 300° C. or higher. $\lambda_{max}=582$ nm, $\epsilon=4.23\times104$ (in dimethyl sulfoxide).

SYNTHESIS EXAMPLE 6

Synthesis of Compound 39

A mixture of 6.0 g of 2-(4-carboxyphenyl)-4,7-dimethylpyrazolo[3,4-b]pyridine-3,6-dione, 3.6 g of 4-dimethylamino-2-methylbenzaldehyde, 30 ml of acetic acid, and 10 ml of acetic anhydride was heated at an inner temperature of 80° to 85° C. for 2 hours while stirring. The precipitated crystals were collected by filtration and washed with methanol. The crystals were dispersed in 100 ml of methanol, and the dispersion was refluxed for 1 hour. Insoluble crystals were collected by filtration, washed with methanol, and dried to obtain 6.8 g of Compound 39 having a melting point of 300° C. or higher. $\lambda_{max}=585$ nm, $\epsilon=4.35\times10^4$ (in dimethyl sulfoxide).

SYNTHESIS EXAMPLE 7

Synthesis of Compound 42

A mixture of 2.8 g of 2-(4-carboxyphenyl)-4-methylpyrazolo[3,4-b]pyridine-3,6-dione, 1.9 g of 4-dimethylaminocinnamic aldehyde, 25 ml of acetic acid, and 5 ml of acetic anhydride was heated at an inner temperature of 80° to 85° C. for 2.5 hours while stirring. The precipitated crystals were collected by filtration and washed with methanol. The crystals were dispersed in 100 ml of methanol, and the dispersion was refluxed for 1 hour. Insoluble crystals were collected by filtration, washed with methanol, and dried to obtain 1.7 g of Compound 42 having a melting point 300° C. or higher. $\lambda_{max}=628$ nm, $\epsilon=6.16\times10^4$ (in dimethyl sulfoxide).

The dye of formula (I) is usually used in an amount of from about 1 to 1000 mg, preferably from about 1 to 800 mg, per $m^2$ of a light-sensitive material.

When the dye of formula (I) is employed as a filter dye or an antihalation dye, the amount to be added is arbitrarily selected from the range of effective amounts. The amount is preferably selected so as to give an optical density between 0.05 and 3.5. The time of addition is at any stage before coating.

The dye of the present invention may be used in any of emulsion layers and other hydrophilic colloidal layers.

A fine dispersion of the dye can be obtained by using known pulverizing techniques, such as ball milling by means of a ball mill, an oscillating ball mill, a planetary ball mill, etc., sand milling, colloid milling, jet milling, and roller milling, in the presence of a dispersing agent. In this case, a solvent, e.g., water and alcohols, may be used. The dye dispersion may be obtained by once dissolving the dye in an appropriate solvent and then adding a poor solvent for the dye to precipitate fine crystals. This being the case, a surface active agent for dispersion aid may be employed. The dye dispersion may also be obtained by dissolving the dye by pH control and then changing the pH to form fine crystals.

The finely-divided dye particles in a dispersion has an average particle size of not greater than 10 μm, preferably not greater than 2 μm, and more preferably not greater than 0.5 μm. In some cases, fine particles of 0.1 μm or smaller are preferred.

As a hydrophilic colloid, gelatin is typically employed. In addition, any of hydrophilic colloids known to be photographically usable may be utilized.

Silver halide emulsions which can be used in this invention may be any of silver bromide, silver iodobromide, silver iodochlorobromide, silver chlorobromide, and silver chloride emulsions.

Silver halide grains in photographic emulsions may have a regular crystal form, such as a cubic form and an octahedral form, or an irregular crystal form, such as a spherical form and a tabular form, or a composite form thereof. The emulsion may be comprised of grains of various crystal forms.

Silver halide grains may have a uniform phase throughout the individual grains or may have different phases between the interior and the surface thereof. Further, the emulsion may be of a surface latent image type which forms a latent image predominantly on the surface of the grains (e.g., negatively working emulsions) or of a internal latent image type which forms a latent image predominantly in the inside of the grains (e.g., internal latent image emulsions, and previously fogged direct reversal emulsions). The former type emulsion is preferred.

In the present invention, the silver halide emulsion is preferably a tabular grain emulsion in which at least 50% of the total projected area of grains comprises those grains having a thickness of not more than 0.5 μm, and preferably not more than 0.3 μm, a diameter of not less than 0.6 μm, and an average aspect ratio of 5 or greater or a monodisperse emulsion in which a statistical coefficient of variation [a quotient of standard deviation S divided by diameter $\bar{d}$ ($S/\bar{d}$) in distribution of diameter, approximating the projected area to a circle] is not more than 0.2. The tabular grain emulsions and the monodisperse emulsions may be used as an admixture.

The photographic emulsions which can be used in the present invention can be prepared by known processes, such as the processes described in P. Glafkides, *Chimie et Physique Photographique,* Paul Montel (1967), G. F. Duffin, *Photographic Emulsion Chemistry,* Focal Press (1966), and V. L. Zelikman, et al., Making and Coating Photographic Emulsion, Focal Press (1964).

During formation of silver halide grains, a silver halide solvent can be used for grain growth control. Examples of suitable silver halide solvents are ammonia, potassium thiocyanate, ammonium thiocyanate, thioether compounds (e.g., those described in U.S. Pat. Nos.3,271,157, 3,574,628, 3,704,130, 4,297,439, and 4,276,374), thione compounds (e.g., those described in JP-A-53-144319, JP-A-53-82408, and JP-A-55-77737), and amine compounds (e.g., those described in JP-A-54-100717).

During silver halide grain formation or physical ripening, a cadmium salt, a zinc salt, a thallium salt, an iridium salt or a complex thereof, a rhodium salt or a complex thereof, an iron salt or a complex thereof, etc. may be present in the system.

Gelatin is advantageously used as a binder or a protective colloid in photographic emulsion layers or intermediate layers of the light-sensitive materials of the present invention. Other hydrophilic colloids may also be employed. Examples of usable hydrophilic colloids are proteins, such as gelatin derivatives, graft polymers of gelatin with other high polymers, albumin, and casein; cellulose derivatives, e.g., hydroxyethyl cellulose, carboxymethyl cellulose, and cellulose sulfate; sugar derivatives, e.g., sodium alginate and starch derivatives; and various synthetic hydrophilic high-molecular substances, e.g., polyvinyl alcohol, polyvinyl alcohol partial acetal, poly-N-vinylpyrrolidone, polyacrylic acid,, polymethacrylic acid, polyacrylamide, polyvinylimidazole, polyvinylpyrazole, etc. and copolymers comprising monomers constituting these homopolymers.

Included in gelatin are lime-processed gelatin for general use as well as acid-processed gelatin. Enzymatic decomposition products of gelatin as described in *Bull. Soc. Sci. Phot. Japan,* No. 16, p. 30 (1966), and hydrolysis products of gelatin are also useful.

The photographic light-sensitive layers or arbitrary hydrophilic colloidal layers constituting backing layers in the light-sensitive materials of the present invention may contain an organic or inorganic hardening agent, such as chromates, aldehydes (e.g., formaldehyde, glyoxal, and glutaraldehyde), and N-methylol compounds (e.g., dimethylolurea). Active halogen compound (e.g., 2,4-dichloro-6-hydroxy-1,3,5-triazine and its sodium salt) and active vinyl compounds [e.g., 1,3-bisvinylsulfonyl-2-propanol, 1,2-b is (vinyl sulfonyl acetamido)ethane , bis(vinylsulfonylmethyl) ether, and vinyl polymers having a vinylsulfonyl group in the side chain thereof] are preferred since they rapidly harden hydrophilic colloids (e.g., gelatin) to give stable photographic characteristics. N-Carbamoylpyridinium salts [e.g.,(1-morpholinocarbonyl-3-pyridinio)methanesulfonate] and haloamidinium salts [e.g., 1-(1-chloro-1-pyridinomethylene)pyrrolidinium and 2-naphthalene sulfonate] are also excellent in rate of hydrophilic colloid hardening.

The silver halide photographic emulsions which can be used in the present invention may be spectrally sensitized with methine dyes and other sensitizing dyes. Sensitizing dyes include cyanine dyes, merocyanine dyes, complex cyanine dyes, complex merocyanine dyes, holopolar cyanine dyes, hemicyanine dyes, styryl dyes, and hemioxonol dyes. Particularly useful are those belonging to cyanine dyes, merocyanine dyes, and complex merocyanine dyes. Any of nuclei commonly employed in cyanine dyes as a basic heterocyclic nucleus is applicable to these dyes. Included in such nuclei are pyrroline, oxazoline, thiazoline, pyrrole, oxazole, thiazole, selenazole, imidazole, tetrazole, and pyridine nuclei; the above-enumerated nuclei to each of which an alicyclic hydrocarbon ring is fused; and the aboveenumerated nuclei to each of which an aromatic hydrocarbon ring is fused, e.g., indolenine, benzindolenine, indole, benzoxazole, naphthoxazole, benzothiazole, naphthothiazole, benzoselenazole, benzimidazole, and quinoline nuclei. These nuclei may have a substituent(s) on the carbon atom(s) thereof.

To merocyanine dyes or complex merocyanine dyes is applicable a 5- or 6-membered heterocyclic ring as a nucleus having a ketomethylene structure, e.g., pyrazolin-5-one, thiohydantoin, 2-thiooxazolidine-2,4-dione, thiazolidine-2,4-dione, rhodanine, and thiobarbituric acid nuclei.

These sensitizing dyes may be used either individually or in combination thereof. A combination of sensitizing dyes is often used for supersensitization. The sensitizing dye may be used in combination with a dye showing no spectral sensitizing activity per se but exhibiting supersensitizing activity or a substance absorbing no substantial visible light but exhibiting supersensitizing activity. Examples of such a supersensitizing dye or substance are aminostilbene compounds substituted with a nitrogen-containing heterocyclic ring (e.g., those described in U.S. Pat. Nos. 2,933,390 and 3,635,721), aromatic organic acid-formaldehyde condensates (e.g., those described in U.S. Pat. Nos. 3,743,510), cadmium salts, and azaindene compounds. Combinations described in U.S. Pat. Nos. 3,615,613, 3,615,641, 3,617,295, and 3,635,721 are especially useful.

For the purpose of preventing fog during preparation, preservation or photographic processing of a light-sensitive material or for stabilizing photographic performance properties, various compounds may be incorporated into the silver halide photographic emulsion which can be used in the present invention. Such compounds include azoles, such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially 1-phenyl-5-mercaptotetrazole); mercaptopyrimidines; mercaptotriazines; thioketo compounds, such as oxazolinethione; azaindenes, such as triazaindenes, tetraazaindenes (especiallly 4-hydroxy-substituted (1,3,3a,7)tetraazaindenes), and pentaazaindenes; benzenethiosulfonic acids, benzenesulfinic acids, benzenesulfonic acid amides, and many other compounds known as antifoggants or stabilizers.

The light-sensitive material of this invention may further contain various known surface active agents for the purpose of coating aid, static charge prevention, improvement of slip properties, emulsification and dispersion aid, prevention of blocking, and improvement of photographic characteristics (for example, acceleration of development, increase of contrast, and increase of sensitivity).

The hydrophilic colloidal layers of the light-sensitive material of this invention may furthermore contain water-soluble dyes as filter dyes or for irradiation prevention or for other various purposes. Suitable water-soluble dyes include oxonol dyes, hemioxonol dyes, styryl dyes, merocyanine dyes, anthraquinone dyes, and azo dyes. Known cyanine dyes, azomethine dyes, triarylmethane dyes, and phthalocyanine dyes are also useful. Oil-soluble dyes may also be incorporated into hydrophilic colloidal layers by oil-in-water dispersion technique.

The present invention is applicable to multilayer multicolor photographic materials comprising a support having thereon at least two emulsion layers differing in spectral sensitivity. The multi-layer natural color photographic materials generally comprise a support having thereon at least one red-sensitive emulsion layer, at least one green-sensitive emulsion layer, and at least one blue-sensitive emulsion layer. The order of these layers is arbitrarily chosen depending on the end use. A preferred order of providing the layer is (i) support/red-sensitive layer/green-sensitive layer/blue-sensitive layer, (ii) support/blue-sensitive layer/green-sensitive layer/red-sensitive layer, or (iii) support/blue-sensitive layer/red-sensitive layer/green-sensitive layer. An emulsion layer of any color sensitivity may be composed of two or more layers differing in sensitivity to thereby improve sensitivity. Graininess can be improved, too, by constituting it from three layers differing in sensitivity. A light-insensitive layer may be interposed between two or more emulsion layers having the same color sensitivity. Two emulsion layers having the same color sensitivity may have therebetween an emulsion layer having different color sensitivity. A reflective layer, such as an emulsion of fine silver halide grains, may be provided beneath a highly sensitive emulsion layer, particularly a highly sensitive blue-sensitive emulsion layer, to thereby improve sensitivity.

It is general to combine red-sensitive emulsion layers with cyan-forming couplers; green-sensitive emulsion layers with magenta-forming couplers; and blue-sensitive emulsion layers with yellow-forming couplers; respectively. Depending on cases, other combinations may also be employable. For example, an infrared-sensitive layer is combined to provide a false color film or a light-sensitive material for semiconductor laser exposure.

Finished emulsions or other coating compositions are coated on an appropriate support commonly employed in the art, including a flexible support, e.g., a film of synthetic resins, paper, and cloth; and a rigid support, e.g., a glass sheet, a porcelain sheet, and a metal sheet. Examples of suitable flexible supports are films made of semi-synthetic or synthetic high polymers, e.g., cellulose nitrate, cellulose acetate, cellulose acetate butyrate, polystyrene, polyvinyl chloride, polyethylene terephthalate, and polycarbonate; and paper coated or laminated with a baryta layer or an $\alpha$-olefin polymer (e.g., polyethylene, polypropylene, an ethylene/butene copolymer). The support may be colored with dyes or pigments. The support may be made black for the purpose of light shielding. The surface of the support is usually subjected to subbing treatment to have improved adhesion to photographic emulsions, etc. Before or after the subbing treatment, the surface of the support may be treated by glow discharge, corona discharge, ultraviolet irradiation, flame treatment, and the like.

Coating of photographic emulsion layers and other hydrophilic colloidal layers is carried out by utilizing various known coating techniques, such as dip coating, roller coating, curtain coating, extrusion coating, and so on. If desired, plural layers can be coated simultaneously by the method described in U.S. Pat. Nos. 2,681,294, 2,761,791, 3,526,528, and 3,508,947.

The present invention is applicable to various color or black-and-white (B/W) light-sensitive materials. Silver halide photographic materials falling within the scope of the present invention typically include color negative films for general use or movies, color reversal film for slides or TV, color papers, color positive films, color reversal papers, light-sensitive materials for color diffusion transfer process, light-sensitive materials for heat development, and the like. The present invention is also applicable to B/W light-sensitive materials, for example, X-ray films, by utilizing three couplers mixing as described in *Research Disclosure,* No. 17123 (July, 1978) or by utilizing black-forming couplers as described in U.S. Pat. No. 4,126,461 and British Patent 2,102,136. The present invention is further applicable to films for photomechanical process, such as lithographic films and scanner films, X-ray films for direct or indirect photography for medical use or for industrial use, negative B/W films for photographing, B/W papers, microfilms for COM or for general use, light-sensitive materials for silver salt diffusion transfer process, and light-sensitive materials for print-out process.

Structures of film units of photographic elements applied to color diffusion transfer process include a peel-apart type, an integrated type as described ir JP-B-46-16356 (the term "JP-B" as used herein means an "examined Japanese patent publication"), JP-B-48-33697, JP-A-50-13040, and British Patent 1,330,524, and a non-peel-apart type as described in JP-A-57-119345. In any of these film units, it is advantageous to use a polymer acid layer protected by a neutralization timing layer for broadening a permissible processing temperature range. When applied to color diffusion transfer process, the dye of the present invention may be added to any layer of the light-sensitive material or may be enclosed in a container of a processing solution as a developer component.

For exposure of image formation, various exposure means are employed. An arbitrary light source emitting radiation having a wavelength corresponding to the sensitive wavelength of a light-sensitive material can be used as a light source for light-ing or writing. Generally employed light sources include natural light (sunlight), an incandescent lamp, a halogen lamp, a mercury lamp, a fluorescent lamp, and a flash light source (e.g., an electronic flash and a flash bulb). Lasers of gases, dye solutions or semi-conductors, light-emitting diodes, and plasma light sources can also be used as a recording light source. Fluorescence emitted from a fluorescent substance excited by electron rays, etc. (e.g., CRT) and exposure means comprised of a microshutter array utilizing a liquid crystal display (LCD) or a lanthanum-doped lead zirconotitanate (PLZT) and a linear or planar light source may also be used. If desired, the spectral distribution of light for exposure can be controlled by using a color filter.

A color developer which can be used for development processing of the light-sensitive materials of the present invention generally comprises an alkaline aqueous solution containing an aromatic primary amine color developing agent, such as aminophenol compounds and p-phenylenediamine compounds, with the latter being preferred. Typical examples of p-phenylenediamine developing agents are 3-methyl-4-amino-N,N-diethylaniline, 3-methyl-4-amino-N-ethyl-N-$\beta$-hydroxyethylaniline, 3-methyl-4 amino-N-ethyl-N-$\beta$-methanesulfonamidoethylaniline, and 3-methyl-4-amino-N-ethyl-N-$\beta$-methoxyethylaniline, and sulfates, hydrochlorides or p-toluenesulfonates thereof. These diamines are generally more stable in the form of a salt than in the free form.

The color developer usually contains pH buffering agents, such as carbonates, borates or phosphates of alkali metals; and development restrainers or antifoggants, such as bromides, iodides, benzimidazoles, benzothiazoles and mercapto compounds. If desired, the color developer may furthermore contain preservatives (e.g., hydroxylamines, dialkylhydrcxylamines, hydrazines, triethanolamine, triethylenediamine, and sulfites), organic solvents (e.g., triethanolamine and diethylene glycol), development accelerators (e.g., benzyl alcohol, polyethylene glycol, quaternary ammonium salts, and amines), dye-forming couplers, competing couplers, nucleating agents (e.g., sodium borohydride), auxiliary developing agents (e.g., 1-phenyl-3-pyrazolidone), tackifiers, various chelating agents (e.g., aminopolycarboxylic acids, aminopolyphosphonic acids, alkylphosphonic acids, and phosphonocarboxylic acids), and antioxidants described in West German Patent Application (OLS) No. 2,622,950.

For development processing of reversal color light-sensitive materials, color development is usually preceded by B/W development. A B/W developer contains known B/W developing agents, such as dihydroxybenzenes (e.g., hydroquinones), 3-pyrazolidones (e.g., 1-phenyl-3-pyrazolidone), and aminophenols (e.g., N-methyl-p-aminophenol), either individually or in combinations thereof.

Not only color development but other photographic development systems can be applied to the light-sensitive materials included in the present invention. Developing agents to be used include dihydroxybenzene developing agents, 1-phenyl-3-pyrazolidone developing agents, and p-aminophenol developing agents, either individually or in combinations thereof. For example, a 1-phenyl-3-pyrazolidone may be combined with a dihydroxybenzene, or a p-aminophenol may be combined with a dihydroxybenzene. In addition, the light-sensitive materials of this invention may be processed with a so-called infectious developer containing a sulfite ion buffer (e.g., carbonylbisulfite) and hydroquinone.

Examples of suitable dihydroxybenzene developing agents are hydroquinone, chlorohydroquinone, bromohydroquinone, isopropylhydroquinone, toluhydrohydroquinone, methylhydroquinone, 2,3-dichlorohydroquinone, and 2,5-dimethylhydroquinone.

Examples of suitable 1-phenyl-3-pyrazolidone developing agents are 1-phenyl-3-pyrazolidone, 4,4-dimethyl-1-phenyl-3-pyrazolidone, 4-hydroxymethyl-4-methyl-1-phenyl-3-pyrazolidone, and 4,4-dihydroxymethyl1-phenyl-3-pyrazolidone.

Examples of suitable p-aminophenol developing agents are p-aminophenol and N-methyl-p-aminophenol.

To the developer is added as a preservative a compound affording a free sulfite ion, such as sodium sulfite, potassium sulfite, potassium metabisulfite, and sodium bisulfite. In the case of an infectious developer, formaldehyde-sodium bisulfite affording no sulfite ion in the developer may be used.

Alkali agents in the developer which can be used in the present invention include potassium hydroxide, sodium hydroxide, potassium carbonate, sodium carbonate, sodium acetate, potassium tertiary phosphate, diethanolamine, and triethanolamine. The developer is adjusted usually to a pH of 9 or higher, and preferably 9.7 or higher.

The developer may contain organic compounds known as antifoggants or development inhibitors. Such compounds include azoles, such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzothiazoles, nitrobenzotriazoles, and mercaptotetrazoles (especially 1-phenyl-5-mercaptotetrazole); mercaptopyrimidines; mercaptotriazines; thioketo compounds, such as oxazolinethione; azaindenes, such as triazaindenes, tetraazaindenes (especially 4-hydroxy-substituted (1,3,3a,7)tetraazaindenes), and pentaazaindenes; benzenethiosulfonic acids, benzenesulfinic acids, benzenesulfonic acid amides, and sodium 2-mercapto-benzimidazole-5-sulfonate.

The developer which can be used in the present invention may contain a polyalkylene oxide as a development inhibitor. For example, a polyethylene oxide having a molecular weight of from 1000 to 10000 can be added in a concentration of from 0.1 to 10 g/l.

A water softener, e.g., nitrilotriacetic acid, ethylenediaminetetraacetic acid, triethylenetetraminehexaacetic acid, and diethylenetetraminepentaacetic acid, is preferably added to the developer which can be used in the present invention.

The developer which can be used in the present invention may further contain silver stain inhibitors (e.g., the compounds described in JP-A-56-24347), development unevenness inhibitors (e.g., the compounds described in JP-A-62-212651), and dissolution aids (e.g., the compounds described in Japanese Patent Application No. 60-109743 (corresponding to JP-A-61-267759)).

The developer which can be used in the present invention may furthermore contain buffering agents, e.g., boric acids as described in Japanese Patent Application No. 61-28708 (corresponding to JP-A-62-186259), sugars as described in JP-A-60-93433 (e.g., saccharose), oximes (e.g., acetoxime), phenols (e.g.,. 5-sulfosalicylic acid), and tertiary phosphates (e.g., sodium salt and potassium salt).

Development accelerators which can be used in the present invention include a wide variety of compounds. The development accelerators may be incorporated to either a light-sensitive material or a processing solution. Examples of suitable development accelerators are amine compounds, imidazole compounds, imidazoline compounds, phosphonium compounds, sulfonium compounds, hydrazine compounds, thioether compounds, thione compounds, certain kinds of mercapto compounds, isothione compounds, and thiocyanates.

The development accelerator is required particularly in carrying out rapid development. It is desirably added to a color developer. Depending on the kind of the accelerator or the position of a light-sensitive layer subject to development acceleration with respect to a support, the development accelerator may be incorporated into a light-sensitive material. It may also be incorporated into both a color developer and a light-sensitive material. Further, a prebath of a development bath may be used, to which the accelerator can be added.

The amine compounds useful as an accelerator include inorganic amines (e.g., hydroxylamine) and organic amines. The organic amines include aliphatic amines, aromatic amines, cyclic amines, aliphaticaromatic mixed amines, and heterocyclic amines. Any of primary, secondary, and tertiary amines and quaternary ammonium compounds is effective.

Photographic emulsion layers after color development are usually subjected to bleaching. Bleaching may be carried out simultaneously with fixing, or these two steps may be carried out separately. To speed up processing, bleach may be followed by bleach-fix. Bleaching agents to be used include compounds of polyvalent metals [e.g., iron(III), cobalt(III), chromium(IV), and copper(II), peracids, quinones and nitroso compounds. Typical examples of these bleaching agents are ferricyanides; bichromates; organic complex salts of iron(III) or cobalt(III), e.g., complex salts with aminopolycarboxylic acids (e.g., ethylenediaminetetraacetic acid, diethylenetriaminepentaacetic acid, nitrilotriacetic acid, 1,3-diamino-2-propanotetraacetic acid) or organic acids (e.g., citric acid, tartaric acid, and malic acid); persulfates; manganates; and nitrosophenol. Preferred of them are ethylenediaminetetraacetonato iron(III) salts, diethylenetriaminepentaacetato ,iron(III) salts, and persulfates from the standpoints of rapidness in processing and prevention of environmental pollution. Ethylenediaminetetraacetato iron(III) complex salts are particularly useful either in a bleaching bath or in a bleach-fix monobath.

If desired, a bleaching bath, a bleach-fix bath, or a prebath thereof contains known bleaching accelerators. Examples of useful bleaching accelerators are compounds having a mercapto group or a disulfide group as described in U.S. Pat. No. 3,893,858, German Patents 1,290,812 and 2,059,988, JP-A-53-32736, JP-A-53-57831, JP-A-53-65732, JP-A-53-72623, JP-A-53-95630, JP-A-53-95631, JP-A-53-104232, JP-A-53-124424, JP-A-53-141623, JP-A-53-28426, and *Research Disclosure* No. 17129 (July, 1978); thiazolidine derivatives as described in JP-A-50-140129; thiourea derivatives described in JP-B45-8506, JP-A-52-20832, JP-A-53-32735, and U.S. Pat. No. 3,706,561; iodides described in German Patent 1,127,715 and JP-A-58-16235; polyethylene oxides described in German Patents 966,410 and 2,748,430; polyamine compounds described in JP-B-45-8836; the compounds described in JP-A-49-42434, JP-A-49-59644, JP-A-53-94927, JP-A-54-35727, JP-A-55-26506, and JP-A-58-163940; and iodide or bromide ions. Among them, the compounds having a mercapto group or a disulfide group are preferred because of their high accelerating effect. In particular, the compounds disclosed in U.S. Pat. No. 3,893,858, West German Patent 1,290,812, and JP-A-53-95630 are preferred. In addition, the compounds disclosed in U.S. Pat. No. 4,552,834 are also preferred. These bleaching accelerators may be incorporated into a light-sensitive material. Where color light-sensitive materials for photographing are subjected to bleach-fix, these bleaching accelerators are especially effective.

Fixing agents to be used include thiosulfates, thiocyanates, thioether compounds, thioureas, and a large quantity of an iodide, with thiosulfates being commonly employed. Preservatives for the belach-fix bath or fixing bath preferably include sulfites, bisulfites, and carbonyl-bisulfite adducts.

The fixing or bleach-fix is generally followed by washing and stabilizing. Various known additives may be used in the washing and stabilizing steps for prevention of sedimentation or water saving. For example, for the purpose of preventing sedimentation, washing water or a stabilizing bath contains water softeners, e.g., inorganic phosphoric acids, aminopolycarboxylic acids, organic aminopolyphosphonic acids, and organic phosphoric acids; biocides or fungicides for preventing generation of various bacteria, algae, and fungi; metallic salts, e.g., magnesium salts, aluminum salts, and bismuth salts, surface active agents for reducing drying load or unevenness; various hardening agents; and the like. The additives described in L. E. West, *Photo. Sci. and Eng.*, Vol. 6, pp. 344-359 (1965) can also be employed. Addition of chelating agents and fungicides is particularly effective.

Washing is usually carried out in a counter-current system using more than one tank, for saving water. Washing may be replaced by multi-stage counter-current stabilizing as described in JP-A-57-8543. In this case, 2 to 9 tanks in a counter-current system are required. A stabilizing bath to be used contains various compounds for image stabilizing in addition to the above-described additives. Examples of such compounds include buffering agents for adjusting to a pH, for example, between 3 to 9 (e.g., borates, metaborates, borax, phosphates, carbonates, potassium hydroxide, sodium hydroxide, aqueous ammonia, monocarboxylic acids, dicarboxylic acids, polycarboxylic acids, or mixtures thereof) and aldehydes (e.g., formalin). If desired, the stabilizing bath may contain chelating agents (e.g., inorganic phosphoric acids, aminopolycarboxylic acids, organic phosphoric acids, organic phosphonic acids, aminopolyphosphonic acids, and phosphonocarboxylic acids), biocides (e.g., benzoisothiazolinone, isothiazolone, 4-halogenated phenols, sulfanilamide, and benzotriazole), surface active agents, brightening agents, hardening agents, and so on. Two or more of these compounds for the same or different purposes may be used in combination.

It is preferable to add various ammonium salts, e.g., ammonium chloride, ammonium nitrate, ammonium sulfate, ammonium phosphate, ammonium sulfite, and ammonium thiosulfate, for film pH adjustment after processing.

In the processing of color light-sensitive materials for photographing, the washing-stabilizing step generally conducted after fixing may be replaced with the above-described stabilizing step and washing step (with water saving). In this case, where magenta couplers used are 2-equivalent, formalin in the stabilizing bath may be omitted.

The washing and stabilizing step is generally carried out for a period of from 20 seconds to 10 minutes, and preferably from 20 seconds to 5 minutes, though depending on the kind of the light-sensitive material and processing conditions.

Where the photographic material of this invention is a silver halide color light-sensitive material, the material may contain a color developing agent for simplification and speeding up of processing. To this effect, the color developing agent is preferably added in the form of a precursor thereof. Examples of suitable precursors are indoaniline compounds described in U.S. Pat. No. 3,342,597; Schiff base compounds described in U.S. Pat. No. 3,342,599, *Research Disclosure* Nos. 14850 and 15159; aldol compounds described in *Research Disclosure* No. 13924; metallic salt complex described in U.S. Pat. No. 3,719,492, urethane compounds described in JP-A-53-135628, and various precursors of a salt form as described in JP-A-56-6235, JP-A-56-16133, JP-A-56-59232, JP-A-56-67842, JP-A-56-83734, JP-A-56-83735, JP-A-56-83736, JP-A-56-89735, JP-A-56-81837, JP-A-56-54430, JP-A-56-106241, JP-A-56-107236, JP-A-57-97531, and JP-A-57-83565.

The silver halide color light-sensitive material according to the present invention can also contain various 1-phenyl-3-pyrazolidone compounds for acceleration of color development. Typical examples of 1-phenyl-3-pyrazolidone compounds are described in JP-A-56-64339, JP-A-57-144547, JP-A-57-211147, JP-A-58-50532, JP-A-58-50536, JP-A-58-50533, JP-A-58-50534, JP-A-58-50535, and JP-A-58-115438.

Each of the above-described processing solutions which can be used in the present invention is used at a temperature of from 10° to 50° C., and usually from 33° to 38° C. Higher temperatures can be used for acceleration or for reduction in time, or lower temperatures can be used for improvement of image quality or for improvement of processing solution stability. For the purpose of silver saving, cobalt intensification or hydrogen peroxide intensification may be performed as taught in West German Patent 2,226,770 or U.S. Pat. No. 3,674,499.

If necessary, each processing tank may be equipped with a heater, a temperature sensor, a liquid level sensor, a circulating pump, a filter, a floating lid, a squeegee, etc.

In continuous processing, a constant finish can be assured by using a replenisher for each processing solution by which variations of liquid compositions can be prevented. The rate of replenishment may be reduced to half or less than half a standard rate of replenishment to achieve cost reduction.

The light-sensitive materials according to the present invention are subjected to bleach-fix as is very common in case of color papers or when necessary in case of color photographic materials for photographing.

In the silver halide photographic material according to the present invention, the dye in a dye layer exhibits proper spectral absorption and is capable of selectively coloring the dye layer without diffusing into other layers.

The dye of formula (I) is easily decolorized or dissolved away upon photographic processing, giving a low minimum density ($D_{min}$) without reducing sensitivity. Also, the dye is less causative of reduction in sensitivity due to preservation.

The silver halide photographic material of the invention provides an image having improved sharpness. The photographs obtained from the photographic material exhibit stability during long-term preservation without undergoing staining or reduction in photographic performance properties.

Further, some of the dyes of the present invention have an absorption in the near infrared region, they are effectively applied to light-sensitive materials spectrally sensitized to a wavelength region of 700 nm or more.

The present invention is now illustrated in greater detail by way of Examples, but it should be understood that the present invention is not construed as being limited thereto. All the percents are given by weight unless otherwise indicated.

EXAMPLE 1

Preparation of Silver Halide Emulsion

In 1000 ml of distilled water was dissolved 32 g of lime-processed gelatin at 40° C., and 3.3 g of sodium chloride was added to the solution. The solution was heated to 52° C., and 3.2 ml of a 1% aqueous solution of N,N'-dimethylimidazolidine-2-thione was added thereto. Then, a solution of 32.0 g of silver nitrate in 200 ml of distilled water and a solution of 11.0 g of sodium chloride in 200 ml of distilled water were added to the gelatin solution over 14 minutes while keeping at 52° C. A solution of 128.0 g of silver nitrate in 560 ml of distilled water and a solution of 44.0 g of sodium chloride and 0.1 mg of potassium hexachloroiridate (IV) in 560 ml of distilled water were then added thereto over 20 minutes while keeping at 52° C. After allowing the mixture to stand at 52° C. for 15 minutes, the temperature was decreased to 40° C., and the emulsion was subjected to desalting and washing with water. Lime-processed gelatin was further added thereto to obtain Emulsion A. Emulsion A contained cubic silver chloride grains having a mean grain size of 0.45 μm with a coefficient of variation of grain size distribution being 0.08.

Silver chlorobromide emulsion B having a silver bromide content of 2 mol % was prepared in the same manner as for Emulsion A, except for replacing the sodium chloride aqueous solution to be simultaneously added with the silver nitrate aqueous solution with a mixed solution of sodium chloride and potassium bromide, with the total mole number being the same, and the molar ratio being 98:2. The time of adding the reaction mixture was controlled so that the mean grain size of silver halide grains in the resulting emulsion might be equal to that of Emulsion A. The resulting emulsion contained cubic silver chlorobromide grains having a coefficient of variation of grain size of 0.08.

Silver chlorobromide Emulsion C was prepared in the same manner as for Emulsion A, except for replacing the sodium chloride aqueous solution to be simultaneously added with the silver nitrate aqueous solution with a mixed solution of sodium chloride and potassium bromide, with the total mole number being the same, and the molar ratio being 9:1. The time of adding the reaction mixture was controlled so that the mean grain size of the resulting emulsion might be equal to that of Emulsion A. The resulting emulsion contained cubic silver chlorobromide grains having a coefficient of variation of grain size of 0.09.

After adjusting pH and pAg of each of Emulsions A to C, triethylthiourea was added thereto to effect optimum chemical sensitization to obtain Emulsion A-1, B-1, or C-1, respectively.

Separately, a fine silver bromide emulsion having a mean grain size of 0.05 μm [containing $2.5\times10^{-5}$ mol/mol of AgBr of potassium hexachloroiridate (IV)] was prepared.

To Emulsion A was added Emulsion A-1 in an amount corresponding to 2 mol % as silver halide, and triethylthiourea was added thereto to effect optimum chemical sensitization to prepare Emulsion A-2.

To each of the above-prepared four kinds of emulsions was added a stabilizer shown below in an amount of $5.0\times10^{-4}$ mol/mol of silver halide.

Stabilizer:

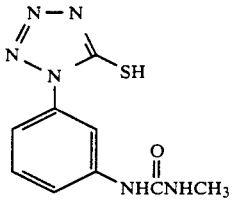

Halogen composition and halogen distribution of silver halide emulsions can be determined by X-ray diffractometry. The angle of diffraction from a (200) plane was closely determined by using a monochromatic CuKα ray. The diffraction pattern of a crystal having a uniform halogen composition shows a single peak, whereas that of a crystal containing phases differing in halogen composition shows plural peaks corresponding to the localized phases. The halogen composition constituting the silver halide grains can be decided by obtaining a lattice constant from the angle of diffraction of the peak(s) observed. As a result of X-ray diffractometry, Emulsions A-1, B-1, and C-1 showed a single diffraction peak assigned to 100% silver chloride, 98% silver chloride (i.e., 2% silver bromide), and 90% silver chloride (i.e., 10% silver bromide), respectively. On the other hand, Emulsion A-2 showed a broad secondary peak centered at 70% silver chloride (30% silver bromide) and extending at the tie to about 60% silver chloride (40% silver bromide) as well as a main peak of 100% silver chloride.

Preparation of Fine Solid Dye Dispersion

Crystals of dyes and a surface active agent both shown below were kneaded and finely divided in a sand mill to an average particle size of 0.15 μm or less. The fine particles were dispersed in 25 ml of a 10% aqueous solution of lime-processed gelatin having dissolved therein 0.1 g of citric acid. The sand used was removed by filtration through a glass filter. The dye adsorbed on the sand on the glass filter was washed away with hot water. The filtrate and the washing were combined to obtain 100 ml of a 7% gelatin aqueous solution, which was used as a fine solid dye dispersion.

| | |
|---|---|
| Dispersion A: | |
| Dye (15) | 0.8 g |
| Dye (13) | 1.5 g |
| 5% Aqueous solution of Cpd-10 (surface active agent) | 5 ml |
| Dispersion B: | |
| Dye (15) | 0.8 g |
| Dye (9) | 1.5 g |
| 5% Aqueous solution of Cpd-10 | 5 ml |
| Dispersion C: | |
| Dye (15) | 2 g |
| 5% Aqueous solution of Cpd-11 (surface active agent) | 5 ml |

Preparation of Color Light-Sensitive Material

Emulsified dispersions of couplers, etc. were prepared and combined with each silver halide emulsion. Coating compositions were coated on a paper support having polyethylene laminated on both sides thereof to obtain a multi-layer color light-sensitive material having the following layer structure. The resulting samples were designated Sample 101 to 106.

Layer Structure

Support

Polyethylene-laminated paper [polyethylene on the emulsion layer side contained a white pigment ($TiO_2$) and a bluing dye (ultramarine)].

| | |
|---|---|
| 1st Layer: Antihalation Layer | |
| Gelatin | 0.80 g/m$^2$ |
| Fine solid dye dispersion | see Table 1 |
| 2nd Layer: Yellow-Forming Layer | |
| Silver halide emulsion (see Table 1) | 0.30 g of Ag/m$^2$ |
| Spectral sensitizing dye (see Table 1) | |
| Yellow coupler (Y-1) | 0.82 g/m$^2$ |
| Dye image stabilizer (Cpd-7) | 0.09 g/m$^2$ |
| Solvent (Solv-6) | 0.28 ml/m$^2$ |
| Gelatin | 1.75 g/m$^2$ |
| 3rd Layer: Color Mixing Preventing Layer | |
| Gelatin | 1.25 g/m$^2$ |
| Filter dye (Dye-4) | 0.01 g/m$^2$ |
| Color mixing preventing agent (Cpd-4) | 0.11 g/m$^2$ |
| Solvent (Solv-2) | 0.24 ml/m$^2$ |
| Solvent (Solv-5) | 0.26 ml/m$^2$ |
| 4th Layer: Magenta-Forming Layer | |
| Silver halide emulsion (see Table 1) | 0.12 g of Ag/m$^2$ |
| Spectral sensitizing dye (see Table 1) | |
| Supersensitizer (see Table 1) | |
| Magenta coupler (M-1) | 0.13 g/m$^2$ |
| Magenta coupler (M-2) | 0.09 g/m$^2$ |
| Dye image stabilizer (Cpd-1) | 0.15 g/m$^2$ |
| Dye image stabilizer (Cpd-8) | 0.02 g/m$^2$ |
| Dye image stabilizer (Cpd-9) | 0.03 g/m$^2$ |
| Solvent (Solv-1) | 0.34 ml/m$^2$ |
| Solvent (Solv-2) | 0.17 ml/m$^2$ |
| Gelatin | 1.25 g/m$^2$ |
| 5th Layer: Ultraviolet Absorbing Layer | |
| Gelatin | 1.58 g/m$^2$ |
| Filter dye (Dye-5) | 0.05 g/m$^2$ |
| Ultraviolet absorbent (UV-1) | 0.47 g/m$^2$ |
| Color mixing inhibitor (Cpd-4) | 0.05 g/m$^2$ |
| Solvent (Solv-3) | 0.26 ml/m$^2$ |
| 6th Layer: Cyan-Forming Layer | |
| Silver halide emulsion (see Table 1) | 0.23 g of Ag/m$^2$ |
| Spectral sensitizing dye (see Table 1) | |
| Supersensitizer (see Table 1) | |
| Cyan coupler (C-1) | 0.32 g/m$^2$ |
| Dye image stabilizer (Cpd-5) | 0.17 g/m$^2$ |
| Dye image stabilizer (Cpd-6) | 0.04 g/m$^2$ |

-continued

| | |
|---|---|
| Dye image stabilizer (Cpd-7) | 0.40 g/m$^2$ |
| Solvent (Solv-4) | 0.15 ml/m$^2$ |
| Gelatin | 1.34 g/m$^2$ |
| 7th Layer: Ultraviolet Absorbing Layer | |
| Gelatin | 0.53 g/m$^2$ |
| Ultraviolet absorbent (UV-1) | 0.16 g/m$^2$ |
| color mixing inhibitor (Cpd-4) | 0.02 g/m$^2$ |
| Solvent (Solv-3) | 0.09 ml/m$^2$ |
| 8th Layer: Protective Layer | |

-continued

| | |
|---|---|
| Gelatin | 1.33 g/m$^2$ |
| Acrylic-modified copolymer of polyvinyl alcohol (degree of modification: 17%) | 0.17 g/m$^2$ |
| Liquid paraffin | 0.03 g/m$^2$ |

Each of these layers additionally contained 14.0 mg of sodium 1-hydroxy-3,5-dichloro-s-triazine as a gelatin hardening agent per gram of gelatin.

TABLE 1

| Layer | Dye | Silver Halide Emulsion | Sensitizing Dye | Super-sensitizer | Dye | Silver Halide Emulsion | Sensitizing Dye | Super-Sensitizer |
|---|---|---|---|---|---|---|---|---|
| | Sample 101 | | | | Sample 102 | | | |
| 1st Layer (Anti-halation Layer) | — | | | | 15 . . . 16 mg<br>13 . . . 30 mg | | | |
| 2nd Layer (Yellow-Forming Layer) | | A-1 | Dye-1 | — | | A-1 | Dye-1 | — |
| 4th Layer (Magenta-Forming Layer) | | A-2 | Dye-2 | Cpd-12<br>Cpd-13 | | A-2 | Dye-2 | Cpd-12<br>Cpd-13 |
| 6th Layer (Cyan-Forming Layer) | | A-2 | Dye-3 | Cpd-12<br>Cpd-13 | | A-2 | Dye-3 | Cpd-12<br>Cpd-13 |
| | Sample 103 | | | | Sample 104 | | | |
| 1st Layer (Anti-halation Layer) | 15 . . . 27 mg<br>13 . . . 50 mg | | | | 15 . . . 27 mg<br>9 . . . 50 mg | | | |
| 2nd Layer (Yellow-Forming Layer) | | A-1 | Dye-1 | — | | A-1 | Dye-1 | — |
| 4th Layer (Magenta-Forming Layer) | | A-2 | Dye-2 | Cpd-12<br>Cpd-13 | | A-2 | Dye-2 | Cpd-12<br>Cpd-13 |
| 6th Layer (Cyan-Forming Layer) | | A-2 | Dye-3 | Cpd-12<br>Cpd-13 | | A-2 | Dye-3 | Cpd-12<br>Cpd-13 |
| | Sample 105 | | | | Sample 106 | | | |
| 1st Layer (Anti-halation Layer) | 15 . . . 27 mg<br>9 . . . 50 mg | | | | 15 . . . 27 mg<br>13 . . . 50 mg | | | |
| 2nd Layer (Yellow-Forming Layer) | | B-1 | Dye-1 | — | | A-2 | Dye-1 | — |
| 4th Layer (Magenta-Forming Layer) | | C-1 | Dye-3 | Cpd-12<br>Cpd-13 | | A-2 | Dye-2 | Cpd-12<br>Cpd-13 |
| 6th Layer (Cyan-Forming Layer) | | C-1 | Dye-2 | Cpd-12<br>Cpd-13 | | B-1 | Dye-3 | Cpd-12<br>Cpd-13 |
| 3rd Layer (Color Mixing Preventing Layer) | | | | | 15 . . . 10 mg | | | |
| | Cyan-forming layer and magenta-forming layer were reversed. | | | | Cyan-forming layer and yellow-forming layer were reversed. | | | |

Yellow Coupler (Y-1):

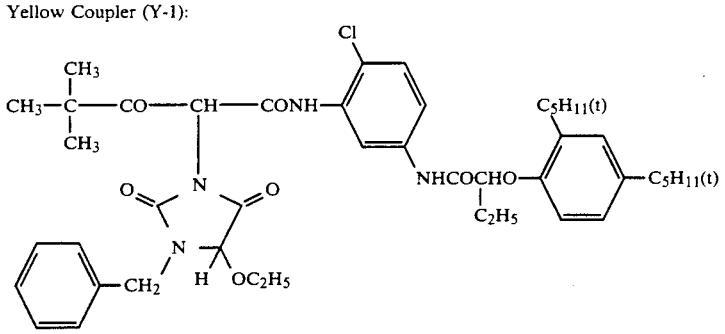

Cyan Coupler (C-1):

A 2:4:4 (by weight) mixture of

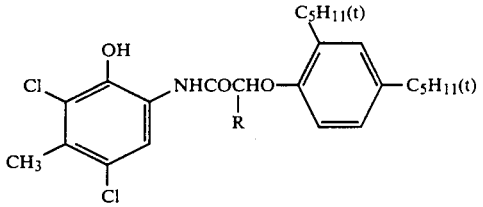

R = $C_2H_5$ and $C_4H_9$

-continued
and
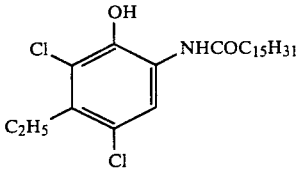
Magenta Coupler (M-1):
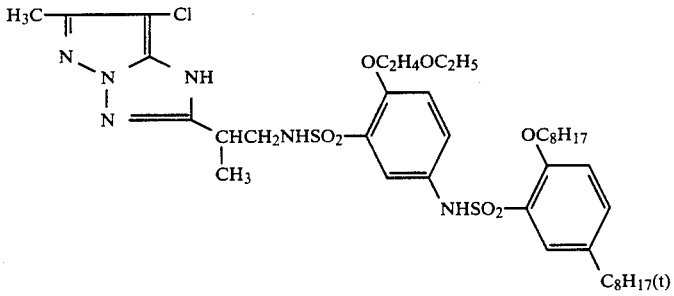
Magenta Coupler (M-2):
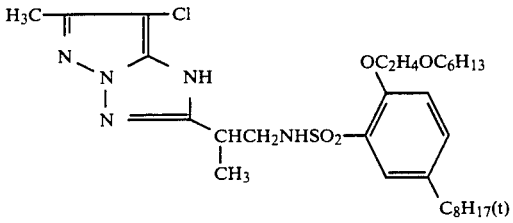
Dye Image Stabilizer (Cpd-1):
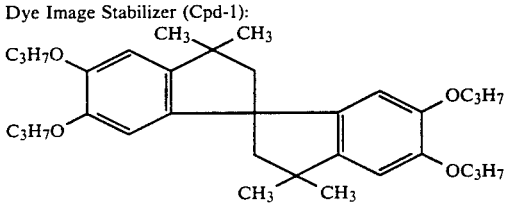
Color Mixing Inhibitor (Cpd-4):
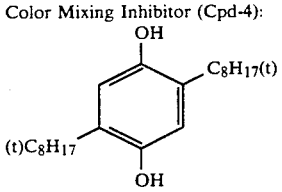
Dye Image Stabilizer (Cpd-5):
A 2:4:4 (by weight) mixture of
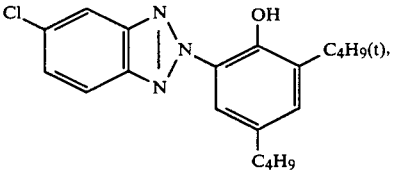
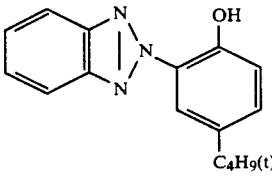
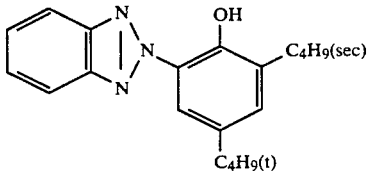
Dye Image Stabilizer (Cpd-6):

-continued
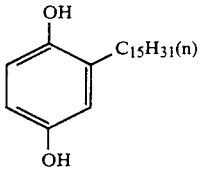
Dye Image Stabilizer (Cpd-7):
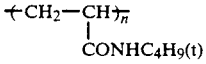
Dye Image Stabilizer (Cpd-8):
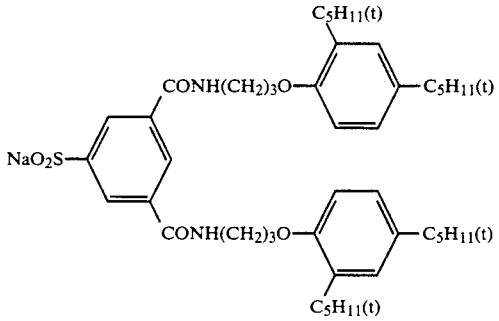
Dye Image Stabilizer (Cpd-9):
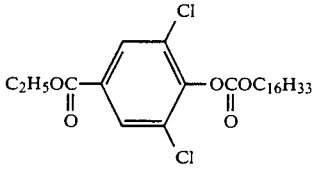
Surface Active Agent (Cpd-10):
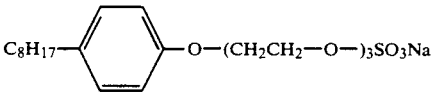
Surface Active Agent (Cpd-11):
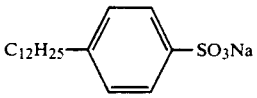
Supersensitizer (Cpd-12):
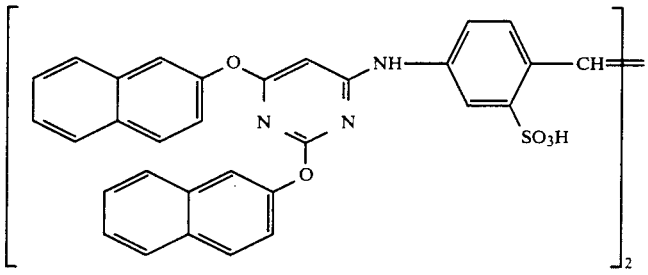
Supersensitizer (Cpd-13):
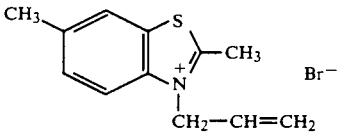
Solvent (Solv-1):

-continued
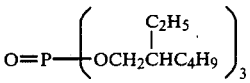
Solvent (Solv-2):
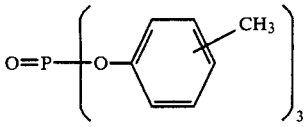
Solvent (Solv-3):
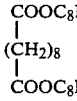
Solvent (Solv-4):
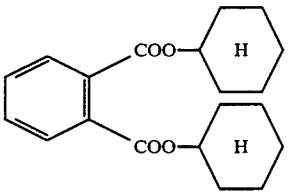
Solvent (Solv-5):
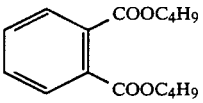
Solvent (Solv-6):
$O{=}P{\leftarrow}O{-}C_9H_{19}(iso))_3$
Ultraviolet Absorbent (UV-1):
A 4:2:4 (by weight) mixture of
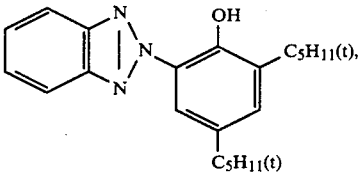
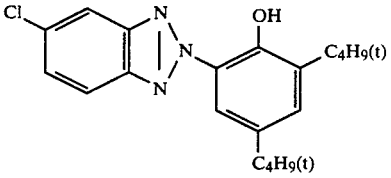
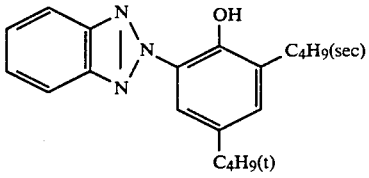
Sensitizing Dye (Dye-1):
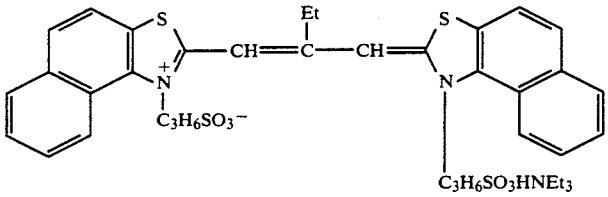
($3.2 \times 10^{-5}$ mol/mol of silver halide)

-continued

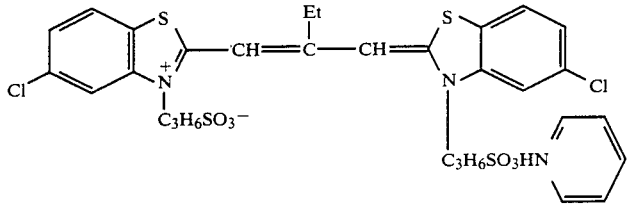

(2.7 × $10^{-5}$ mol/mol of silver halide)

Sensitizing Dye (Dye-2):

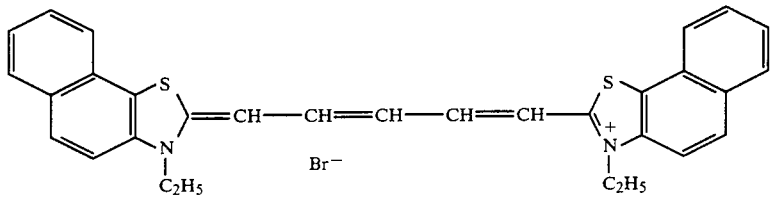

(3.5 × $10^{-5}$ mol/mol of silver halide)

$2.6\times10^{-3}$ mol of Cpd-12 was used in combination per mol of silver.

Sensitizing Dye (Dye-3):

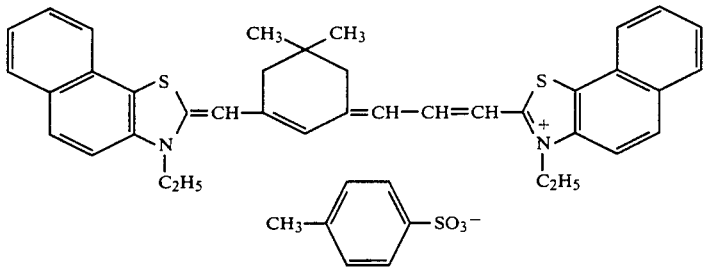

(1.7 × $10^{-5}$ mol/mol of silver halide)

$2.6\times10^{-3}$ mol of Cpd-12 and $1\times10^{-3}$ mol of Cpd-13 were used in combination each per mol of silver.

Filter Dye (Dye-4:)

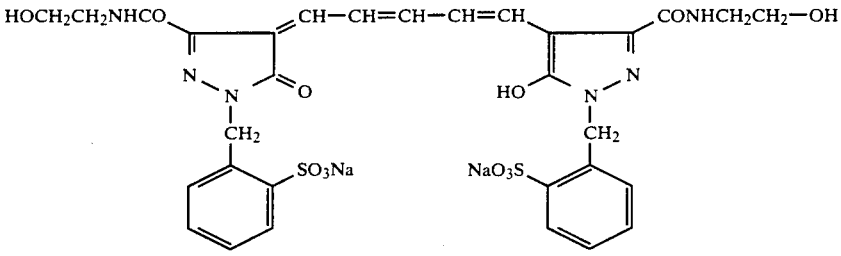

(10 mg/$m^2$)
(Filter dye and antiirradiation dye)

Filter Dye (Dye-5):

-continued

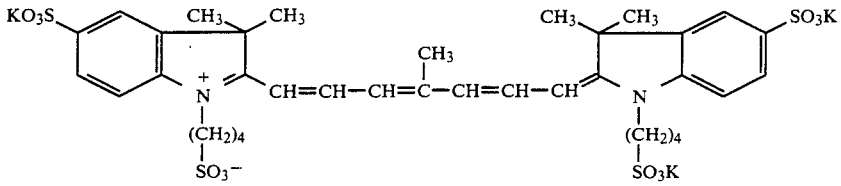

(5 mg/m$^2$)
(Filter dye and antiirradiation dye)

Each of Samples 101 to 106 was exposed to a laser beam by means of a laser exposure apparatus described below.

Exposure Apparatus

A semi-conductor laser AlGaInP (oscillation wavelength: about 670 nm), GaAlAs (oscillation wavelength: about 750 nm), or GaAlAs (oscillation wavelength: about 830 nm) was used as a laser. An apparatus was set up so that a laser beam was successively scanned over color paper moving in the direction vertical to the scanning direction by means of a polyhedral rotator. The exposure amount was controlled by electrically adjusting the exposure time of the semiconductor laser. For the details of the exposure apparatus used here, reference can be made in Japanese Patent Application No. 63-226552.

The sample was exposed to a laser beam having a wavelength of about 670 nm, about 750 nm, or about 830 nm under output control so as to give a recorded line width of about 50 μm. The exposed sample was then developed according to the processing procedure described below.

Separately, in order to determine resolving power, each sample was exposed in contact with a chart for CTF determination to light of a xenon light source through a band transmission filter having a maximum transmission wavelength of 670 nm, 750 nm, or 830 nm ("Model IF-S" produced by Nippon Shinku Kogaku K. K.) while controlling a quantity of light by using an ND filter. The exposure time was about $10^{-4}$ second. The exposed sample was then developed according to the processing procedure described below. Densities of the resulting yellow, magenta, and cyan dye images were measured with a reflection microdensitometer at an aperture of 5 μm×400 μm to obtain the respective CTF curve.

Edge sharpness of the line image obtained by exposure to a semi-conductor laser beam and the number of lines per mm (line/mm) at a CTF value of 0.5 are shown in Table 2.

| Processing Procedure: | | |
|---|---|---|
| Processing Step | Temperature (°C.) | Time (second) |
| Color Development | 35 | 45 |
| Bleach-Fix | 30-35 | 45 |
| Rinsing (1) | 30-35 | 20 |
| Rinsing (2) | 30-35 | 20 |
| Rinsing (3) | 30-35 | 20 |
| Rinsing (4) | 30-35 | 20 |
| Drying | 70-80 | 60 |

[Rinsing was conducted in a counter-current system of from (4) toward (1)]

Processing solutions used had the following formulations.

| Color Developer Formulation: | |
|---|---|
| Water | 800 ml |
| Ethylenediamine-N,N,N,N-tetramethylphosphonic acid | 1.5 g |
| Triethylenediamine (1,4-diazabicyclo-[2,2,2]octane) | 5.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| Brightening agent "UVITEX CK" produced by Ciba Geigy | 2.0 g |
| Water to make | 1000 ml |
| pH (25° C.) | 10.10 |
| **Bleach-Fix Solution Formulation:** | |
| Water | 400 ml |
| Ammonium thiosulfate (70%) | 100 ml |
| Sodium sulfite | 18 g |
| Ammonium ethylenediaminetetraacetato ferrate | 55 g |
| Disodium ethylenediaminetetraacetate | 3 g |
| Ammonium bromide | 40 g |
| Glacial acetic acid | 8 g |
| Water to make | 1000 ml |
| pH (25° C.) | 5.5 |

Rinsing Solution

Deionized water containing not more than 3 ppm of calcium or magnesium.

TABLE 2

| Sample | Resolving Power (CTF50) (line number/mm) | | | Sharpness of Edges* by Visual Observation | | | |
|---|---|---|---|---|---|---|---|
| No. | Yellow | Magenta | Cyan | Yellow | Magenta | Cyan | Remarks |
| 101 | 15 | 19 | 11 | poor | poor | poor | Comparison |
| 102 | 17 | 23 | 22 | medium | good | good | Invention |
| 103 | 18 | ≧25 | 24 | medium | good | good | " |
| 104 | 19 | ≧25 | 25 | good | good | good | " |
| 105 | 17 | 25 | ≧25 | medium | good | good | " |

TABLE 2-continued

| Sample No. | Resolving Power (CTF50) (line number/mm) Yellow | Magenta | Cyan | Sharpness of Edges* by Visual Observation Yellow | Magenta | Cyan | Remarks |
|---|---|---|---|---|---|---|---|
| 106 | 24 | ≧25 | 21 | good | good | good | " |

Note:
*Good . . . sharp
Medium . . . medium
Poor . . . smearing

It can be seen that resolving power and sharpness of edge can be markedly improved by the present invention. In particular, Samples 104 and 106 exhibit excellent sharpness of edge in any of yellow, magenta, and cyan dye images. Although Sample 106 is somewhat less sensitive in cyan dye formation (2nd layer), the saturation each of the yellow, magenta and cyan dye images is high (satisfactory separation of colors) to give an excellent image.

EXAMPLE 2

Sample 201 was prepared in the same manner as for Sample 101 of Example 1, except for increasing the amount of Dye-5 in the 5th layer to 30 mg/m$^2$. Each of Sample 102 of Example 1 and Sample 201 was wedgewise exposed to light emitted from the same xenon light source as used in Example 1 and transmitted through a band transmission filter having a maximum transmission of 750 nm. The exposed sample was development-processed in the same manner as in Example 1, and the density of the resulting magenta image was determined to obtain sensitivity. The sensitivity was expressed relatively taking that of Sample 101 of Example 1 as a standard (100). Further, the resolving power (number of lines per mm at CTF 50%) of each sample was determined in the same manner as in Example 1. The results obtained are shown in Table 3 below.

TABLE 3

| Sample No. | Relative Sensitivity | Fog (Inclusive of Remaining Color) | Resolving Power (line/mm) | Remarks |
|---|---|---|---|---|
| 101 | 100 | 0.14 | 19 | Comparison |
| 102 | 86 | 0.12 | 23 | Invention |
| 201 | 63 | 0.13 | 23 | Comparison |

The results of Table 3 reveal that an increase of a filter dye so as to obtain a resolving power equal to Sample 102 according to the conventional technique tends to cause significant reduction of sensitivity and to increase fog (inclusive of the remaining color).

EXAMPLE 3

Fifty grams of gelatin was dissolved in water, and 3.1 g of Dye-4 and Dye-5 shown in Example 1 was added to the gelatin aqueous solution. Further, 30 ml of a 4% aqueous solution of sodium dodecylbenzenesulfonate (surface active agent) and 45 ml of a 1% aqueous solution of sodium 1-hydroxy-3,5-dichlorotriazine (hardening agent) were added thereto. Furthermore, Dispersion A or B prepared from the composition shown below in the same manner as in Example 1 was added thereto.

| | |
|---|---|
| Dispersion A: | |
| Dye (13) | 1.5 g |
| 5% Aqueous solution of Cpd-10 (surface active agent) | 5 ml |
| Dispersion B: | |
| Dye (9) | 1.5 g |
| 5% Aqueous solution of Cpd-10 (surface active agent) | 5 ml |

For comparison, a solution of Dye (a) shown below was added to the gelatin aqueous solution in the amount equal to Dye (13) or (9) to make 1 l.

Each of the gelatin-containing aqueous solutions thus prepared was coated on a polyethylene-coated paper support to provide a gelatin layer having a dry film thickness of 4 μm.

To 1 kg of a silver chloroiodobromide emulsion (bromide content: 30 mol %; iodide content: 0.1 mol %; mean grain size: 0.30 μm) having been chemically sensitized with gold and sulfur compounds were added 50 ml of a 0.05% methanol solution of Dye-7, 30 ml of a 1.0% methanol solution of Cpd-12, 20 ml of a 0.5% methanol solution of Cpd-13, 40 ml of a 0.6% methanol solution of Cpd-14, 30 ml of a 4.0% aqueous solution of sodium dodecylbenzenesulfonate, and 35 ml of a 1.0% aqueous solution of sodium 1-hydroxy- 3,5-dichlorotriazine, followed by stirring. The resulting emulsion was coated on the gelatin layer.

Further, an aqueous solution containing gelatin and sodium dodecylbenzenesulfonate was coated on the emulsion layer to form a protective layer. The resulting samples were designated Samples 301 to 304.

Each of Samples 301 to 304 was exposed to light emitted from (A) a light-emitting diode having a wavelength of 760 nm or (B) a semi-conductor laser having a wavelength of 783 nm and processed with LD-835 (a developer produced by Fuji Photo Film Co., Ltd.) at 38° C. for 20 seconds by using an automatic developing machine "FG-800RA" produced by Fuji Photo Film Co., Ltd.

Image quality of the resulting image was evaluated and rated according to a rating system of from 1 (very poor image with considerable fringe) to 5 (sharp image with no fringe). Color remaining was also evaluated and rated according to a rating system of from 1 (considerable color remaining) to 5 (no color remaining at all). Note that fringe or color remaining can be evaluated with higher accuracy when observed with eyes than determined with measuring instruments. On actual use of light-sensitive materials, these performances are evaluated with eyes.

The results obtained are shown in Table 4 below.

Dye-7:

-continued

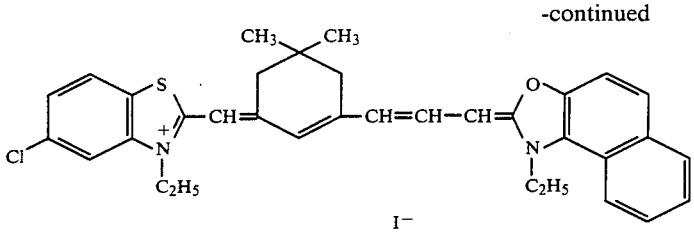

Cpd-14:

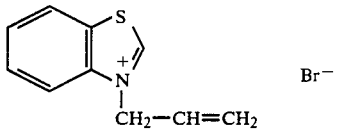

Dye (a):

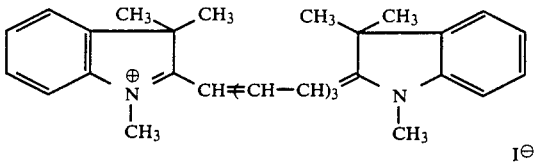

(Disclosed in British Patent 434,875)

TABLE 4

| Image Sample No. | Dye | Quality A | Quality B | Color Remaining after Dispersion | Remarks |
|---|---|---|---|---|---|
| 301 | none | 1 | 1 | 5 | Comparison |
| 302 | Dispersion A | 4 | 5 | 4 | Invention |
| 303 | Dispersion B | 4 | 5 | 4 | " |
| 304 | Dye (a) | 3 | 4 | 2 | Comparison |

As is apparent from the results of Table 4, where a dye dispersion according to the present invention is used, an image having satisfactory quality with reduced color remaining can be obtained.

EXAMPLE 4

To an aqueous solution containing 75 g of gelatin were simultaneously added 2 kg of an aqueous solution containing 1 kg of silver nitrate and 2 kg of an aqueous solution containing 70 g of potassium bromide and 359 g of sodium chloride at a constant feed rate over a period of 30 minutes. After soluble salts were removed, gelatin was added to the emulsion. The emulsion was chemically ripened to obtain a silver chlorobromide emulsion (bromide content: 10 mol %; mean grain size: 0.30 μm).

To the emulsion were added $4\times10^{-5}$ mol of Dye-6 as a sensitizing dye, $2\times10^{-4}$ mol of Cpd-12, and $5\times10^{-4}$ mol of Cpd-13, each per mol of silver halide. To the emulsion were further added sodium 1-hydroxy-3,5-dichlorotriazine as a hardening agent and sodium dodecylbenzenesulfonate as a coating aid and the resulting coating composition was coated on a polyethylene terephthalate film in an amount of 4 g of silver per $m^2$.

Crystals of dyes and a surface active agent both shown below were kneaded and finely divided in a sand mill to an average particle size of 0.30 μm or less. The fine particles were dispersed in 25 ml of a 10% aqueous solution of lime-processed gelatin having dissolved therein 0.1 g of citric acid. The sand was removed by filtration through a glass filter, and the dye adsorbed on the sand remaining on the filter was washed off with hot water. The filtrate and the washing were combined to prepare 100 ml of a 7% gelatin aqueous solution.

| Dispersion D: | |
|---|---|
| Dye (15) | 1.5 g |
| 5% Aqueous solution of Cpd-11 (surface active agent) | 5 ml |

To the gelatin aqueous solution containing the dye dispersion were added polymethyl methacrylate as a matting agent and sodium dodecylbenzenesulfonate as a coating aid. The resulting composition was coated on the emulsion layer to form a protective layer. The thus prepared sample was designated Sample 401.

Sample 402 was prepared in the same manner as for Sample 401, except that the protective layer contained no dye.

Each of Samples 401 and 402 was exposed to tungsten light for 50 minutes through a safelight filter No. 4 LD (produced by Fuji Photo Film Co., Ltd.) to carry out testing on safety to safelight. The exposed sample was developed with LD-835 at 38° C. for 20 seconds. The fog of the image obtained are shown in Table 5 below.

Dye-6:

-continued

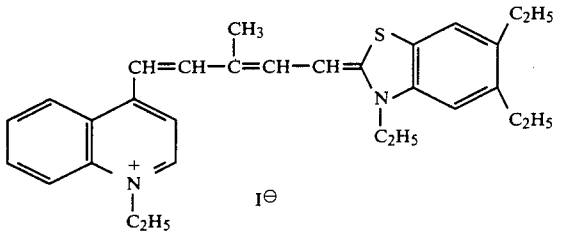

TABLE 5

| Sample No. | Fog Unexposed | Fog Exposed to Safelight | Remarks |
|---|---|---|---|
| 401 | 0.05 | 0.07 | Invention |
| 402 | 0.05 | 0.10 | Comparison |

It can be seen that the sample according to the present invention undergoes neither increase in fog when exposed to safelight nor color remaining after processing.

EXAMPLE 5

Preparation of Emulsion

Five grams of potassium bromide, 0.05 g of potassium iodide, 30 g of gelatin, and 2.5 ml of a 5% aqueous solution of $HO(CH_2)_2S(CH_2)_2S(CH_2)_2OH$ were added to 1 l of water to form a solution, and the solution was kept at 75° C. An aqueous solution containing 8.33 g of silver nitrate and an aqueous solution containing 5.94 g of potassium bromide and 0.726 g of potassium iodide were simultaneously added to the solution by a double jet process over 45 minutes under stirring. After addition of 2.5 g of potassium bromide, an aqueous solution containing 8.33 g of silver nitrate was added thereto over 7.5 minutes at such an increasing feeding rate that the final rate was twice the initial rate. Then, an aqueous solution containing 153.34 g of silver nitrate and a potassium bromide aqueous solution were added thereto over 25 minutes while maintaining a pAg at 8.1 by a controlled double jet process each at such an increasing feeding rate that the final rate was 8 times the initial rate. After the addition, 15 ml of a 2N potassium thiocyanate solution was added, and also 50 ml of a 1% potassium iodide aqueous solution was added thereto over 30 seconds. The temperature was decreased to 35° C. to remove soluble salts by a flocculation method. The temperature was raised to, 40° C., and 68 g of gelatin, 2 g of phenol, and 7.5 g of trimethylolpropane were added. The emulsion was then adjusted to a pH of 6.55 and a pAg of 8.10 by addition of sodium hydroxide and potassium bromide.

The temperature was raised to 56° C., and 735 mg of a sensitizing dye shown below was added thereto. Ten minutes later, 5.5 mg of sodium thiosulfate pentahydrate, 163 mg of potassium thiocyanate, and 3.6 mg of chloroauric acid were added to the emulsion. After 5 minutes, the emulsion was quenched to solidify. The emulsion comprised grains having an aspect ratio of 3 or more in a proportion of 93% based on the total projected area. All the grains having an aspect ratio of 2 or more had an average projected area diameter of 0.83 μm, a standard deviation of 18.5%, an average thickness of 0.161 μm, and an aspect ratio of 5.16.

Sensitizing Dye:

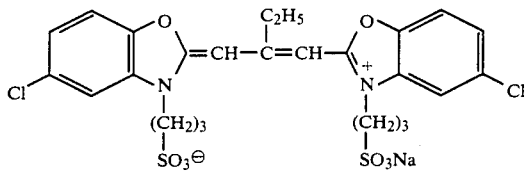

The following additives where further added to the emulsion in the amounts shown below (per mol of silver halide) to prepare a coating composition.

| | |
|---|---|
| 2,6-Bis(hydroxylamino)-4-diethylamino-1,3,5-triazine | 94.5 mg |
| Sodium polyacrylate (average molecular weight: 41,000) | 2.7 g |
| 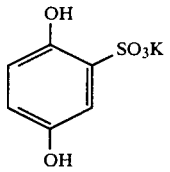 | 10.0 g |
| Plasticizer [ethyl acrylate/acrylic acid/methacrylic acid (95/2/3) copolymer] | 24.8 g |
| Potassium bromide | 77 mg |

Preparation of Photographic Material

A dye layer containing 0.12 g/m² of gelatin and a fine particle dispersion of each of the dyes shown in Table 6 below which was prepared in the same manner as in Example 4 was coated on each side of a 175 μm thick blue-tinted polyethylene terephthalate film having a subbing layer together with the above-prepared emulsion layer and a surface protective layer shown below (the coverage shown was a single spread). The single spread of the emulsion was as follows:

| | |
|---|---|
| Emulsion Layer: | |
| Silver | 1.7 g/m² |
| Gelatin | 1.7 g/m² |
| Polyacrylamide (average molecular weight: 45,000) | 0.47 g/m² |
| Protective Layer: | |
| Gelatin | 1.4 g/m² |
| Polyacrylamide (average molecular weight: 45,000) | 0.23 g/m² |
| Matting agent (methyl methacrylate/methacrylic acid (9/1) copolymer having an average particle size of 3.5 μm) | 0.05 g/m² |
| 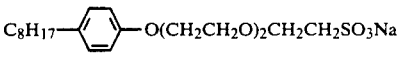 | 22.5 g/m² |
| $C_{16}H_{33}O(CH_2CH_2O)_{10}H$ | 20 mg/m² |
| $C_8H_{17}SO_2N(C_3H_7)(CH_2CH_2O)_{15}H$ | 5 mg/m² |
| $C_8H_{17}SO_2N(C_3H_7)(CH_2CH_2O)_4(CH_2)_4SO_3Na$ | 1 mg/m² |

-continued

| | |
|---|---|
| 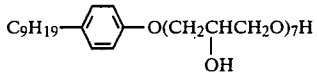 | 10 mg/m$^2$ |
| 4-Hydroxy-6-methyl-1,3,3a,7-tetraazaindene | 21.7 mg/m$^2$ |

1,2-Bis(vinylsulfonylacetamido)ethane was coated as a hardening agent at a single spread of 57 mg/m$^2$.

The resulting photographic materials for X ray photography were designated Samples 501 to 510.

Evaluation of Photographic Performance

Each of Samples 501 to 510 was interposed between two radiographic intensifying screens ("GRENEX Series G-3 Screen" produced by Fuji Photo Film Co., Ltd.) in intimate contact and exposed to X-ray through a 10 cm water phantom.

The exposed film was developed with an X-ray film developer ("RD-III" produced by Fuji Photo Film Co., Ltd.) at 35° C. and fixed with a fixer ("Fuji F" produced by Fuji Photo Film Co., Ltd.) by using an automatic developing machine ("FPM-4000" produced by Fuji Photo Film Co., Ltd.).

1. Sensitivity

The sensitivity of the sample was determined and expressed relatively taking that of Sample 501 as a standard (100).

2. Sharpness (MTF)

An MTF value was determined at an aperture of 30 μm×500 μm. The sharpness at the area having an optical density of 1.0 was evaluated at a spatial frequency of 1.0 c/mm.

3. Color Remaining

Each of the unexposed sample was processed in the same manner as described above, and the level of color remaining was visually observed and rated as follows.

A . . . No appreciable color remaining was observed.

B . . . Level in the middle of A and C

C . . . Color remaining was perceptible but negligible for practical use.

D . . . Level in the middle of C and E

E . . . Color remaining was distinctly appreciated and unnegligible for practical use.

The results of these evaluations are shown in Table 6 below.

Compound a:

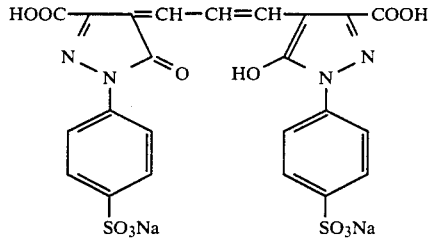

Compound b

C.I. Acid Violet 19 (C.I. 42, 685)

As is apparent from the results of Table 6, Samples 504 to 510 according to the present invention are excellent in sensitivity, sharpness (MTF), and color remaining balance.

EXAMPLE 6

A paper support having polyethylene laminated on both sides thereof was subjected to a corona discharge treatment and then coated with a gelatin subbing layer or a dye dispersion shown below to prepare support A (duplicate) having a subbing layer or Support B or C having an antihalation layer.

Preparation of Dye Dispersion

Crystals of Dye (16) (1.0 g), 1.6 of crystals of Dye (15), and 5 ml of a 5% aqueous solution of

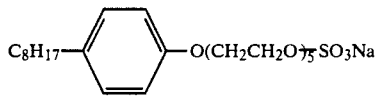

were kneaded and pulverized in a sand mill to an average particle size of 0.15 μm. The particles were dispersed in 25 ml of a 10% aqueous solution of lime-processed gelatin having dissolved therein 0.5 g of citric acid. The sand used was removed by filtration using a glass filter, and the dyes adsorbed onto the sand remaining on the filter were washed away. The filtrate and the washing were combined to obtain 100 ml of a 7% gelatin aqueous solution.

| | |
|---|---|
| Subbing Layer of Support A: | |
| Gelatin | 0.8 g/m$^2$ |
| Antihalation Layer of Support B: | |

TABLE 6

| Sample No. | Fine Crystal Dispersion Dye | Single Spread (mg/m$^2$) | Relative Sensitivity | MTF | Color Remaining | Remarks |
|---|---|---|---|---|---|---|
| 501 | — | — | 100 | 0.74 | A | Control |
| 502 | Compound a | 80 | 81 | 0.77 | D | Comparison |
| 503 | Compound b | 80 | 77 | 0.78 | C | " |
| 504 | Dye (16) | 50 | 91 | 0.80 | B | Invention |
| 505 | " | 100 | 87 | 0.80 | B | " |
| 506 | Dye (7) | 50 | 90 | 0.81 | B | " |
| 507 | Dye (36) | 50 | 89 | 0.86 | A | " |
| 508 | Dye (37) | 50 | 91 | 0.83 | A | " |
| 509 | Dye (38) | 50 | 89 | 0.85 | A | " |
| 510 | Dye (41) | 50 | 87 | 0.84 | A | " |

-continued

| | |
|---|---|
| Gelatin | 0.6 g/m$^2$ |
| Dye (16) | 25 mg/m$^2$ |
| Dye (15) | 40 mg/m$^2$ |
| Antihalation Layer of Support C: | |
| Gelatin | 0.6 g/m$^2$ |
| Dye (16) | 40 mg/m$^2$ |
| Dye (15) | 65 mg/m$^2$ |

On each of Supports A (duplicate), B, and C were coated the following layers to obtain a multi-layer color paper (designated Samples 601 to 604).

Coating compositions for emulsion layers were prepared as follows.

Preparation of 1st Layer Coating Composition

To 19.1 g of a yellow coupler (ExY), 4.4 g of a dye image stabilizer (Cpd-1), and 1.8 g of a dye image stabilizer (Cpd-7) were added 27.2 ml of ethyl acetate, 4.1 g of a solvent (Solv-3), and 4.1 g of a solvent (Solv-6) to form a solution. The solution was emulsified and dispersed in 185 ml of a 10% aqueous solution of gelatin containing 8 ml of a 10% solution of sodium dodecylbenzenesulfonate.

On the other hand, a mixed silver halide emulsion comprising a cubic silver chlorobromide emulsion having a bromide content of 80.0 mol %, a mean grain size of 0.85 μm; and a coefficient of variation of 0.08 and a cubic silver chlorobromide emulsion having a bromide content of 80.0 mol %, a mean grain size of 0.62 μm, and a coefficient of variation of 0.07 at a silver molar ratio of 1:3 was subjected to sulfur sensitization, and $5.0\times10^{-4}$ mol/mol-Ag of a blue-sensitive sensitizing dye shown below was added to the emulsion.

The above-prepared dispersion and the silver halide emulsion were mixed to prepare a coating composition for a first layer having the composition shown below.

Coating compositions for second to seventh layers were also prepared in the same manner as for the 1st layer coating composition.

Each layer was additionally contained sodium 1-hydroxy-3,5-dichloro-s-triazine as a gelatin hardening agent.

Spectral sensitizing dyes used in silver halide emulsion layers were as follows.

For Blue-Sensitive Emulsion Layer:

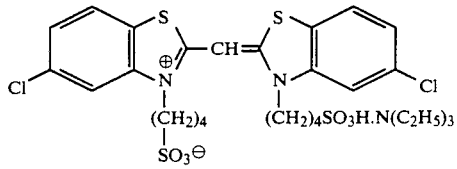

($5.0\times10^{-4}$ mol/mol of silver halide)

For Green-Sensitive Emulsion Layer:

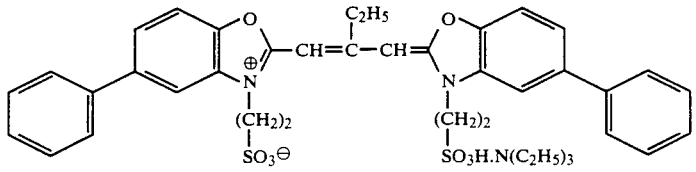

($4.0\times10^{-4}$ mol/mol of silver halide)

and

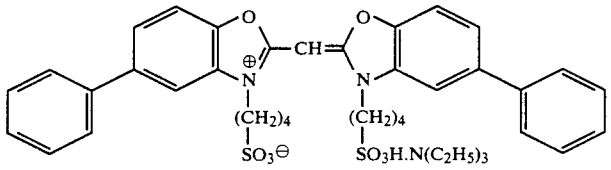

($7.0\times10^{-5}$ mol/mol of silver halide)

For Red-Sensitive Emulsion Layer:

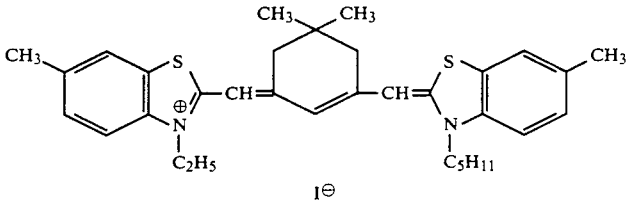

-continued ($0.9 \times 10^{-4}$ mol/mol of silver halide)

The red-sensitive emulsion layer further contained a compound shown below in an amount of $2.6 \times 10^{-3}$ mol/mol of silver halide.

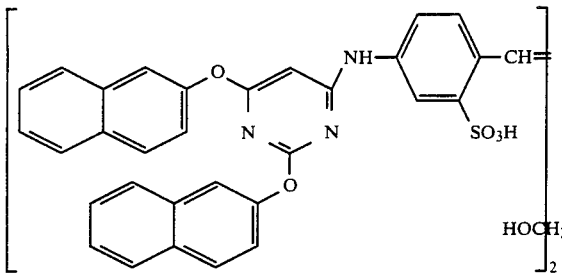

Each of the blue-, green- and red-sensitive emulsion layers further contained 1-(5-methylureidophenyl)-5-mercaptotetrazole in an amount of $4.0 \times 10^{-6}$ mol, $3.0 \times 10^{-5}$ mol, or $1.0 \times 10^{5}$ mol, respectively, per mol of silver halide, and 2-methyl-5-t-octylhydroquinone in an amount of $8 \times 10^{-3}$ mol, $2 \times 10^{-2}$ mol, or $2 \times 10^{-2}$ mol, respectively, per mol of silver halide.

The blue- and green-sensitive emulsion layers furthermore contained 4-hydroxy-6-methyl-1,3,3a,7-tetraazaindene in an amount of $1.2 \times 10^{-2}$ mol and $1.1 \times 10^{-2}$ mol, respectively, per mol of silver halide.

To the third and fifth layers of the sample using Support A (Sample 602) were added the following comparative dyes in amounts shown below, respectively.

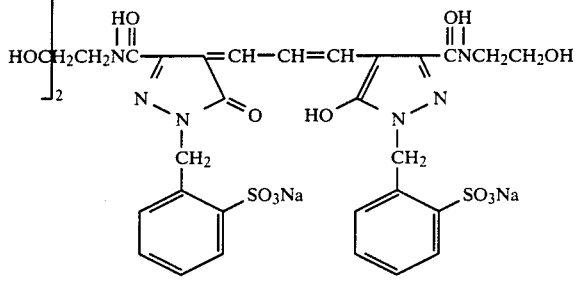

7.5 mg/m²

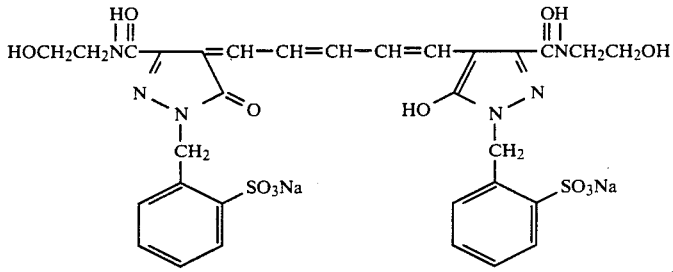

21 mg/m²

Layer Structure

Support

A polyethylene-laminated paper support containing a white pigment ($TiO_2$) and a bluing dye (ultramarine) in the polyethylene layer on the side to be coated with the 1st layer, with a subbing layer or an antihalation layer as described above being provided thereon (Support A, B, or C).

| | |
|---|---|
| 1st Layer (Blue-Sensitive Layer): | |
| Silver chlorobromide emulsion (AgBr: 80 mol %) (prepared as described above) | 0.26 g of Ag/m² |
| Gelatin | 1.83 g/m² |
| Yellow coupler (ExY) | 0.83 g/m² |
| Dye image stabilizer (Cpd-1) | 0.19 g/m² |
| Dye image stabilizer (Cpd-7) | 0.08 g/m² |
| Solvent (Solv-3) | 0.18 g/m² |
| Solvent (Solv-6) | 0.18 g/m² |
| 2nd Layer (Color Mixing Preventing Layer): | |
| Gelatin | 0.99 g/m² |
| Color mixing inhibitor (Cpd-6) | 0.08 g/m² |
| Solvent (Solv-1) | 0.16 g/m² |
| Solvent (Solv-4) | 0.08 g/m² |
| 3rd Layer (Green-Sensitive Layer): | |
| Silver chlorobromide emulsion [1:1 (by Ag molar ratio) mixture of a cubic emulsion having an AgBr content of 90 mol %, a mean grain size of 0.47 μm, and a coefficient of variation of 0.12 and a cubic emulsion having an AgBr content of 90 mol %, a mean grain size of 0.36 μm, and a coefficient of variation of 0.09] | 0.16 g of Ag/m² |
| Gelatin | 1.79 g/m² |

-continued

| | |
|---|---|
| Magenta coupler (ExM) | 0.32 g/m$^2$ |
| Dye image stabilizer (Cpd-3) | 0.20 g/m$^2$ |
| Dye image stabilizer (Cpd-8) | 0.03 g/m$^2$ |
| Dye image stabilizer (Cpd-4) | 0.01 g/m$^2$ |
| Dye image stabilizer (Cpd-9) | 0.04 g/m$^2$ |
| Solvent (Solv-2) | 0.65 g/m$^2$ |
| 4th Layer (Ultraviolet Absorbing Layer): | |
| Gelatin | 1.58 g/m$^2$ |
| Ultraviolet absorbing (UV-1) | 0.47 g/m$^2$ |
| Color mixing inhibitor (Cpd-5) | 0.05 g/m$^2$ |
| Solvent (Solv-5) | 0.24 g/m$^2$ |
| 5th Layer (Red-Sensitive Layer): | |
| Silver chlorobromide emulsion [1:2 (by Ag molar ratio) mixture of a cubic emulsion having an AgBr content of 70 mol %, a mean grain size of 0.49 μm, and a coefficient of variation of 0.08 and a cubic emulsion having an AgBr content of 70 mol %, a mean grain size of 0.34 μm, and a coefficient of variation of 0.10] | 0.23 g of Ag/m$^2$ |
| Gelatin | 1.34 g/m$^2$ |
| Cyan coupler (ExC) | 0.30 g/m$^2$ |
| Dye image stabilizer (Cpd-6) | 0.17 g/m$^2$ |
| Dye image stabilizer (Cpd-7) | 0.40 g/m$^2$ |
| Solvent (Solv-6) | 0.20 g/m$^2$ |
| 6th Layer (Ultraviolet Absorbing Layer): | |
| Gelatin | 0.53 g/m$^2$ |
| Ultraviolet absorbing (UV-1) | 0.16 g/m$^2$ |
| Color mixing inhibitor (Cpd-5) | 0.02 g/m$^2$ |
| Solvent (Solv-5) | 0.08 g/m$^2$ |
| 7th Layer (Protective Layer): | |
| Gelatin | 1.33 g/m$^2$ |
| Acrylic-modified polyvinyl alcohol (degree of modification: 17%) | 0.17 g/m$^2$ |
| Liquid paraffin | 0.03 g/m$^2$ |

Dye Image Stabilizer (Cpd-1):

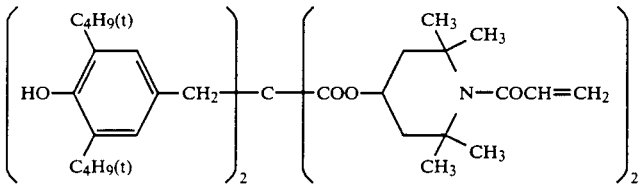

Dye Image Stabilizer (Cpd-3):

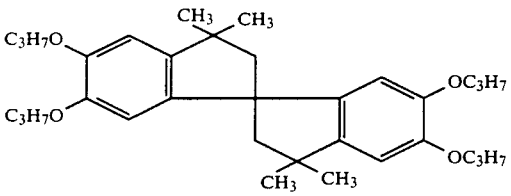

Dye Image Stabilizer (Cpd-4):

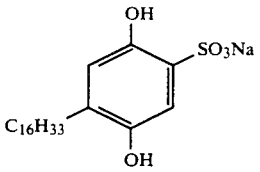

Color Mixing Inhibitor (Cpd-5):

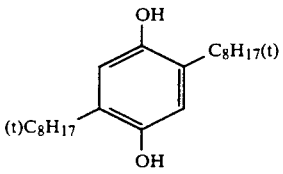

Dye Image Stabilizer (Cpd-6):

A 2:4:4 (by weight ratio) mixture of

-continued
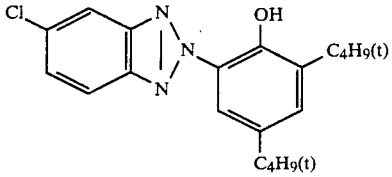
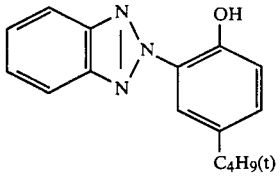
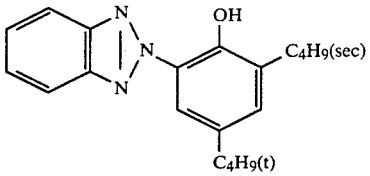
Dye Image Stabilizer (Cpd-7):
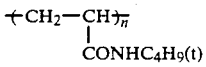
(Average molecular weight: 80,000)
Dye Image Stabilizer (Cpd-8):
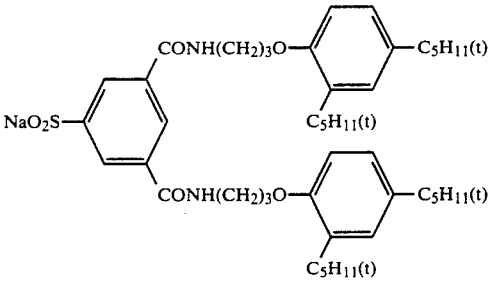
Dye Image Stabilizer (Cpd-9):
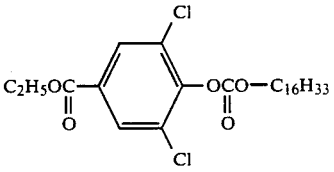
Ultraviolet Absorbent (UV-1):
A 4:2:4 mixture (by weight) of
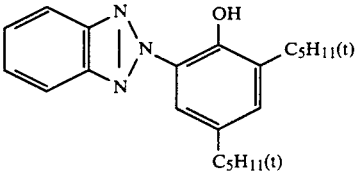
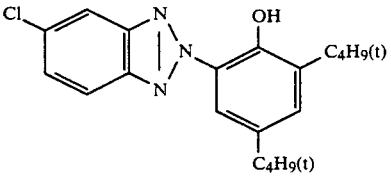

-continued
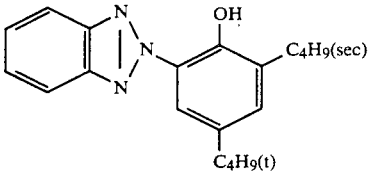
Solvent (Solv-1):
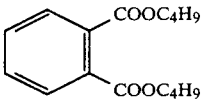
Solvent (Solv-2):
A 2:1 (by volume) mixture of
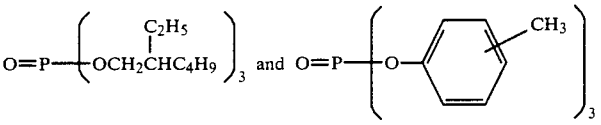
Solvent (Solv-3):
$O{=}P{\leftarrow}O{-}C_9H_{19}(iso))_3$
Solvent (Solv-4):
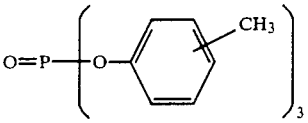
Solvent (Solv-5):
$COOC_8H_{17}$
|
$(CH_2)_8$
|
$COOC_8H_{17}$
Solvent (Solv-6):
$C_8H_{17}CHCH(CH_2)_7COOC_8H_{17}$
$\backslash\ /$
$O$
Yellow Coupler (ExY):
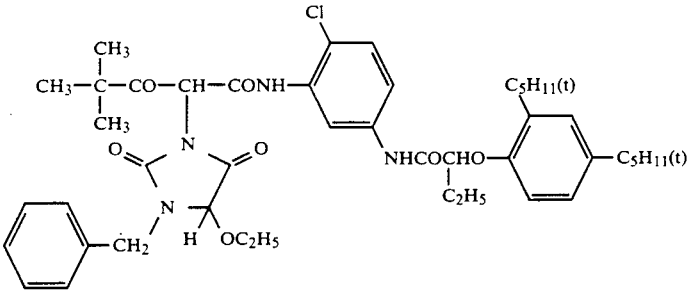
Magenta Coupler (ExM):
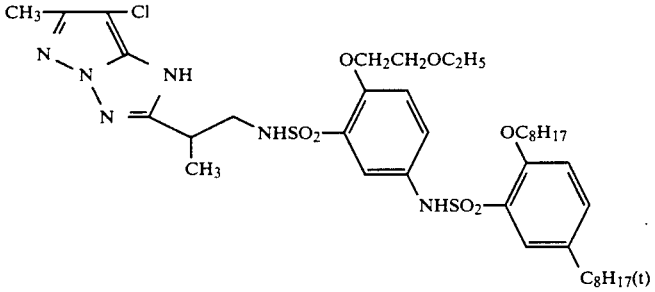
Cyan Coupler (ExC):
A 1:1 (by mole) mixture of -continued

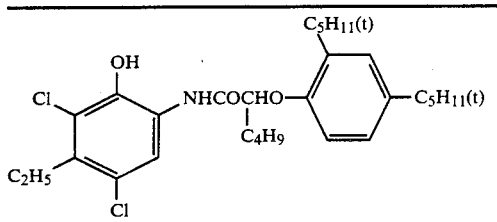

and

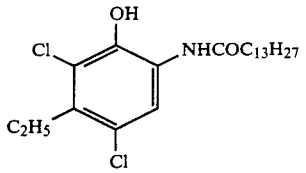

Each of Sample Nos. 601 to 604 was sensitometrically stepwise exposed to light through a blue, green, or red filter by using a sensitometer ("FWH Type" manufactured by Fuji Photo Film Co., Ltd.; color temperature of light source: 3200° K.). On the other hand, the sample was exposed to light for determination of resolving power (CTF).

The exposed sample was processed according to the following procedure, and optical densities were measured. The results obtained are shown in Table 7 below.

Processing Procedure:

| Processing Step | Temperature | Time |
|---|---|---|
| Color Development | 37° C. | 3'30" |
| Bleach-Fix | 33° C. | 1'30" |
| Washing | 24 to 34° C. | 3' |
| Drying | 70 to 80° C. | 1' |

| Color Developer Formulation: | |
|---|---|
| Water | 800 ml |
| Diethylenetriaminepentaacetic acid | 1.0 g |
| Nitrilotriacetic acid | 2.0 g |
| 1-Hydroxyethylidene-1,1-diphosphonic acid (60% solution) | 1.0 ml |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |
| Hydroxylamine sulfate | 3.0 g |
| Brightening agent ("WHITEX 4" produced by Sumitomo Chemical Co., Ltd.) | 1.0 g |
| Water to make | 1000 ml |
| pH (25° C.) | 10.25 |
| **Bleach-Fix Bath:** | |
| Water | 400 ml |
| Ammonium thiosulfate (70%) | 150 ml |
| Sodium sulfite | 18 g |
| Ammonium ethylenediaminetetraacetato ferrate | 55 g |

-continued

| | |
|---|---|
| Disodium ethylenediaminetetraacetate | 5 g |
| Water to make | 1000 ml |
| pH (25° C.) | 6.70 |

TABLE 7

| Sample No. | Support | Dye in Support | Relative Sensitivity Cyan | Relative Sensitivity Magenta | $D_{min}$* Cyan | $D_{min}$* Magenta | Resolving Power (CTF 50%) (line/mm) Cyan | Resolving Power (CTF 50%) (line/mm) Magenta | Resolving Power (CTF 50%) (line/mm) Yellow |
|---|---|---|---|---|---|---|---|---|---|
| 601 | A | — | 100 | 100 | 0.02 | 0.02 | 7 | 11 | 8 |
| 602 | A | comparative | 58 | 67 | 0.02 | 0.02 | 10 | 14 | 11 |
| 603 | B | Dye (16) Dye (15) | 82 | 80 | 0.02 | 0.02 | 1 | 15 | 12 |
| 604 | C | Dye (16) Dye (15) | 71 | 66 | 0.03 | 0.03 | 14 | 18 | 14 |

Note: $D_{min}$* represents [$D_{min}$ (minimum density) — reflection density of support]

It can be seen that use of the dye according to the present invention in an antihalation layer is effective to suppress reduction of sensitivity and to make color remaining inconspicuous. Further, resolving power can be markedly improved by the use of the dye in the amount shown above.

When the same test was made on rapidly developable color papers prepared by providing an emulsion layer having a high silver chloride content on Support B or C (such as the multi-layer light-sensitive materials described in EP 273,429, EP 273,430, and Japanese Patent Application No. 63-7861 (corresponding to JP-A-1-183647)), similar results as described above can be obtained.

EXAMPLE 7

Preparation of Silver Halide Emulsion

To a 3% aqueous solution of lime-processed gelatin were added 3.3 g of sodium chloride and 3.2 ml of a 1% aqueous solution of N,N'-dimethylimidazolidine-2-thione. To the solution were added an aqueous solution containing 0.2 mol of silver nitrate and an aqueous solution containing 0.2 mol of sodium chloride and 15 μg of rhodium trichloride at 56° C. while vigorously stirring. Subsequently, an aqueous solution containing 0.780 mol of silver nitrate and an aqueous solution containing 0.780 mol of sodium chloride and 4.2 mg of potassium ferrocyanide were added thereto at 56° C. while vigorously stirring. Five minutes later from the completion of the addition of the silver nitrate aqueous solution and the alkali halide aqueous solution, an aqueous solution containing 0.020 mol of silver nitrate and an aqueous solution containing 0.015 mol of potassium bromide, 0.005 mol of sodium chloride, and 0.8 mg of potassium hexachloroiridate (IV) were added thereto at 40° C. while vigorously stirring, followed by mixing. After desalting and washing with water, 90.0 g of lime-processed gelatin was added to the resulting emulsion, triethylthiourea was added thereto, and the emulsion was subjected to optimum chemical sensitization.

An electron micrograph of the resulting silver chlorobromide emulsion (designated Emulsion A) revealed that the silver halide grains were all cubic and had a mean grain size of 0.52 μm with a coefficient of variation of 0.08. The mean grain size as herein referred to is a mean of a diameter of a circle equivalent to the projected area of the grain, and the coefficient of variation is obtained by dividing a standard deviation of grain size by the mean grain size.

The halogen composition of the grains of Emulsion A was determined by X-ray diffractometry. As a result, there wee observed in the diffraction pattern a main peak assigned to 100% silver chloride and, in addition, a broad peak centered at 70% silver chloride (30% silver bromide) and extending at the toe to around 60% silver chloride (40% silver bromide).

Preparation of Liqht-Sensitive Material

A coating composition comprising 0.8 g/m$^2$ of gelatin and a dispersion of the dye shown in Table 8 below which was prepared in the same manner as in Example 1 was coated on a paper support having polyethylene laminated on both sides thereof to form an antihalation layer. The thus prepared support was coated the following layers to obtain a multi-layer color paper (designated Samples 701 to 703). The coating compositions for emulsion layers were prepared as follows.

Preparation of Coating Composition for 1st Layer

To 19.1 g of yellow coupler (ExY), 4.4 g of a dye image stabilizer (Cpd-1), and 1.4 g of a dye image stabilizer (Cpd-7) were added 27.2 ml of ethyl acetate and 8.2 g of a solvent (Solv-1) to form a solution. The solution was emulsified and dispersed in 185 ml of a 10% aqueous solution of gelatin containing 8 ml of a 10% solution of sodium dodecylbenzenesulfonate.

On the other hand, a red-sensitive sensitizing dye (Dye-1) shown below was added to Emulsion A above prepared.

The above-prepared dispersion and the spectrally sensitized Emulsion A were mixed to prepare a coating composition for a first layer having the composition shown below.

Coating compositions for second to seventh layers were also prepared in the same manner as for the 1st layer coating composition.

Each layer additionally contained sodium 2,4-dichloro-6-hydroxy-1,3,5-triazine as a gelatin hardening agent.

Spectral sensitizing dyes used in silver halide emulsion layers were as follows.

For 1st Layer (Red-Sensitive Yellow-Forming Layer):
(Dye-1)

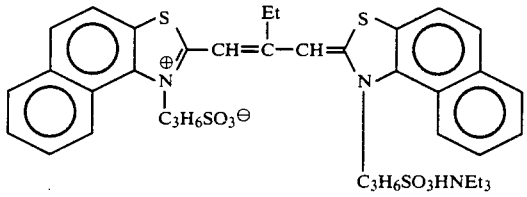

($1.0 \times 10^{-4}$ mol/mol of silver halide)

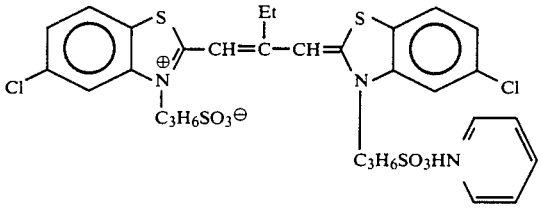

($1.0 \times 10^{-4}$ mol/mol of silver halide)

For 3rd Layer (Infrared-Sensitive Magenta-Forming Layer):
(Dye-2)

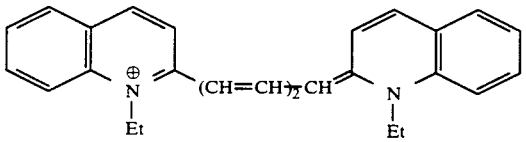

($4.5 \times 10^{-5}$ mol/mol of silver halide)

For 5th Layer (Infrared-Sensitive Cyan-Forming Layer):
(Dye-3)

-continued

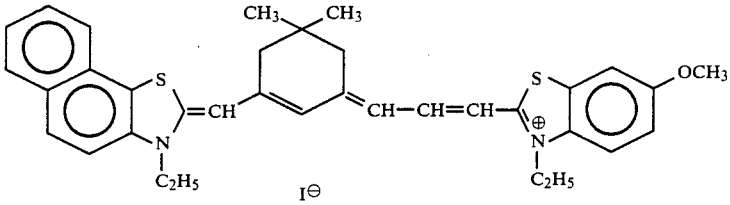

(0.5 × $10^{-5}$ mol/mol of silver halide)

The 3rd and 5th layers containing Dye-2 and Dye-3, respectively, further contained $1.8\times10^{-3}$ mol/mol of silver halide of the following compound:

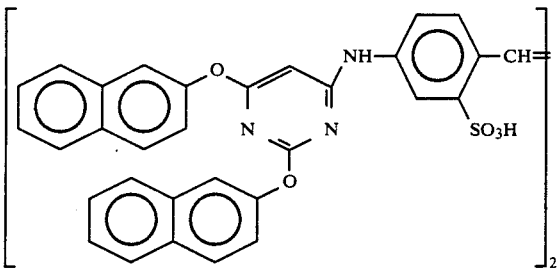

Further, to each of the yellow-forming emulsion layer, magenta-forming emulsion layer, and cyan-forming emulsion layer was added $8.0\times10^{-4}$ mol/mol of silver halide of 1-(5-methylureidophenyl)-5-mercaptotetrazole.

For prevention of irradiation, the following dyes were added to each emulsion layer.

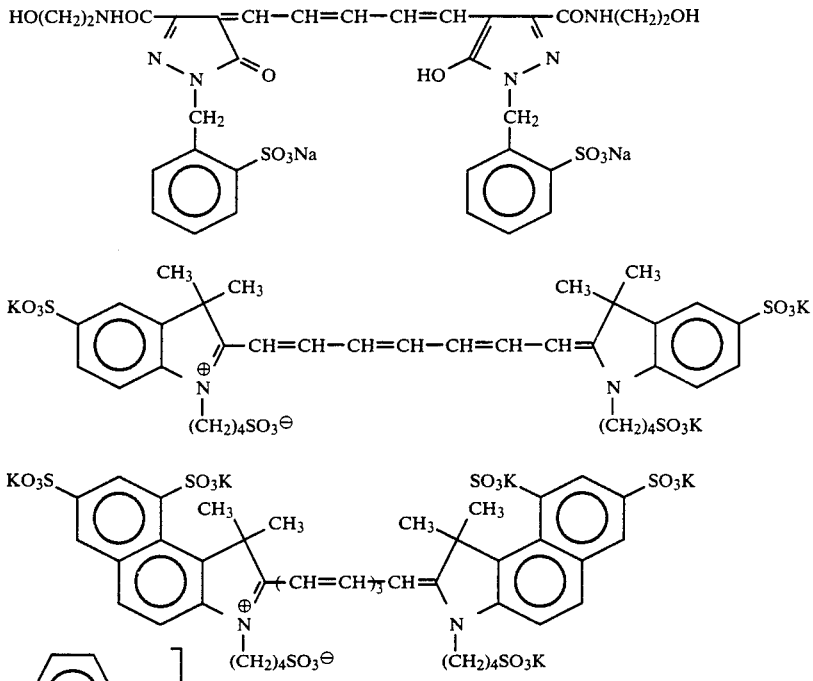

Layer Structure

Support

A polyethylene-laminated paper support containing a white pigment ($TiO_2$) and a bluing dye (ultramarine) in the polyethylene layer on the side to be coated with the 1st layer.

| | |
|---|---|
| 1st Layer (Red-Sensitive Yellow-Forming Layer): | |
| Emulsion A | 0.30 g of Ag/$m^2$ |
| Gelatin | 1.86 g/$m^2$ |
| Yellow coupler (ExY) | 0.82 g/$m^2$ |
| Dye image stabilizer (Cpd-1) | 0.19 g/$m^2$ |
| Solvent (Solv-1) | 0.35 g/$m^2$ |
| Dye image stabilizer (Cpd-7) | 0.06 g/$m^2$ |
| 2nd Layer (Color Mixing Preventing Layer): | |
| Gelatin | 0.99 g/$m^2$ |
| Color mixing inhibitor (Cpd-5) | 0.08 g/$m^2$ |
| Solvent (Solv-1) | 0.16 g/$m^2$ |

-continued

| | |
|---|---|
| Solvent (Solv-4) | 0.08 g/m$^2$ |
| 3rd Layer (Infrared-Sensitive Magenta-Forming Layer): | |
| Emulsion A | 0.12 g of Ag/m$^2$ |
| Gelatin | 1.24 g/m$^2$ |
| Magenta coupler (ExM) | 0.20 g/m$^2$ |
| Dye image stabilizer (Cpd-2) | 0.03 g/m$^2$ |
| Dye image stabilizer (Cpd-3) | 0.15 g/m$^2$ |
| Dye image stabilizer (Cpd-4) | 0.02 g/m$^2$ |
| Dye image stabilizer (Cpd-9) | 0.02 g/m$^2$ |
| Solvent (Solv-2) | 0.40 g/m$^2$ |
| 4th Layer (Ultraviolet Absorbing Layer): | |
| Gelatin | 1.58 g/m$^2$ |
| Ultraviolet absorbent (UV-1) | 0.47 g/m$^2$ |
| Color mixing inhibitor (Cpd-5) | 0.05 g/m$^2$ |
| Solvent (Solv-5) | 0.24 g/m$^2$ |
| 5th Layer (Infrared-Sensitive Cyan-Forming Layer): | |
| Emulsion A | 0.23 g of Ag/m$^2$ |
| Gelatin | 1.34 g/m$^2$ |
| Cyan coupler (ExC) | 0.32 g/m$^2$ |
| Dye image stabilizer (Cpd-6) | 0.17 g/m$^2$ |
| Dye image stabilizer (Cpd-7) | 0.40 g/m$^2$ |
| Dye image stabilizer (Cpd-8) | 0.04 g/m$^2$ |
| Solvent (Solv-6) | 0.15 g/m$^2$ |
| 6th Layer (Ultraviolet Absorbing Layer): | |
| Gelatin | 0.53 g/m$^2$ |
| Ultraviolet absorbent (UV-1) | 0.16 g/m$^2$ |
| Color mixing inhibitor (Cpd-5) | 0.02 g/m$^2$ |
| Solvent (Solv-5) | 0.08 g/m$^2$ |
| 7th Layer (Protective Layer): | |
| Gelatin | 1.33 g/m$^2$ |
| Acrylic-modified polyvinyl alcohol (degree of modification: 17%) | 0.17 g/m$^2$ |
| Liquid paraffin | 0.03 g/m$^2$ |

Yellow Coupler (ExY):

A 1:1 (by mole) mixture of

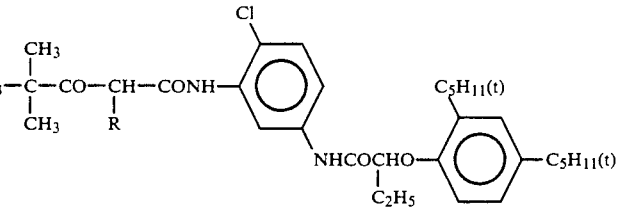

(R:

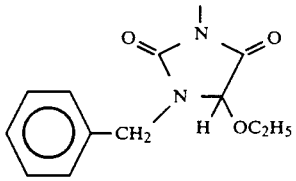

and

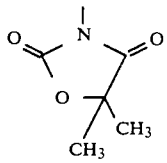

Magenta Coupler (ExM):

A 1:1 (by mole) mixture of

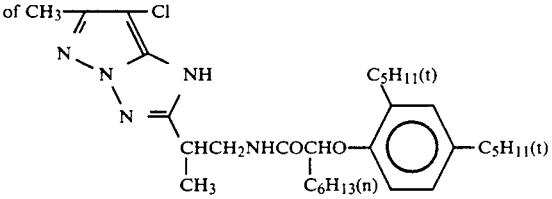

and

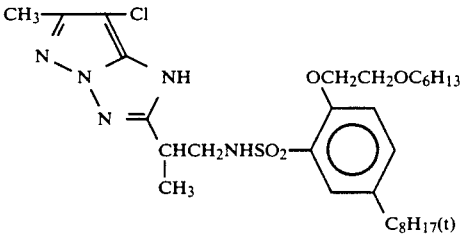

Cyan Coupler (ExC):

-continued
A 2:4:4 (by weight) mixture of 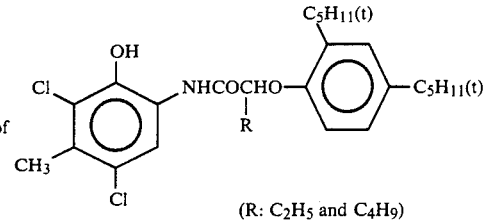 and
(R: $C_2H_5$ and $C_4H_9$)
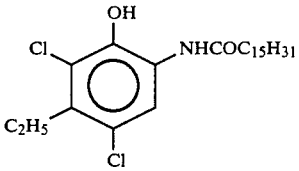
Dye Image Stabilizer (Cpd-1):
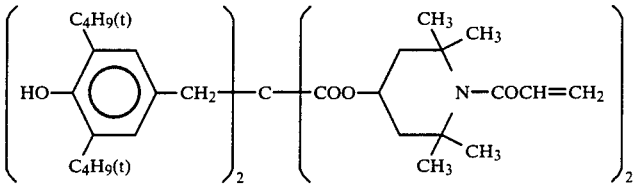
Dye Image Stabilizer (Cpd-2):
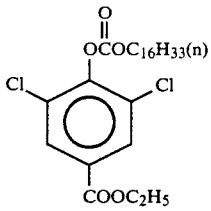
Dye Image Stabilizer (Cpd-3):
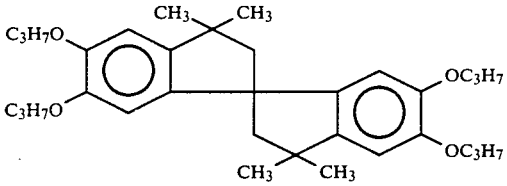
Dye Image Stabilizer (Cpd-4):
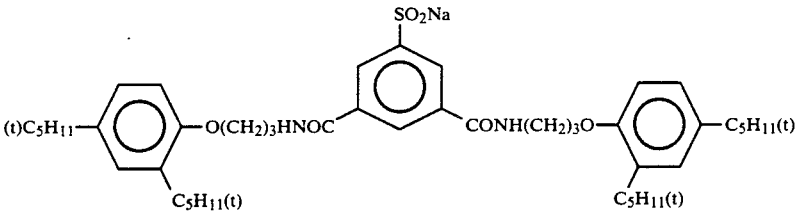
Color Mixing Inhibitor (Cpd-5):
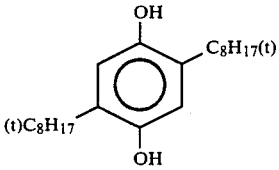
Dye Image Stabilizer (Cpd-6):

-continued
A 2:4:4 (by weight) mixture of
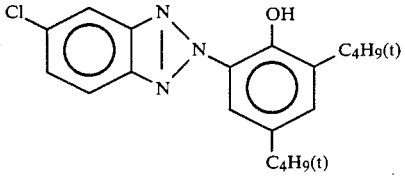
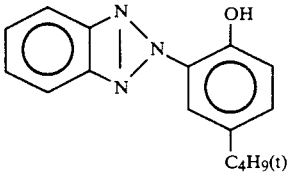
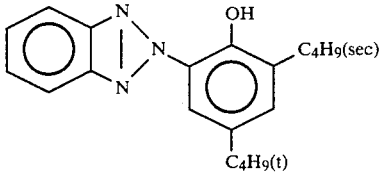
Dye Image Stabilizer (Cpd-7):
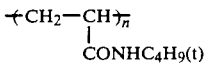
(average molecular weight: 60,000)
Dye Image Stabilizer (Cpd-8):
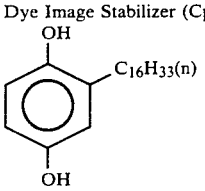
Dye Image Stabilizer (Cpd-9):
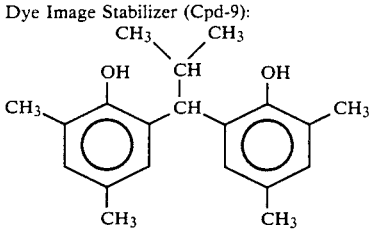
Ultraviolet Absorbent (UV-1):
A 4:2:4 (by weight) mixture of
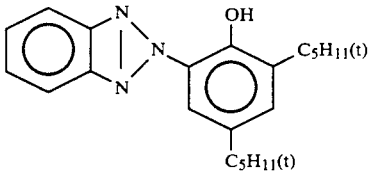
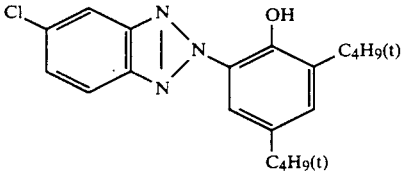
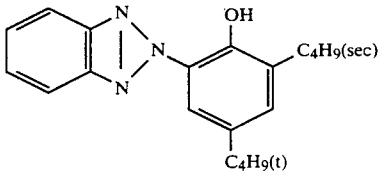
Solvent (Solv-1):
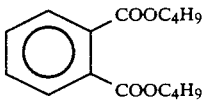
Solvent (Solv-2):
A 2:1 (by volume) mixture of $O{=}P\left(OCH_2\underset{}{\overset{C_2H_5}{C}}HC_4H_9\right)_3$ and $O{=}P\left(O-C_6H_4-CH_3\right)_3$ -continued Solvent (Solv-4):

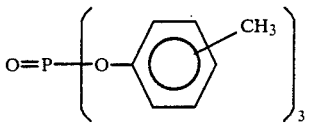

Solvent (Solv-5):

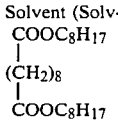

Solvent (Solv-6):

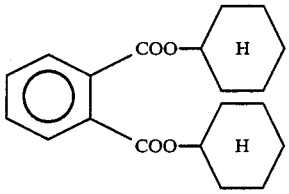

A semi-conductor laser AlGaInP (oscillation wavelength: about 670 nm), GaAlAs (oscillation wavelength: about 750 nm), or GaAlAs (oscillation wavelength: about 810 nm) was used as a laser. An apparatus was set up so that a laser beam was successively scanned over color paper moving in the direction vertical to the scanning direction by means of a polyhedral rotator. The exposure amount was controlled by electrically adjusting the exposure time and the amount of light emission of the semi-conductor laser.

Each of Samples 701 to 703 was exposed to a laser beam having the respective wavelength. Running test was carried out by developing the exposed sample by means of a paper processor according to the processing procedure described below until the replenisher of the color developer reached twice the tank volume.

Processing Procedure

| Processing Step | Temp. (°C.) | Time (second) | Rate of Replenishment (ml/m$^2$) | Volume of Tank (l) |
|---|---|---|---|---|
| Color Development | 35 | 45 | 161 | 17 |
| Bleach-Fix | 30 to 35 | 45 | 215 | 17 |
| Rinsing (1) | 30 to 35 | 20 | — | 10 |
| Rinsing (2) | 30 to 35 | 20 | — | 10 |
| Rinsing (3) | 30 to 35 | 20 | 350 | 10 |
| Drying | 70 to 80 | 60 | | |

Note: Rinsing was carried out in a counter-current system of from (3) to (1).

Processing solutions used had the following formulations.

| Color Developer: | Tank Solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 5.5 g | 7.0 g |
| Brightening agent ("WHITEX 4B" produced by Sumitomo Chemical Co., Ltd.) | 1.0 g | 2.0 g |
| Water to make | 1000 ml | 1000 ml |
| pH (25° C.) | 10.05 | 10.45 |

Bleach-Fix Bath:
(Tank solution and replenisher had the same composition)

| | |
|---|---|
| Water | 400 ml |
| Ammonium thiosulfate (700 g/l) | 100 ml |
| Sodium sulfite | 17 g |
| Ammonium ethylenediaminetetraacetato ferrate | 55 g |
| Disodium ethylenediaminetetraacetate | 5 g |
| Ammonium bromide | 40 g |
| Water to made | 1000 ml |
| pH (25° C.) | 6.0 |

Rinsing Solution (Tank solution and replenisher had the same composition)

Deionized water containing not more than 3 ppm of calcium or magnesium.

The thus process samples were evaluated for resolving power, and sharpness of edges in the same manner as in Example 1, and the results obtained are shown in Table 8 below.

TABLE 8

| Sample No. | Dye | Resolving Power (line/mm) Yellow | Magenta | Cyan | Sharpness of Edge (Visual Observation) Yellow | Magenta | Cyan | Remarks |
|---|---|---|---|---|---|---|---|---|
| 701 | none | 18 | 20 | 13 | poor | medium | poor | Comparison |
| 702 | Dye (15) (27 mg) Dye (13) | 20 | ≧25 | ≧25 | good | good | good | Invention |

TABLE 8-continued

| Sample No. | Dye | Resolving Power (line/mm) Yellow | Magenta | Cyan | Sharpness of Edge (Visual Observation) Yellow | Magenta | Cyan | Remarks |
|---|---|---|---|---|---|---|---|---|
| 703 | (50 mg) Dye (15) (27 mg) Dye (9) (50 mg) | 24 | ≧25 | ≧25 | good | good | good | " |

In can be seen from the results of Table 8 that the resolving power and sharpness of edge can be markedly improved by the present invention.

EXAMPLE 8

The following 1st to 14th layers were coated on the surface of a 100 μm thick paper support having polyethylene laminated on both sides thereof, and the following 15th to 16th layers were coated on the back side of the support to prepare a color photographic material. The polyethylene layer of the support on the side to be coated with the 1st layer contained titanium dioxide as a white pigment and trace amount of ultramarine as a bluing dye. The chromaticity of the surface of the support expressed in an L*a*b* colorimetric system was 88.0, −0.20, and −0.75.

Emulsions in the layers were prepared in accordance with the following process. The emulsion for the 14th layer was not subjected to surface chemical sensitization (Lippmann emulsion).

Preparation of Emulsion (EMI)

A potassium bromide aqueous solution and a silver nitrate aqueous solution were simultaneously added to a gelatin aqueous solution at 75° C. while vigorously stirring over a period of 15 minutes to obtain an octahedral silver bromide emulsion having a mean grain size of 0.40 μm. To the emulsion were successively added 0.3 g of 3,4-dimethyl-1,3-thiazoline-2-thione, 6 mg of sodium thiosulfate, and 7 mg of chloroauric acid tetrahydrate each per mol of silver, followed by heating at 75° C. for 80 minutes to conduct chemical sensitization. The thus obtained grains were allowed to grow as a core under the same environmental conditions as for the first grain formation to finally obtain an octahedral monodisperse core/shell type silver bromide emulsion having a mean grain size of 0.7 μm with a coefficient of variation of about 0.1%. To the emulsion were added 1.5 mg of sodium thiocyanate and 1.5 mg of chloroauric acid tetrahydrate each per mol of silver, followed by heating at 60° C. for 60 minutes to conduct chemical sensitization to prepare an internal latent image type silver halide emulsion (designated EM1).

Each light-sensitive emulsion layer contained $1\times10^{-3}$% of a nucleating agent (ExZK-1), $1\times10^{-2}$% of a nucleating agent (ExZK-2) and $1\times10^{-2}$% of a nucleation accelerator (Cpd-22), each based on the weight of silver halide. Further, each layer contained Alkanol XC (produced by E.I. Du Pont) and a sodium alkyl-benzenesulfonate as dispersion aids and a succinate and Magefac F-120 (produced by Dai-Nippon Ink K. K.) as a coating aid. The silver halide layer and colloidal silver-containing layer further contained stabilizers (Cpd-23, Cpd-24, and Cpd-25).

| Layer Structure: | |
|---|---|
| 1st Layer (Antihalation Layer): | |
| Black colloidal silver | 0.10 g/m$^2$ |
| Gelatin | 0.70 g/m$^2$ |
| 2nd Layer (Intermediate Layer): | |
| Gelatin | 0.70 g/m$^2$ |
| 3rd Layer (Low-Sensitive Red-Sensitive Layer): | |
| Silver bromide emulsion (mean grain size: 0.25 μm; coefficient of variation of size: 0.08; octahedral grains) having been spectrally sensitized with red sensitizing dyes (ExS-1, 2, and 3) | 0.04 g of Ag/m$^2$ |
| Silver chlorobromide emulsion (silver chloride: 5 mol %; mean grain size: 0.40 μm; coefficient of variation of size: 0.10; octahedral grains) having been spectrally sensitized with red sensitizing dyes (ExS-1, 2, and 3) | 0.08 g of Ag/m$^2$ |
| Gelatin | 1.00 g/m$^2$ |
| Cyan couplers (1:1:0.2 mixture of ExC-1, 2, and 3) | 0.30 g/m$^2$ |
| Discoloration inhibitors (equal amount mixture of Cpd-1, 2, 3, and 4) | 0.18 g/m$^2$ |
| Stain inhibitor (Cpd-5) | 0.003 g/m$^2$ |
| Dispersing medium for coupler (Cpd-6) | 0.03 g/m$^2$ |
| Solvents for coupler (equal amount mixture of Solv-1, 2, and 3) | 0.12 g/m$^2$ |
| 4th Layer (High-Sensitive Red-Sensitive Layer): | |
| Silver bromide emulsion (mean grain size: 0.60 μm; coefficient of variation of size: 0.15; octahedral grains) having been spectrally sensitized with red sensitizing dyes (ExS-1, 2, and 3) | 0.14 g of Ag/m$^2$ |
| Gelatin | 1.00 g/m$^2$ |
| Cyan couplers (1:1:0.2 mixture of ExC-1, 2, and 3) | 0.30 g/m$^2$ |
| Discoloration inhibitors (equal amount mixture of Cpd-1, 2, 3, and 4) | 0.18 g/m$^2$ |
| Dispersing medium for coupler (Cpd-6) | 0.03 g/m$^2$ |
| Solvents for coupler (equal amount mixture of Solv-1, 2, and 3) | 0.12 g/m$^2$ |
| 5th Layer (Intermediate Layer): | |
| Gelatin | 1.00 g/m$^2$ |
| Color mixing inhibitor (Cpd-7) | 0.08 g/m$^2$ |
| Solvents for color mixing inhibitor (equal amount mixture of Solv-4 and 5) | 0.16 g/m$^2$ |
| Polymer latex (Cpd-8) | 0.10 g/m$^2$ |
| 6th Layer (Low-Sensitive Green Sensitive Layer): | |
| Silver bromide emulsion (mean grain size: 0.25 μm; coefficient of variation of size: 0.08; octahedral grains) having been spectrally sensitized with green sensitizing dye (ExS-4) | 0.04 g of Ag/m$^2$ |
| Silver chlorobromide emulsion (silver chloride: 5 mol %; mean grain size: 0.40 μm; coefficient of variation of size: 0.10; octahedral grains) having been spectrally sensitized with green sensitizing dye (ExS-4) | 0.06 g of Ag/m$^2$ |
| Gelatin | 0.80 g/m$^2$ |
| Magenta couplers (equal amount mixture of ExM-1, 2, and 3) | 0.11 g/m$^2$ |
| Discoloration inhibitors (equal amount | 0.15 g/m$^2$ |

-continued

| Layer Structure: | |
|---|---|
| mixture of Cpd-9 and 26) | |
| Stain inhibitors (10:7:7:1 mixture of Cpd-10, 11, 12, and 13) | 0.025 g/m$^2$ |
| Dispersing medium for coupler (Cpd-6) | 0.05 g/m$^2$ |
| Solvents for coupler (equal amount mixture of Solv-4 and 6) | 0.15 g/m$^2$ |
| 7th Layer (High-Sensitive Green-Sensitive Layer): | |
| Silver bromide emulsion (mean grain size: 0.65 μm; coefficient of variation of size: 0.16; octahedral grains) having been spectrally sensitized with green sensitizing dye (ExS-4) | 0.10 g of Ag/m$^2$ |
| Gelatin | 0.80 g/m$^2$ |
| Magenta couplers (equal amount mixture of ExM-1, 2, and 3) | 0.11 g/m$^2$ |
| Discoloration inhibitors (equal amount mixture of Cpd-9 and 26) | 0.15 g/m$^2$ |
| Stain inhibitors (10:7:7:1 mixture of Cpd-10, 11, 12, and 13) | 0.025 g/m$^2$ |
| Dispersing medium for coupler (Cpd-6) | 0.05 g/m$^2$ |
| Solvents for coupler (equal amount mixture of Solv-4 and 6) | 0.15 g/m$^2$ |
| 8th Layer (Intermediate Layer): | |
| The same as 5th Layer. | |
| 9th Layer (Yellow Filter Layer): | |
| Colloidal yellow silver | 0.12 g/m$^2$ |
| Gelatin | 0.07 g/m$^2$ |
| Color mixing inhibitor (Cpd-7) | 0.03 g/m$^2$ |
| Solvents for color mixing inhibitor (equal amount mixture of Solv-4 and 5) | 0.10 g/m$^2$ |
| Polymer latex (Cpd-8) | 0.07 g/m$^2$ |
| 10th Layer (Intermediate Layer): | |
| The same as 5th Layer. | |
| 11th Layer (Low-Sensitive Blue-Sensitive Layer): | |
| Silver bromide emulsion (mean grain size: 0.40 μm; coefficient of variation of size: 0.08; octahedral grains) having been spectrally sensitized with blue sensitizing dyes (ExS-5 and 6) | 0.07 g of Ag/m$^2$ |
| Silver chlorobromide emulsion (silver chloride: 8 mol %; mean grain size: 0.60 μm; coefficient of variation of size: 0.11; octahedral grains) having been spectrally sensitized with blue sensitizing dyes (ExS-5 and 6) | 0.14 g of Ag/m$^2$ |
| Gelatin | 0.80 g/m$^2$ |
| Yellow couplers (equal amount mixture of ExY-1 and 2) | 0.35 g/m$^2$ |
| Discoloration inhibitor (Cpd-14) | 0.10 g/m$^2$ |
| Stain inhibitors (1:5 mixture of Cpd-5 and 15) | 0.007 g/m$^2$ |

-continued

| Layer Structure: | |
|---|---|
| Dispersing medium for coupler (Cpd-6) | 0.05 g/m$^2$ |
| Solvent for coupler (Solv-2) | 0.10 g/m$^2$ |
| 12th Layer (High-Sensitive Blue-Sensitive Layer): | |
| Silver bromide emulsion (mean grain size: 0.85 μm; coefficient of variation of size: 0.18; octahedral grains) having been spectrally sensitized with blue sensitizing dyes (ExS-5 and 6) | 0.15 g of Ag/m$^2$ |
| Gelatin | 0.60 g/m$^2$ |
| Yellow couplers (equal amount mixture of ExY-1 and 2) | 0.30 g/m$^2$ |
| Discoloration inhibitor (Cpd-14) | 0.10 g/m$^2$ |
| Stain inhibitors (1:5 mixture of Cpd-5 and 15) | 0.007 g/m$^2$ |
| Dispersing medium for coupler (Cpd-6) | 0.05 g/m$^2$ |
| Solvent for coupler (Solv-2) | 0.10 g/m$^2$ |
| 13th Layer (Ultraviolet Absorbing Layer): | |
| Gelatin | 1.00 g/m$^2$ |
| Ultraviolet absorbents (equal amount mixture of Cpd-2, 4, and 16) | 0.50 g/m$^2$ |
| Color mixing inhibitors (equal amount mixture of Cpd-7 and 17) | 0.03 g/m$^2$ |
| Dispersing medium (Cpd-6) | 0.02 g/m$^2$ |
| Solvents for color ultraviolet absorbent (equal amount mixture of Solv-2 and 7) | 0.08 g/m$^2$ |
| Antiirradiation dyes (10:13:20 mixture of Cpd-18, 19, and 20) | 0.05 g/m$^2$ |
| 14th Layer (Protective Layer): | |
| Fine silver chlorobromide (silver chloride: 97%; mean grain size: 0.1 μm) | 0.03 g of |
| Acrylic-modified polyvinyl alcohol | 0.01 g/m$^2$ |
| Equal amount mixture of polymethyl methacrylate particles (average particle size: 2.4 μm) and silicon oxide (average particle size: 5 μm) | 0.05 g/m$^2$ |
| Gelatin | 1.80 g/m$^2$ |
| Gelatin hardening agents (equal amount mixture of H-1 and 2) | 0.18 g/m$^2$ |
| 15th Layer (Backing Layer): | |
| Gelatin | 2.50 g/m$^2$ |
| Ultraviolet absorbents (equal amount mixture of Cpd-2, 4, and 16) | 0.50 g/m$^2$ |
| 16th Layer (Back Protective Layer): | |
| Equal amount mixture of polymethyl methacrylate particles (average particle size: 2.4 μm) and silicon oxide (average particle size: 5 μm) | 0.05 g/m$^2$ |
| Gelatin | 2.00 g/m$^2$ |
| Gelatin hardening agent (equal amount mixture of H-1 and 2) | 0.14 g/m$^2$ |

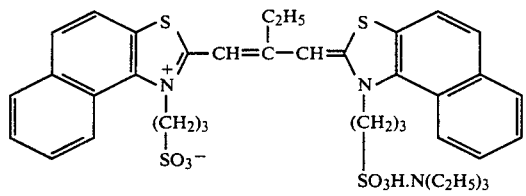

ExS-1

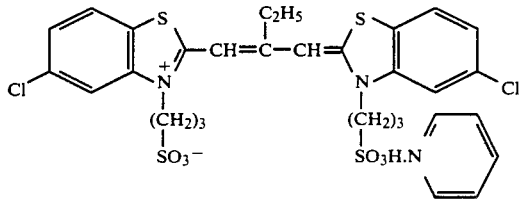

ExS-2

-continued
ExS-3
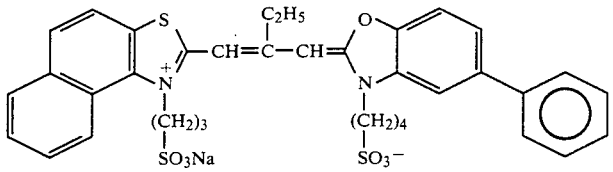
ExS-4
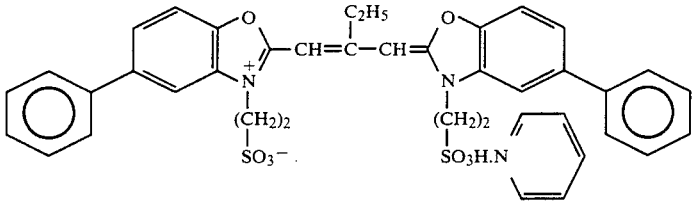
ExS-5
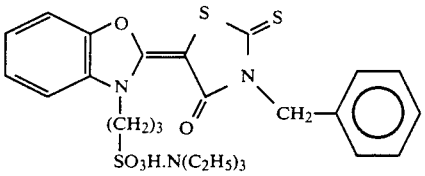
ExS-6
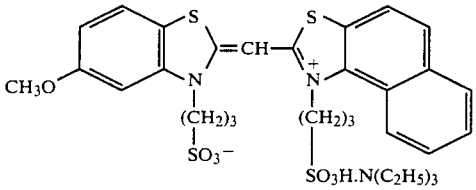
Cpd-1
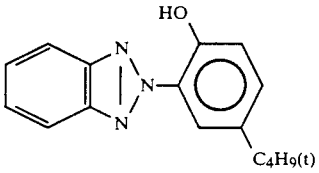
Cpd-2
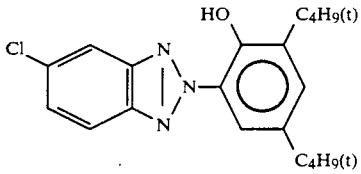
Cpd-3
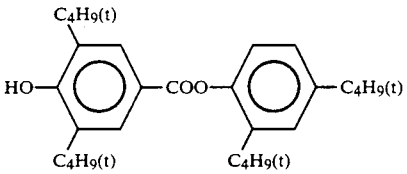
Cpd-4
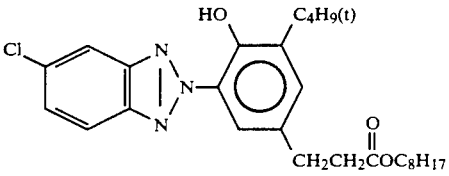

-continued
Cpd-5
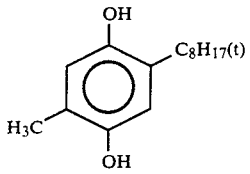
Cpd-6
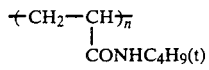
n = 100 ~ 1000
Cpd-7
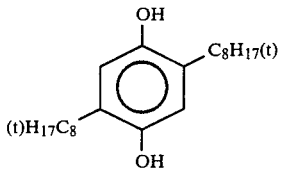
Cpd-8
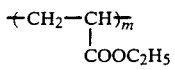
Cpd-9
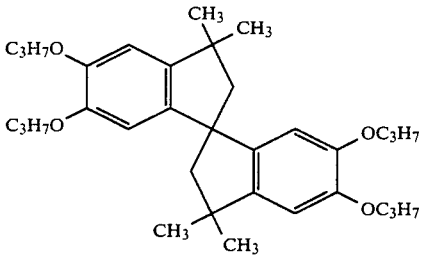
Cpd-10
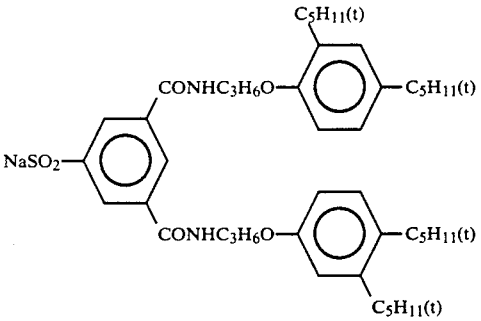
Cpd-11
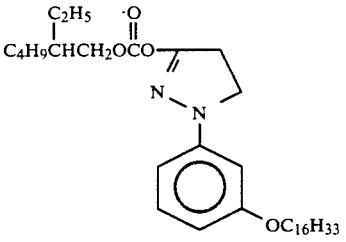
Cpd-12
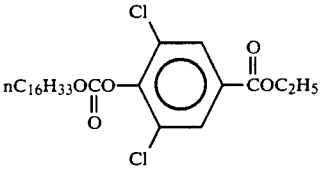

-continued
Cpd-13
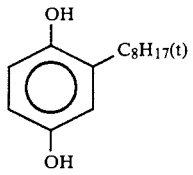
Cpd-14
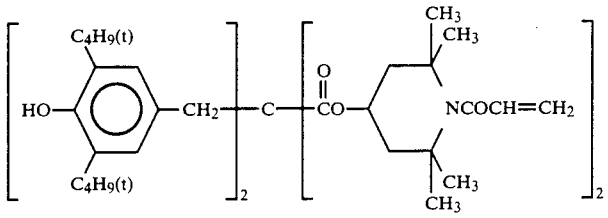
Cpd-15
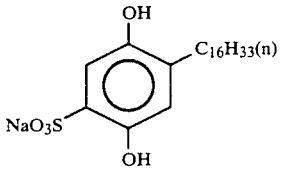
Cpd-16
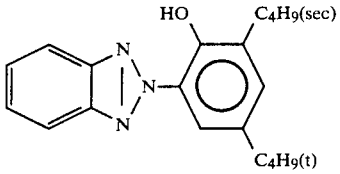
Cpd-17
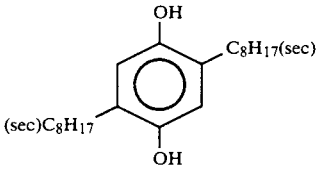
Cpd-18
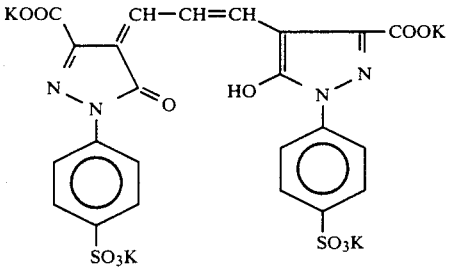
Cpd-19
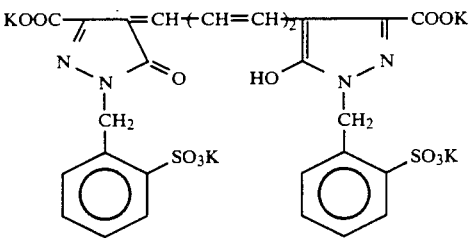
Cpd-20
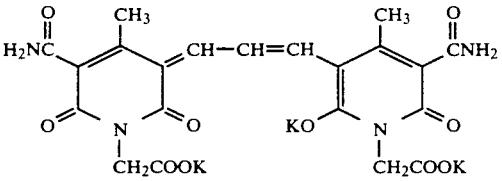

-continued
Cpd-22
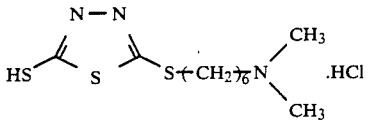
Cpd-23
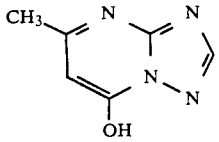
Cpd-24
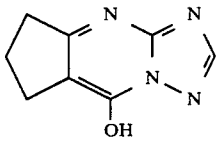
Cpd-25
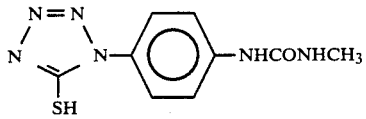
Cpd-26
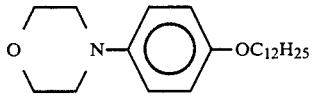
ExC-1
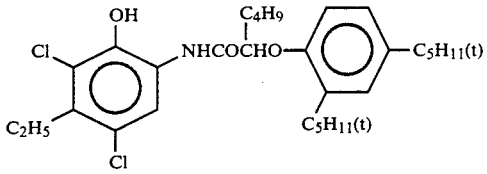
ExC-2
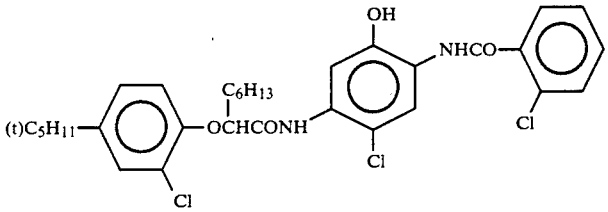
ExC-3
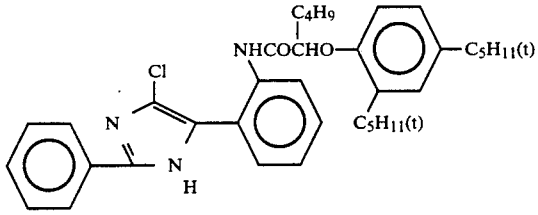
ExM-1
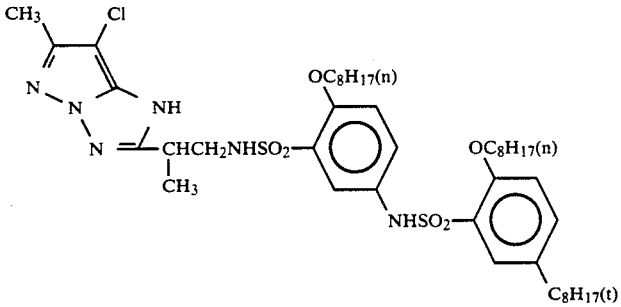

-continued

ExM-2

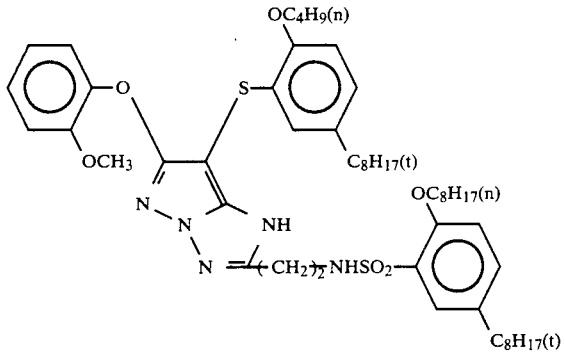

ExM-3

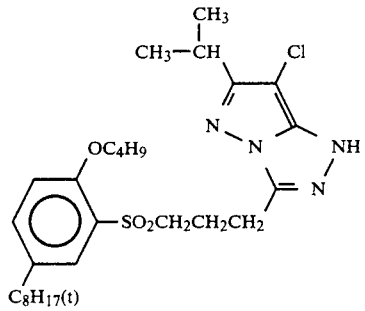

ExY-1

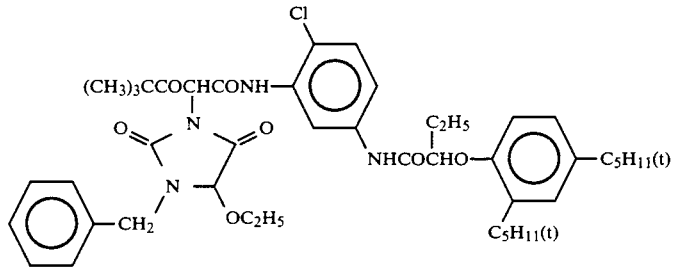

ExY-2

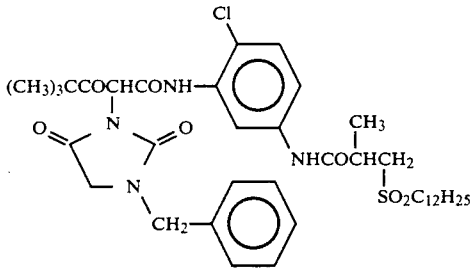

Solv-1: Di(2-ethylhexyl) sebacate
Solv-2: Trinonyl phosphate
Solv-3: Di(3-methylhexyl) phthalate
Solv-4: Tricresyl phosphate
Solv-5: Dibutyl phthalate
Solv-6: Trioctyl phosphate
Solv-7: Di(2-ethylhexyl) phthalate
H-1: 1,2-Bis(vinylsulfonylacetamido)ethane
H-2: Sodium 4,6-dichloro-2-hydroxy-1,3,5-triazine
ExZK-1: 7-(3-Ethoxythiocarbonylaminobenzamido)-9-methyl-10-propargyl-1,2,3,4-tetrahydroacridinium trifluoromethanesulfonate
ExZK-2: 2-[4-{3-[3-{3-[5-{3-[2-Chloro-5-(1-dodecyloxycarbonylethoxycarbonyl)phenylcarbamoyl]-4-hydroxy-1-naphthylthio}tetrazol-1-yl]phenyl-}ureido]benzenesulfonamido}phenyl]-1-formylhydrazine The thus prepared sample was designated Sample 801. Samples 802 to 807 were prepared in the same manner as for Sample 801, except that the 5th layer (intermediate layer) further contained a fine dispersion of the dye according to the present invention as shown in Table 9 below which was prepared as described in Example 4.

Each of Samples 801 to 807 was imagewise exposed to light and continuously processed by means of an automatic developing machine according to the following processing procedure until the amount of replenishment supplied reached three times the volume of the tank.

Processing Procedure

| Processing Step | Time (second) | Temp. (°C.) | Rate of Replenishment (ml/m$^2$) | Tank Volume (l) |
|---|---|---|---|---|
| Color Development | 135 | 38 | 300 | 15 |
| Bleach-Fix | 40 | 33 | 300 | 3 |
| Washing (1) | 40 | 33 | — | 3 |
| Washing (2) | 40 | 33 | 320 | 3 |
| Drying | 30 | 80 | | |

The washing was carried out in a counter-current system in which a replenisher was supplied to the washing bath (2), and the overflow from the washing bath (2) was introduced to the washing bath (1). The amount of the bleach-fix solution which was carried over by the light-sensitive material from the bleach-fix bath to the washing bath (1) was 35 ml/m$^2$, and the rate of replenishment of the washing water was 9.1 times that amount.

Processing solutions used had the following compositions.

| Color Developer: | Tank Solution | Replenisher |
|---|---|---|
| D-Solbit | 0.15 g | 0.20 g |
| Sodium napththalene-sulfonate.formalin condensate | 0.15 g | 0.20 g |
| Ethylenediaminetetrakis-methylenephosphonic acid | 1.5 g | 1.5 g |
| Diethyleneglycol | 12.0 ml | 16.0 ml |
| Benzyl alcohol | 13.5 ml | 18.0 ml |
| Potassium bromide | 0.80 g | — |
| Benzotriazole | 0.003 g | 0.004 g |
| Sodium sulfite | 2.4 g | 3.2 g |
| N,N-bis(carboxymethyl)-hydrazine | 6.0 g | 8.0 g |
| D-glucose | 2.0 g | 2.4 g |
| Triethanolamine | 6.0 g | 8.0 g |
| N-Ethyl-N-(β-methanesulfonamido ethyl)-3-methyl-4-aminoaniline Sulfate | 6.4 g | 8.5 g |
| Potassium carbonate | 30.0 g | 25.0 g |
| Brightening agent (diaminostilbene type) | 1.0 g | 1.2 g |
| Water to make | 1000 ml | 1000 ml |
| pH (25° C.) | 10.25 | 10.75 |

| Bleach-Fixing Solution: (Tank solution and replenisher had the same composition) | |
|---|---|
| Disodium ethylenediaminetetra-acetate dihydrate | 4.0 g |
| Ammonium ethylenediaminetetra-acetato ferrate dihydrate | 70.0 g |
| Ammonium thiosulfate (700 g/l) | 180 ml |
| Sodium p-toluenesulfinate | 20.0 g |
| Sodium bisulfite | 20.0 g |
| 5-Mercapto-1,3,4-triazole | 0.5 g |
| Ammonium nitrate | 10.0 g |
| Water to make | 1000 ml |
| pH (25° C.) | 6.20 |

Washing Water (Tank solution and replenisher had the same composition)

Tap water was passed through a mixed bed column packed with an H type strongly acidic cation exchange resin ("Amberlite IR-120B" produced by Rohm & Haas Co.) and an OH type anionic exchange resin ("Amberlite IR-400" produced by Rohm & Haas Co.) to reduce calcium and magnesium ion to 3 mg/l or less, respectively. Then, 20 mg/l of sodium isocyanurate dichloride and 1.5 g/l of sodium sulfate were added thereto. The thus prepared washing water had a pH between 6.5 and 7.5.

Evaluation of Saturation

A color paper prepared by using a Macbeth chart as an original was reproduced by using each of Samples 801 to 807, and a rate of increase of chroma value (c*) ($c^*=\sqrt{a^{*2}+b^{*2}}$) over Sample 801 (control) was determined. The results obtained are shown in Table 9 below.

TABLE 9

| Sample No. | Dye Kind | Dye Amount Added (g/m$^2$) | Saturation (c*) (%) | Remark |
|---|---|---|---|---|
| 801 | none | — | control | Comparison |
| 802 | Dye (36) | 0.14 | 4 | Invention |
| 803 | Dye (37) | 0.14 | 5 | " |
| 804 | Dye (38) | 0.14 | 4.5 | " |
| 805 | Dye (39) | 0.14 | 4.5 | " |
| 806 | Dye (41) | 0.14 | 5 | " |
| 807 | Dye (44) | 0.14 | 4 | " |

As is apparent from Table 9, Samples 802 to 807 in which the dye of the present invention is used exhibit improved saturation. Further, coloration of these samples after processing was equal to that of control, proving no color remaining dye to the dye of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having a hydrophilic colloidal layer containing a dispersion of fine solid particles of a dye represented by formula (I):

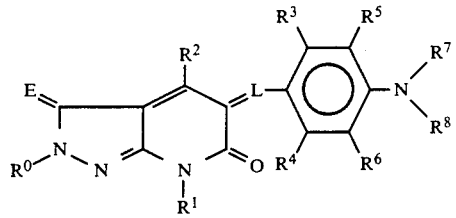

(I)

wherein L represents a nitrogen atom; E represents O, S, or N-R$^9$; R$^0$ and R$^9$ each represents a hydrogen atom, a substituted or unsubstituted alkyl group, a substituted or unsubstituted alkenyl group, a substituted or unsubstituted alkynyl group, a substituted or unsubstituted aryl group, a substituted or unsubstituted heterocyclic group, a substituted or unsubstituted amino group, a substituted or unsubstituted amino group, a substituted or unsubstituted hydrazino group, or a substituted or unsubstituted diazenyl group; R$^1$ represents a hydrogen atom, a substituted or unsubstituted alkyl group, a substituted or unsubstituted aryl group, a substituted or unsubstituted alkenyl group, a substituted or unsubstituted akynyl group, or a substituted or unsubstituted heterocyclic group; R$^2$ represent a hydrogen atom, a halogen atom, a cyano group, a nitro group, a hydroxyl group, a carboxyl group, a substituted or unsubstituted alkyl group, a substituted or unsubstituted aryl group, a substituted or unsubstituted alkenyl group, a substituted or unsubstituted heterocyclic group, a substituted or unsubstituted alkoxyl group, a substituted or unsubstituted aryloxycarbonyl group, a substituted or unsubstituted alkoxycarbonyl group, a substituted or unsubstituted arloxycarbonyl group, a substituted or unsubstituted amino group, a substituted or unsubstituted acyloxy group, a substituted or unsubstituted carbamoyl group, a substituted or unsubstituted sulfamoyl group, a substituted or unsubstituted alkylthio group, a substituted or unsubstituted arylthio group, a substituted or unsubstituted alkylsulfonyl group, a substituted or unsubstituted arylsulfonyl group, or a substituted or unsubstituted alkynyl group; $R^0$ and $R^9$ may be connected to each other to from a ring; $R^3$ and $R^4$ each represents a hydrogen atom, a halogen atom, an alkoxyl group, an alkyl group, an alkenyl group, an aryloxy group, or an aryl group; $R^5$ and $R^6$ each represents a hydrogen atom or a group capable of substituting a hydrogen atom; $R^7$ and $R^8$ each represents an alkyl group, an aryl group, a vinyl group, an acyl group, an alkylsulfonyl group, or an arylsulfonyl group; and $R^3$ and $R^5$, $R^4$ and $R^6$, $R^7$ and $R^8$, $R^5$ and $R^7$, or $R^6$ and $R^8$ may be connected to each other to form a ring.

2. A silver halide photographic material as claimed in claim 1, wherein $R^9$ represents a substituted or unsubstituted alkyl group having from 1 to 20 carbon atoms, a substituted or unsubstituted alkenyl group having from 3 to 6 carbon atoms, a substituted or unsubstituted aryl group having from 6 to 10 carbon atoms, a substituted or unsubstituted amino group, a substituted or unsubstituted hydrazino group or a substituted or unsubstituted diazenyl group.

3. A silver halide photographic material as claimed in claim 1, wherein E represents N-$R^9$.

4. A silver halide photographic material as claimed in claim 3, wherein $R^9$ is connected to $R^0$ to form an imidazole ring, a triazole ring, or a tetrazole ring.

5. A silver halide photographic material as claimed in claim 1, wherein $R^0$ represents a substituted or unsubstituted alkyl group having from 1 to 20 carbon atoms, a substituted or unsubstituted aryl group having from 6 to 20 carbon atoms, or a substituted or unsubstituted 5- or 6-membered heterocyclic ring containing at least one of B, N, O, S, Se and Te atoms as a hetero atom.

6. A silver halide photographic material as claimed in claim 1, wherein $R^1$ represents a hydrogen atom, a substituted or unsubstituted alkyl group having from 1 to 20 carbon atoms, a substituted or unsubstituted aryl group having from 6 to 10 carbon atoms, or a substituted or unsubstituted 5- or 6-membered heterocyclic group containing at least one of B, N, O, S, Se and Te atoms as hetero atom.

7. A silver halide photographic material as claimed in claim 1, wherein $R^2$ represents a hydrogen atom, a substituted or unsubstituted alkyl group having from 1 to 20 carbon atoms, a substituted or unsubstituted aryl group having from 6 to 10 carbon atoms, a substituted or unsubstituted carbamoyl group having from 1 to 20 carbon atoms, a substituted or unsubstituted alkoxycarbonyl group having from 2 to 20 carbon atoms, a substituted or unsubstituted aryloxycarbonyl group having from 7 to 11 carbon atoms, a carboxy group, or a hydroxyl group.

8. A silver halide photographic material as claimed in claim 1, wherein $R^3$ and $R^4$ each represents a hydrogen atom, a chlorine atom, a fluorine atom, a substituted or unsubstituted alkoxyl group having 1 to 10 carbon atoms or a substituted or unsubstituted alkyl group having from 1 to 10 carbon atoms.

9. A silver halide photographic material as claimed in claim 1, wherein the group capable of substituting a hydrogen atom as represented by $R^5$ or $R^6$ includes a hydrogen atom, a hydroxyl group, a cyano group, a substituted or unsubstituted alkyl group having from 1 to 10 carbon atoms, and a substituted or unsubstituted aryl group having from 6 to 10 carbon atoms, said alkyl or aryl group being bonded to the benzene ring either directly or via a divalent linking group.

10. A silver halide photographic material as claimed in claim 1, wherein $R^7$ and $R^8$ each represents a substituted or unsubstituted alkyl group having from 1 to 18 carbon atoms, a phenyl or naphthyl group which may have a substituent, a substituted or unsubstituted vinyl group having from 2 to 18 carbon atoms, a substituted or unsubstituted aliphatic or aromatic acyl group having from 1 to 18 carbon atoms, or a substituted or unsubstituted alkyl- or arylsulfonyl group having from 1 to 18 carbon atoms.

11. A silver halide photographic material as claimed in claim 1, wherein the ring formed by connecting $R^3$ and $R^5$ or connecting $R^4$ and $R^6$ includes a 5- or 6-membered ring.

12. A silver halide photographic material as claimed in claim 1, wherein the ring formed by connecting $R^5$ and $R^7$ or connecting $R^6$ and $R^8$ includes a 5- or 6-membered ring.

13. A silver halide photographic material as claimed in claim 1, wherein the ring formed by connecting $R^7$ and $R^8$ includes a 5- or 6-membered ring.

14. A silver halide photographic material as claimed in claim 1, wherein the compound of formula (I) contains the substituents having a pKa value of 3 or larger.

15. A silver halide photographic material as claimed in claim 14, wherein the compound of formula (I) contains 1 to 4 substituents having a pKa value of from 3 to 12.

16. A silver halide photographic material as claimed in claim 15, wherein the compound of formula (I) contains 1 to 4 substituents having a pKa value of from 4 to 11.

17. A silver halide photographic material as claimed in claim 1, wherein the compound of formula (I) is used in an amount of from 1 to 100 mg per $m^2$ of the photographic material.

18. A silver halide photographic material as claimed in claim 17, wherein the compound of formula (I) is used in an amount of from 1 to 800 mg per $m^2$ of the photographic material.

* * * * *